US009268302B2

(12) United States Patent
Tanaami et al.

(10) Patent No.: US 9,268,302 B2
(45) Date of Patent: Feb. 23, 2016

(54) ELECTROPHOTOGRAPHIC IMAGE FORMING APPARATUS WITH DEMOUNTABLE IMAGE FORMING UNIT

(75) Inventors: Ryuji Tanaami, Yokohama (JP); Masatoshi Yamashita, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 202 days.

(21) Appl. No.: 13/140,953

(22) PCT Filed: Dec. 28, 2009

(86) PCT No.: PCT/JP2009/071923
§ 371 (c)(1),
(2), (4) Date: Jun. 20, 2011

(87) PCT Pub. No.: WO2010/100811
PCT Pub. Date: Sep. 10, 2010

(65) Prior Publication Data

US 2011/0305480 A1 Dec. 15, 2011

(30) Foreign Application Priority Data

Mar. 2, 2009 (JP) ..... 2009-048101

(51) Int. Cl.
*G03G 21/16* (2006.01)
*G03G 21/18* (2006.01)
*G03G 15/01* (2006.01)

(52) U.S. Cl.
CPC ..... *G03G 21/1842* (2013.01); *G03G 15/0121* (2013.01); *G03G 15/0147* (2013.01);
(Continued)

(58) Field of Classification Search
CPC . G03G 21/18; G03G 5/0614; G03G 21/1814; G03G 5/047; G03G 21/1839
USPC ..... 399/111
See application file for complete search history.

(56) References Cited

U.S. PATENT DOCUMENTS 5,170,209 A * 12/1992 Tompkins et al. ..... 399/107
5,428,426 A 6/1995 Inomata et al.
(Continued)

FOREIGN PATENT DOCUMENTS

JP 9-106134 A 4/1997
JP 2005-37633 A 2/2005

OTHER PUBLICATIONS

Notification of Transmittal of the ISR and WO (Form PTO/ISA/220) mailed Jul. 19, 2010, with International Search Report (Form PCT/ISA/210) and Written Opinion of the International Searching Authority (Form PCT/ISA/237) in PCT/JP2009/071923.

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

A color electrophotographic image forming apparatus includes a plurality of electrophotographic photosensitive drums configured to develop images, an intermediary transfer member onto which developed images are transferred, and an image forming unit having a plurality of cartridge mounting portions for demountably mounting cartridges. The image forming unit is movable between a transfer position for transferring, onto the recording material, the developed images transferred onto the intermediary transfer member, and a mounting and demounting position for mounting and demounting the cartridges relative to the cartridge mounting portions. An opening permits mounting and demounting of the cartridges relative to the cartridge mounting portions of the image forming unit placed in the mounting and demounting position, and a locking member releasably locks the image forming unit which is moved to the mounting and demounting position.

12 Claims, 49 Drawing Sheets

(52) U.S. Cl.
CPC ..... *G03G15/0194* (2013.01); *G03G 21/1633* (2013.01); *G03G 2221/169* (2013.01); *G03G 2221/1846* (2013.01)

(56) References Cited

U.S. PATENT DOCUMENTS

| | | | | |
|---|---|---|---|---|
| 8,023,860 | B2 | 9/2011 | Choi et al. | |
| 2004/0085431 | A1 | 5/2004 | Asuwa et al. | |
| 2004/0184834 | A1* | 9/2004 | Blaine et al. | 399/113 |
| 2005/0047821 | A1* | 3/2005 | Murayama et al. | 399/111 |
| 2005/0047823 | A1 | 3/2005 | Nakashima et al. | |
| 2005/0095018 | A1 | 5/2005 | Ahn et al. | |
| 2006/0210304 | A1 | 9/2006 | Nakashima et al. | |
| 2007/0160388 | A1 | 7/2007 | Yoshimura et al. | |
| 2008/0019731 | A1 | 1/2008 | Sato et al. | |
| 2008/0019732 | A1 | 1/2008 | Sato et al. | |
| 2008/0170881 | A1* | 7/2008 | Choi et al. | 399/113 |
| 2008/0286003 | A1 | 11/2008 | Fukuda et al. | |
| 2008/0292355 | A1 | 11/2008 | Sakurai et al. | |
| 2009/0162095 | A1 | 6/2009 | Yoshimura et al. | |
| 2009/0285596 | A1* | 11/2009 | Kawamata | 399/92 |
| 2010/0135691 | A1* | 6/2010 | Kikuchi | 399/111 |
| 2010/0247142 | A1* | 9/2010 | Kikuchi et al. | 399/112 |

* cited by examiner (a)

(b)

ELECTROPHOTOGRAPHIC IMAGE FORMING APPARATUS WITH DEMOUNTABLE IMAGE FORMING UNIT

TECHNICAL FIELD

The present invention relates to a color electrophotographic image forming apparatus for forming an image on a recording material, wherein a plurality of cartridges are dismountably mounted to a main assembly of the apparatus.

Here, the color electrophotographic image forming apparatus forms a color image on the recording material using an electrophotographic image forming process. The examples of the color electrophotographic image forming apparatus include a color electrophotographic copying machine, a color electrophotographic printer (color laser beam printer, color LED printer, for example), a color facsimile device, and a color word processor. The image is formed by the electrophotographic image forming apparatus on a recording material, and the recording material is paper, an OHP sheet, for example. The cartridge is a process cartridge, a developing cartridge or the like and contributes to an image forming process for forming the image on the recording material in the state that it is mounted to the main assembly of the electrophotographic image forming apparatus. Here, the process cartridge contains the at least one of the charging means, developing means, cleaning means as process means, and the electrophotographic photosensitive drum as a unit integrally, and it is dismountably mountable to the main assembly. The process cartridge may contain the developing means as the process means and the electrophotographic photosensitive drum as a unit, and it is dismountably mounted to the main assembly of the electrophotographic image forming apparatus. The process cartridge may contain the charging means, the developing means, or the cleaning means as the process means and the electrophotographic photosensitive drum as a unit and it is dismountably mounted to the main assembly. The process cartridge which is provided integrally with the electrophotographic photosensitive drum and the developing means is called an integral-type process cartridge. The process cartridge which is provided integrally with the electrophotographic photosensitive drum and the process means other than the developing means is called a discrete type process cartridge. In this case, the developing means is provided in a developing unit unintegral with the process cartridge, and the discrete type process cartridge forms the image using the combination with such a developing unit. The process cartridge is mounted and demounted relative to the main assembly by a user. For this reason, the maintenance operation of the device is easy. The process means acts on the electrophotographic photosensitive drum. The developing cartridge is provided with a developing roller, and an electrostatic latent image formed on the electrophotographic photosensitive drum is developed by the developing roller. It contains a developer (toner) for the development, and is dismountably mounted to the main assembly In the case of the developing cartridge, the electrophotographic photosensitive drum is mounted to the main assembly or a cartridge supporting member. Or, the electrophotographic photosensitive drum is provided in a so-called discrete type process cartridge. In this case, the process cartridge is not provided with the developing means. The developing cartridge is also mounted and demounted relative to the main assembly by the user. For this reason, the maintenance of the device is easy. Therefore, the cartridge in this invention includes the process cartridges of a so-called the integral type or a so-called discrete type. The cartridge includes the combination of the so-called process cartridge of the discrete type and the developing cartridge. In another example of the cartridge, the electrophotographic photosensitive drum is mounted fixedly to the main assembly or the cartridge supporting member and the detachably mountable developing cartridge acts on the electrophotographic photosensitive drum. As has been described hereinbefore, the electrophotographic image forming apparatus for forming the image on the recording material using the electrophotographic image forming process is known. In this electrophotographic image forming apparatus, the process cartridge type described above is known. In addition, the developing cartridge type which comprises only the developing unit unintegral with the photosensitive drum is known. In the present invention, the process cartridge type and the developing cartridge type are usable. The process cartridge and the developing cartridge are provided with a developer accommodating portion which contains the developer (toner) for developing the electrostatic latent image.

BACKGROUND ART

U.S. Pat. No. 5,428,426 discloses an image forming apparatus which can form the color image. In this image forming apparatus, an intermediary transfer member is rotated by a driving source of a main assembly side, and the photosensitive drum is rotationally driven through the intermediary transfer member. With this structure, in mounting the process cartridge into the main assembly, it will suffice only if the image bearing member is accurately positioned relative only to the intermediary transfer member. Therefore, the mounting and demounting and positioning relative to the main assembly of the process cartridge are easy.

DISCLOSURE OF THE INVENTION

The present invention further develops the conventional structure described above.

According to an aspect of the present invention, there is provided a color electrophotographic image forming apparatus for forming a color image on a recording material, said apparatus comprising a plurality of cartridge mounting portions for demountably mounting cartridges; an intermediary transfer member onto which developed images formed on the plurality of electrophotographic photosensitive drums are transferred, said intermediary transfer member being provided opposed to said electrophotographic photosensitive drums; an image forming unit comprising said cartridge mounting portions and said intermediary transfer member, said image forming unit being movable between a transfer position for transferring, onto the recording material, the developed images transferred onto said intermediary transfer member from electrophotographic photosensitive drums, and a mounting and demounting position for mounting and demounting said cartridges relative to said cartridge mounting portions; an opening for permitting mounting and demounting of said cartridges relative to said cartridge mounting portions of said image forming unit placed in the mounting and demounting position; an openable member capable of opening and closing said opening, said openable member being movable between a closing position for closing said opening and an open position for opening said opening; an interrelating member for moving said image forming unit from the transfer position to the mounting and demounting position in interrelation with manual movement of said openable member from the closing position to the open position and for moving said image forming unit from the mounting and demounting position to the transfer position in interrelation with manual movement of said openable member from the open position to the closing position.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

Figure 1:
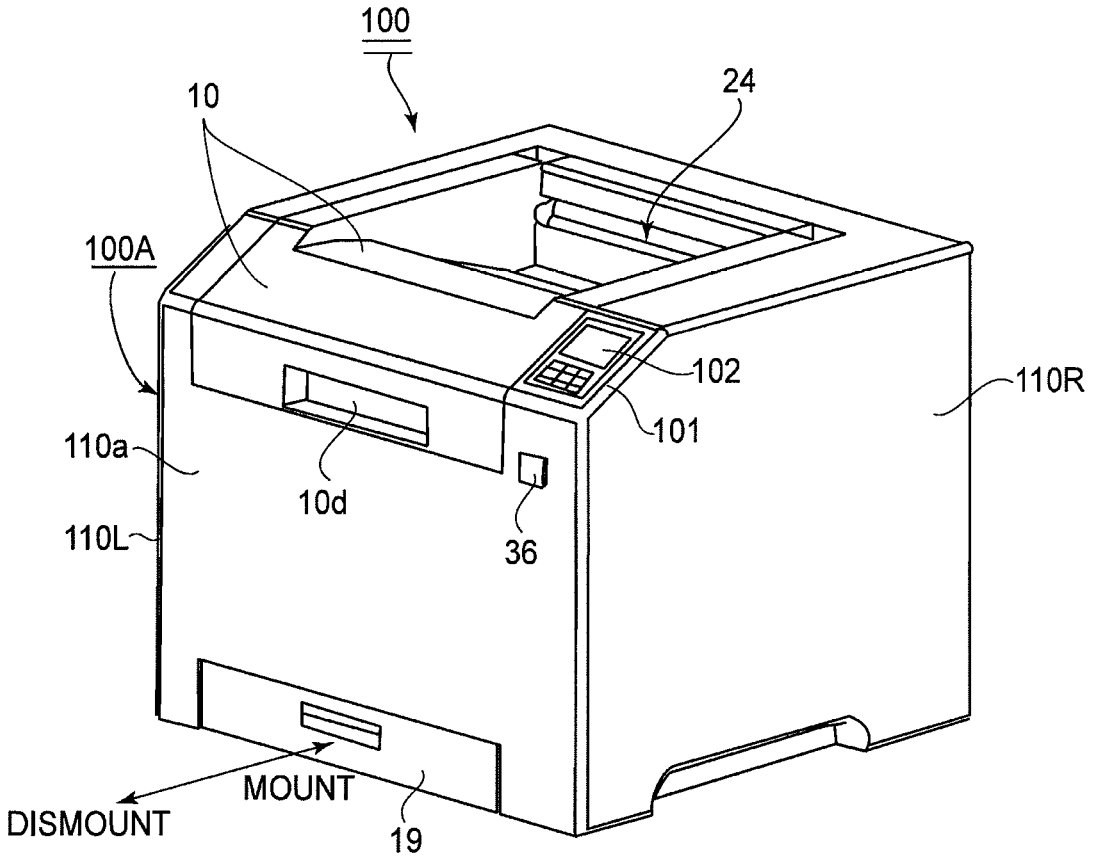
FIG. 1 is an outer appearance perspective view of an image forming apparatus of Embodiment 1.

An embodiment according to the present invention is described in hereinafter in detail on the basis of the drawing. The preferred embodiments of the present invention will be described in conjunction with the accompanying drawings The dimensions, the materials, the configurations, the relative positions, and so on of the constituent parts which will be described hereinafter may be properly changed by one skilled in the art depending on the structures and the various conditions of a device to which this invention is applied, and the scope of this invention is not limited to specific dimensions, materials, configurations, relative positions and so on of the embodiments which will be described below.

Embodiment 1

Figure 2A:
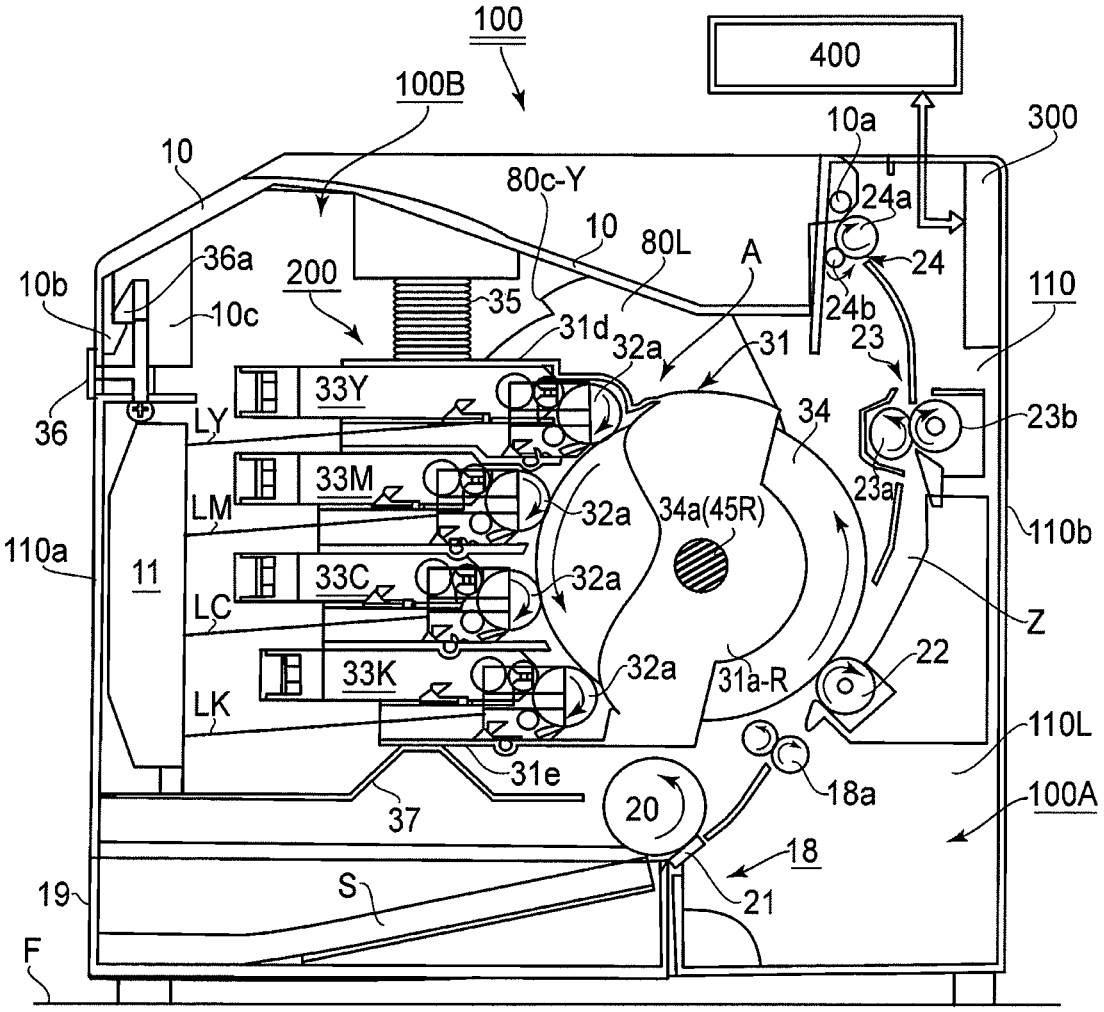
FIG. 2A is a schematic right side sectional view of the image forming apparatus of FIG. 1.

General Arrangement of an Example of Color Electrophotographic Image Forming Apparatus FIG. 1 is an outer appearance perspective view of a color electrophotographic image forming apparatus (image forming apparatus) 100 according to this embodiment. FIG. 2A is a right side longitudinal sectional view of the image forming apparatus 100. The image forming apparatus 100 is a laser printer of a full-color (four color) type which uses the electrophotographic process. The image forming apparatus 100 forms a full-color image on a recording material (sheet) S on the basis of the electrical image signal inputted to a control circuit portion 300 from an external host device 400 such as a personal computer, an image reader, a receiving part of a facsimile device. In the following descriptions of the image forming apparatus 100, a front side (front side) is a side, wherein a feeding cassette 19 which stacks a recording material S is drawn. A backside is the opposite side from it. An upper side is a direction of opening a maintenance cover 10. Front-rear directions are a direction to the front side from the backside of the image forming apparatus and the reverse direction thereof. The left and right are the left and right, as seen from the front side of the image forming apparatus. The left-right directions are a direction to the left from the right, and the reverse direction thereof. A main assembly 100A is a portion of the image forming apparatus other than a cartridge and an image forming unit 200.

Figure 2B:
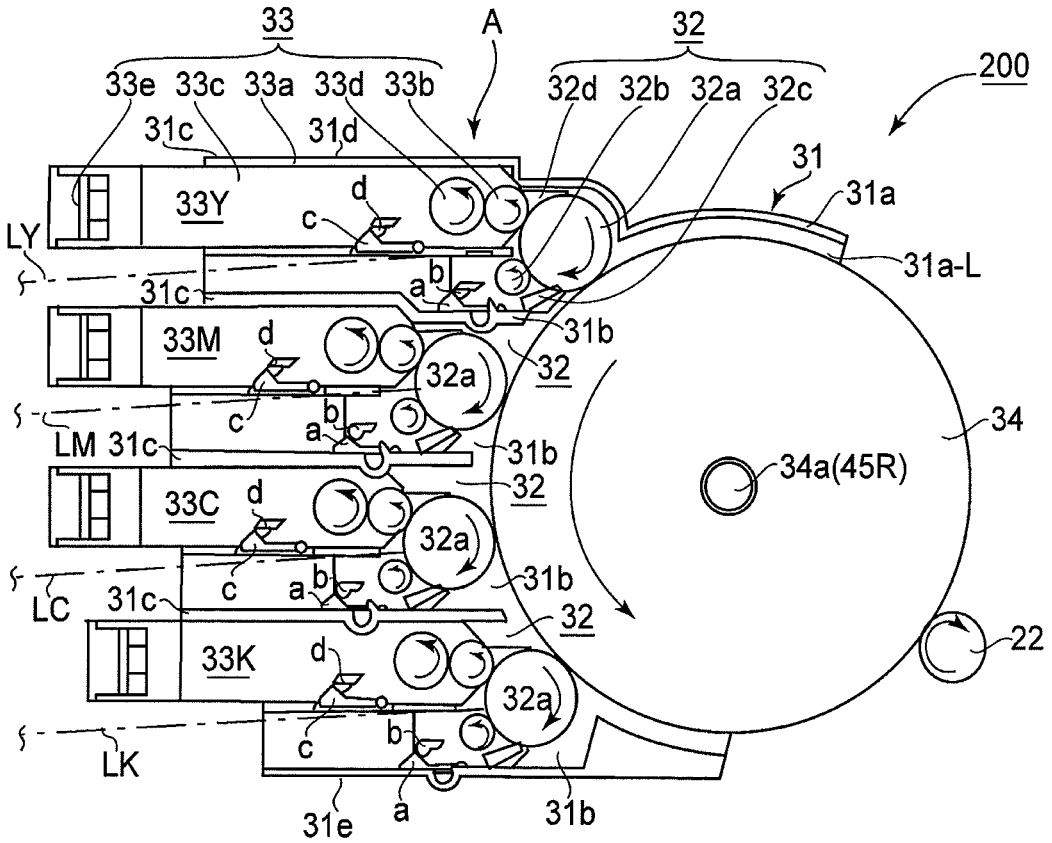
FIG. 2B is a partial enlarged view of the part FIG. 2A.

The image forming apparatus 100 is placed on a substantially horizontal installation surface F such as a mounting base, the desk or floor. The main assembly 100A includes an image forming unit 200. FIG. 2B is an enlarged view of a unit 200 portion of the image forming apparatus 100 shown in FIG. 2B. The unit 200 includes a cartridge mounting portion 31*c* for mounting a plurality of cartridges, that is first-fourth developing cartridge s 33 (33Y, 33M, 33C, 33K) in this embodiment dismountably and a single intermediary transfer member 34. In this embodiment, an electrophotographic photosensitive drum (drum) 32*a*, a charging roller (process means) 32*b*, and a cleaning blade (process means) 32*c* are mounted to the unit 200. In the image forming apparatus 100, a plurality of cartridges 33 are dismountably mounted to main assembly 100A (unit 200), and a color image is formed on recording material S. The unit 200 will be described in the detail hereinafter. In this embodiment, the cartridges 33 have the similar structures, other than the colors of contained developers (toner). However, they are not limited to this example. For example, a cartridge 33K which accommodates a black developer may be larger in the capacity of a developer accommodating portion (a developing device 33*c*) than that of the cartridges 33 which accommodate the other color developers. In this embodiment and the embodiments which will be described hereinafter, although the cartridge is a developing cartridge, the present invention is not limited to this. For example, the drum 32*a*, the charging roller 32*b*, and the cleaning blade 32*c* mounted to the unit 200 in this embodiment may be mounted to the developing cartridge 33. The cartridge which has such a structure is called process cartridge not developing cartridge. The process cartridge contains the drum 32*a* and a charging roller 32*b*, a developing roller 33*b*, and a cleaning blade 32*c* as the process means integrally as a cartridge, and it is dismountably mounted as a unit to the main assembly 100A. The unit 32 includes the drum 32*a*. The unit 32 includes the charging roller 32*b* and the cleaning blade 32*c* for removing the developer which remained on the surface of the drum 32*a*, as the process means which acts on the drum 32*a*. The drum 32*a*, the charging roller 32*b*, and the cleaning blade 32*c* are provided with a predetermined arrangement relation relative to a case 32*d* of the unit 32. The unit 32 is mounted to the unit 200.

The cartridge 33 includes a developing device case 33*a* and the developing roller 33*b* which is provided at the one end portion of this case 33*a* and which supplies the developer to the drum 32*a*. More particularly, the developing roller 33*b* develops an electrostatic latent image formed on the drum 32*a* into a developer image. The cartridge 33 includes the developing device 33*c* as the developer accommodating portion for accommodating the developer to be used for a development of the electrostatic latent image and a supplying roller 33*d* for supplying the developer from the developing device 33*c* to the developing roller 33*b*. The cartridge 33 is provided with a contact unit 33*e* for pressing the developing roller 33*b* with a predetermined pressure against the drum 32*a*. A first cartridge 33Y accommodates a yellow (Y) developer in the developing device 33*c* thereof, and forms a Y color developer image on the surface of the drum 32*a*. A second cartridge 33M accommodates a magenta (M) developer in the developing device 33*c* thereof, and forms an M color developer image on the surface of the drum 32*a*. A third cartridge 33C accommodates a cyan (C) developer in the developing device 33*c* thereof, and forms a C color developer image on the surface of the drum 32*a*. A fourth cartridge 33K accommodates a black (K) developer in the developing device 33*c* thereof, and forms a K color developer image on the surface of the drum 32*a*.

Figure 3:
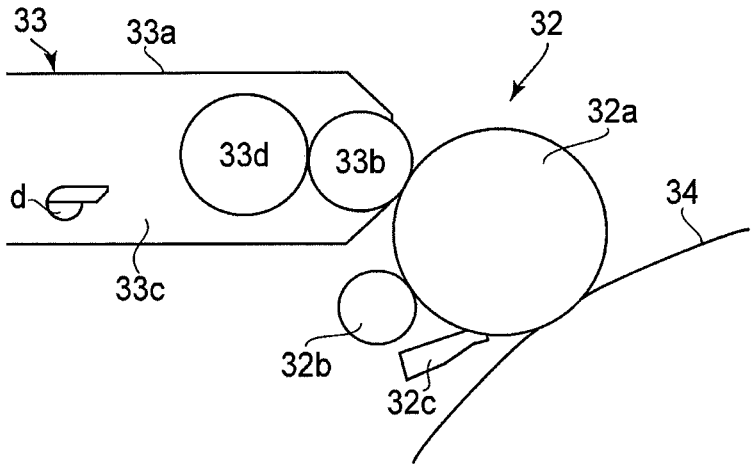
In FIG. 3, (*a*) is a schematic view of a contact type developing system, and (*b*) is a schematic view of the noncontact type developing system.
Figure 3:
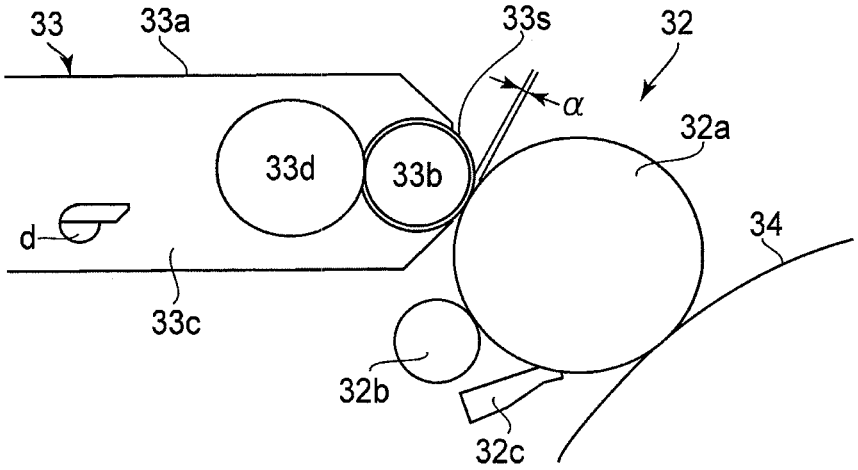

In this embodiment, the intermediary transfer member 34 is a cylindrical drum (intermediary transfer drum) horizontally extends along an axis of a rotation axis 34*a*. Each cartridge 33 is provided on a front side of the intermediary transfer member 34, and extends substantially parallel with the installation surface F of the main assembly 100A. They are provided adjacent to each other with respect to the substantially vertical direction. In the image forming apparatus of this embodiment, the first cartridge 33Y takes a top most stage position, and the second cartridge 33M is placed therebelow. The third cartridge 33C is further placed further below. The fourth cartridge 33K takes a bottom most stage position. The developing roller 33*b* of each cartridge 33 may be in contact to the drum 32*a* as shown in (a) of FIG. 3

(contact type developing system). Or, as shown in (b) of FIG. 3, the developing roller 33*b* may be spaced with a predetermined small gap (predetermined distance) α from the drum 32*a* (noncontact developing system). In (b) of FIG. 3, in order to maintain the predetermined gap α, the spacers 33*s* provided on the left and right end portions of the developing roller 33*b* are contacted to the drum 32*a*. This embodiment employs a structure shown in (b) of FIG. 3. The front side of each cartridge 33 is provided with a laser scanner unit 11 as an image exposure device. The unit 11 is disposed between a front frame 110*a* of a main frame 110 which is a frame of the main assembly and the cartridges 33, in the main assembly 100A. The unit 11 includes a laser diode, a polygonal mirror, an Fθ lens, a reflection mirror, and so on. The unit 11 outputs laser beams L (LY, LM, LC, LK) which are modulated correspondingly to the image information for the Y, M, C, K color inputted to the control circuit portion 300 from the external host device 400 to scan the drums 32*a* of the cartridges 33 for the corresponding colors (image exposure). In other words, the unit (image exposure device) 11 projects the light (laser beam) corresponding to the image information (including color information) to each drum 32*a*. By this, an electrostatic latent image corresponding to the image information is formed on each drum 32*a*.

Figure 10A:
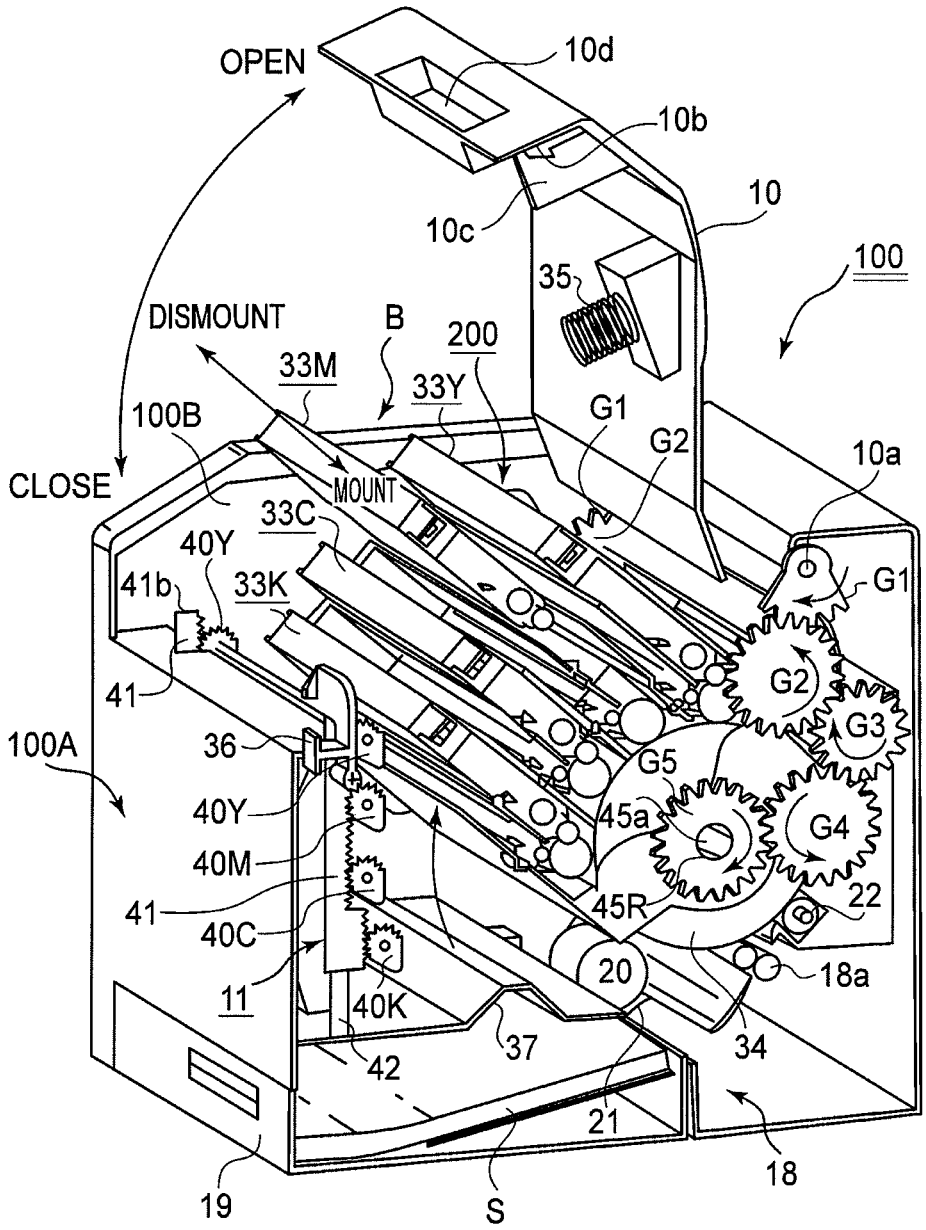
FIG. 10A illustrates the image forming apparatus (1), wherein the cover is opened to an open position and the image forming unit is in a mounting and dismounting position.
Figure 10B:
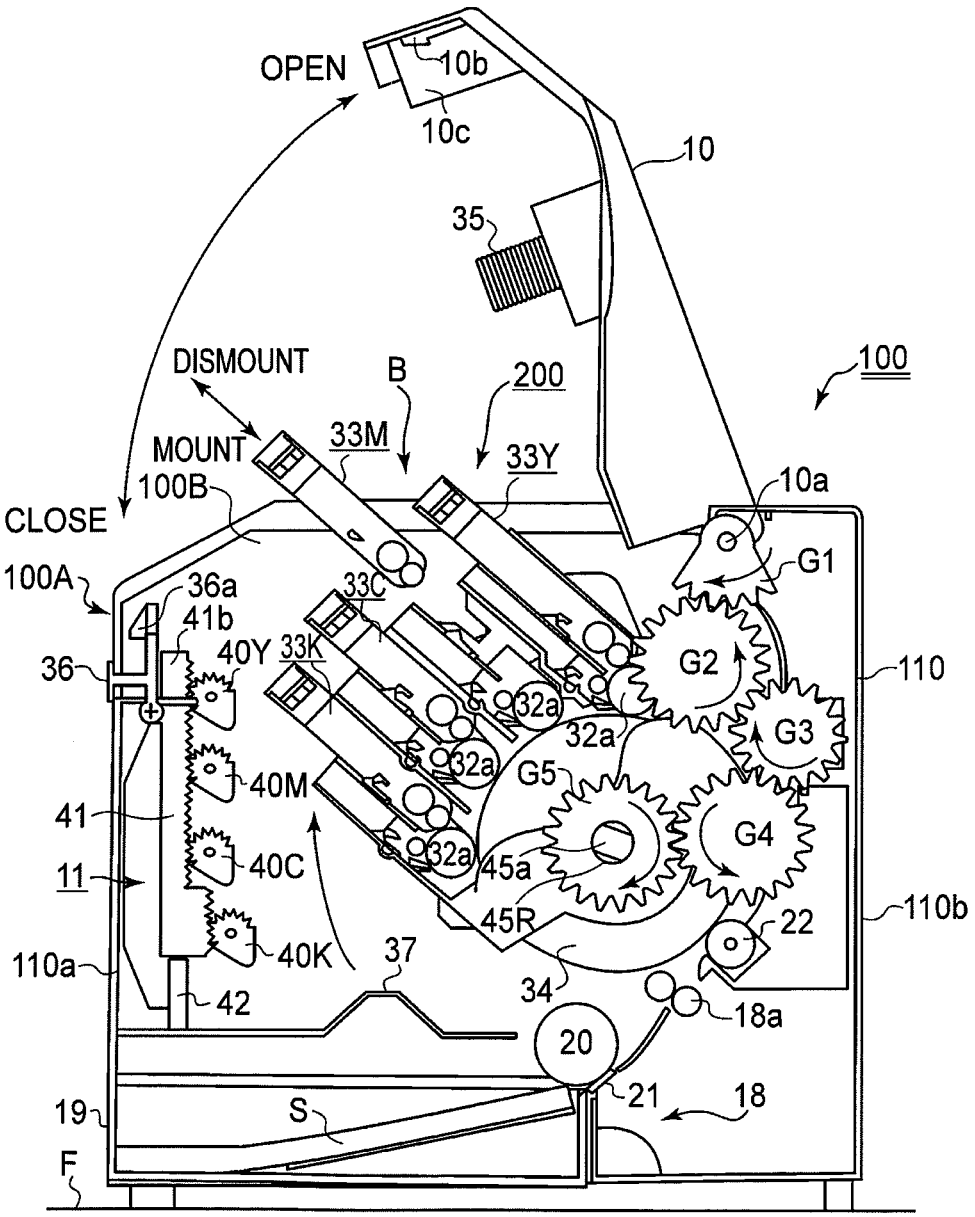
FIG. 10B illustrates the image forming apparatus (2), wherein the cover is opened to the open position and the image forming unit is in the mounting and dismounting position.

A lower part of the unit 200 includes a feeding unit 18. The unit 18 includes a feeding cassette 19 for stacking recording material S, a feeding roller 20, a separation pad 21, and so on. The cassette 19 can go into and out of the front side of the main assembly 100A (front loading). In the main assembly 100A, between the intermediary transfer member 34 and a rear frame 110*b* of the main assembly 100A, there is provided a recording material feeding path Z extended from the feeding roller 20 to the upper rear portion in the main assembly 100A. A registration roller couple 18*a*, a secondary transfer roller 22, a fixing device 23, and a discharging roller pair 24 is provided along feeding path Z in this order upwardly. The fixing device 23 includes a fixing film unit 23*a* and a pressing roller 23*b*. The discharging roller pair 24 includes a discharging roller 24*a* and a discharging roller 24*b*. An upper surface of the main assembly 100A is provided with a maintenance cover 10 which functions as a discharging tray for receiving the recording material S on which the image has been formed. The cover 10 opens and closes an opening 100B provided in the upper surface of the main assembly 100A (opening and closing member). Through the opening 100B, as will be described hereinafter, the developing cartridge 33 is mounted and demounted relative to a developing cartridge mounting portion 31*c* of the unit 200 placed in the mounting and dismounting position B (FIG. 10A and FIG. 10B). In the state of FIG. 2A, a drive inputting portion (unshown) of the intermediary transfer member 34 of the unit 200 is coupled with a drive outputting portion (unshown) of a main assembly (100A). The drive inputting portions (unshown) of a photosensitive unit 32 and cartridge 33 couple with the drive outputting portions (unshown) provided in the main assembly 100A, respectively. The electrical contacts (unshown) of the photosensitive unit 32 and the cartridge 33 are electrically connected with an electric power supply system (unshown) of the main assembly (100A). The driving force transmission system and a bias voltage application system described above are not illustrated, for the sake of simplicity, since they may be the same as those in the ordinary image forming apparatus.

The operation for forming a full-color image will be described. The drum 32*a* is rotationally driven at a predetermined speed in the direction of the arrow (clockwise direction) in FIG. 2B. The charging roller 32*b* is rotated by the rotation of the drum 32*a*. The intermediary transfer member 34 is rotationally driven at the speed corresponding to the speed of the drum 32*a* in the counterclockwise direction (codirectional with the rotation of the drum 32*a*) of the arrow. In the cartridge 33, the developing roller 33*b* and the supplying roller 33*d* are rotationally driven at a predetermined controlled speed in the counterclockwise direction of the arrow. The scanner unit 11 is driven. In synchronism with this drive, a predetermined charging bias voltage is applied to the charging roller 32*b* at the predetermined controlled timing. By this, the surface of the drum 32*a* is uniformly charged to the predetermined potential of the predetermined polarity by the charging roller 32*b*. A scanner unit 11 exposes the surface of each drum 32*a* scanningly to the laser beam L modulated in accordance with the Y, M, C, K image signals. By this, the electrostatic latent images corresponding to the associated color image signals are formed on the surfaces of the drum 32*a*. The electrostatic latent images formed on the surface of the drum 32*a* are developed into the developer images by the developing rollers 33*b*. The developing roller 33*b* is supplied with a predetermined developing bias voltage at the predetermined controlled timing. Through the above described electrophotographic image forming process operation, a Y color developer image corresponding to a yellow component of the full-color image is formed on the drum 32*a* opposed by a cartridge 33Y. The developer image is transferred (primary transfer) onto the intermediary transfer member 34 in a primary transfer nip which is the contact portion between the drum 32*a* and the intermediary transfer member 34. An M color developer image corresponding to a magenta component of the full-color image is formed on the drum 32*a* opposed by a cartridge 33M. The developer image is transferred (primary transfer) onto the intermediary transfer member 34 in a primary transfer nip which is the contact portion between the drum 32*a* and the intermediary transfer member 34 superimposedly on the already transferred Y color developer image. A C color developer image corresponding to a cyan component of the full-color image is formed on the drum 32*a* opposed by a cartridge 33C. The developer image is transferred (primary transfer) onto the intermediary transfer member 34 in the primary transfer nip which is the contact portion between the drum 32*a* and the intermediary transfer member 34 superimposedly on the already transferred Y color plus M color developer image. A K color developer image corresponding to a black component of the full-color image is formed on the drum 32*a* which the cartridge 33K opposed. The developer image is transferred (primary transfer) onto the intermediary transfer member 34 in the primary transfer nip which is the contact portion between the drum 32*a* and the intermediary transfer member 34 superimposedly on the already transferred Y color plus M color plus C color developer images.

In this way, a full-color developer image of the Y color+M color+C color+K color is synthetically formed on the intermediary transfer member 34. The order of the colors of the developer images sequentially superimposedly transferred onto the intermediary transfer member 34 is not limited to an above described order. The untransferred developer remaining on the drum surface after the primary transfer of the developer image relative to the intermediary transfer member 34 is removed by the cleaning blade 32*c*. On the other hand, the feeding roller 20 is driven at the predetermined controlled timing. In this manner, by a cooperation of the feeding roller 20 and the separation pad 21, the separation and feeding of the sheet-like recording materials S stacked in the feeding cassette 19 is carried out one by one. The recording material S is introduced into the secondary transfer nip which is the contact portion between the intermediary transfer member 34 and the secondary transfer roller 22, at the predetermined controlled timing by the registration roller couple 18*a*. The secondary transfer roller 22 is supplied with the secondary transfer bias voltage of the predetermined potential having the polarity opposite to that of the charge polarity of the developer at the predetermined controlled timing. By this, while the recording material S is nipped and fed by the secondary transfer nip, the developer image on the intermediary transfer member 34 on which it is superimposed is sequentially transferred (secondary transfer) onto the surface of recording material S. The recording material S passed through the secondary transfer nip is separated from the surface of the intermediary transfer member 34 and is introduced into the fixing device 23. It is heated and pressed by a fixing nip, by which the color developer images are mixed and fixed on recording material S. The recording material S is discharged out of the fixing device 23, and is discharged on the maintenance cover 10 which functions as a discharging tray by discharging roller pair 24 as a full-color print. After the recording material S is separated from the intermediary transfer member 34, the toner remaining after the secondary tranfser remaining on the surface of the intermediary transfer member 34 is electrostatically deposited on the surface of the drum 32*a* in the primary transfer nip of the drum 32*a* opposed by the first cartridge 33Y, for example, in the case of this embodiment. It is removed by the cleaning blade 32*c*.

Here, the intermediary transfer member 34 is a cylindrical rotatable member. On the intermediary transfer member 34, the different color developer images formed on the drums 32*a* are transferred superimposedly. The developer images transferred superimposedly is transferred all together onto the recording material S from the intermediary transfer member 34. By this, the color image is formed on the recording material S. In the case of a monochromatic image forming mode, the image formation is carried out only using the cartridge 33K for forming a black color image and the photosensitive unit 32 associated with this cartridge 33K. A black developer image formed on the drum 32*a* of the photosensitive unit 32 is transferred onto the intermediary transfer member 34. The transferred black developer image is transferred onto recording material S from the intermediary transfer member 34. A black image is formed on recording material S. A last image on recording material S is formed after the passage of recording material S through the fixing device 23. In this embodiment, the secondary transfer roller 22 is movable between a first position in which it contacts to the intermediary transfer member 34 and forms the secondary transfer nip and a second position spaced from the intermediary transfer member 34 by a shifting mechanism (unshown). At the time of an image forming operation of the image forming apparatus 100, the secondary transfer roller 22 is moved to the first position, and at the time of the non-image formation, it is moved to the second position. The secondary transfer roller 22 may normally be contacted with the intermediary transfer member 34.

(Image Forming Unit)

Figure 4:
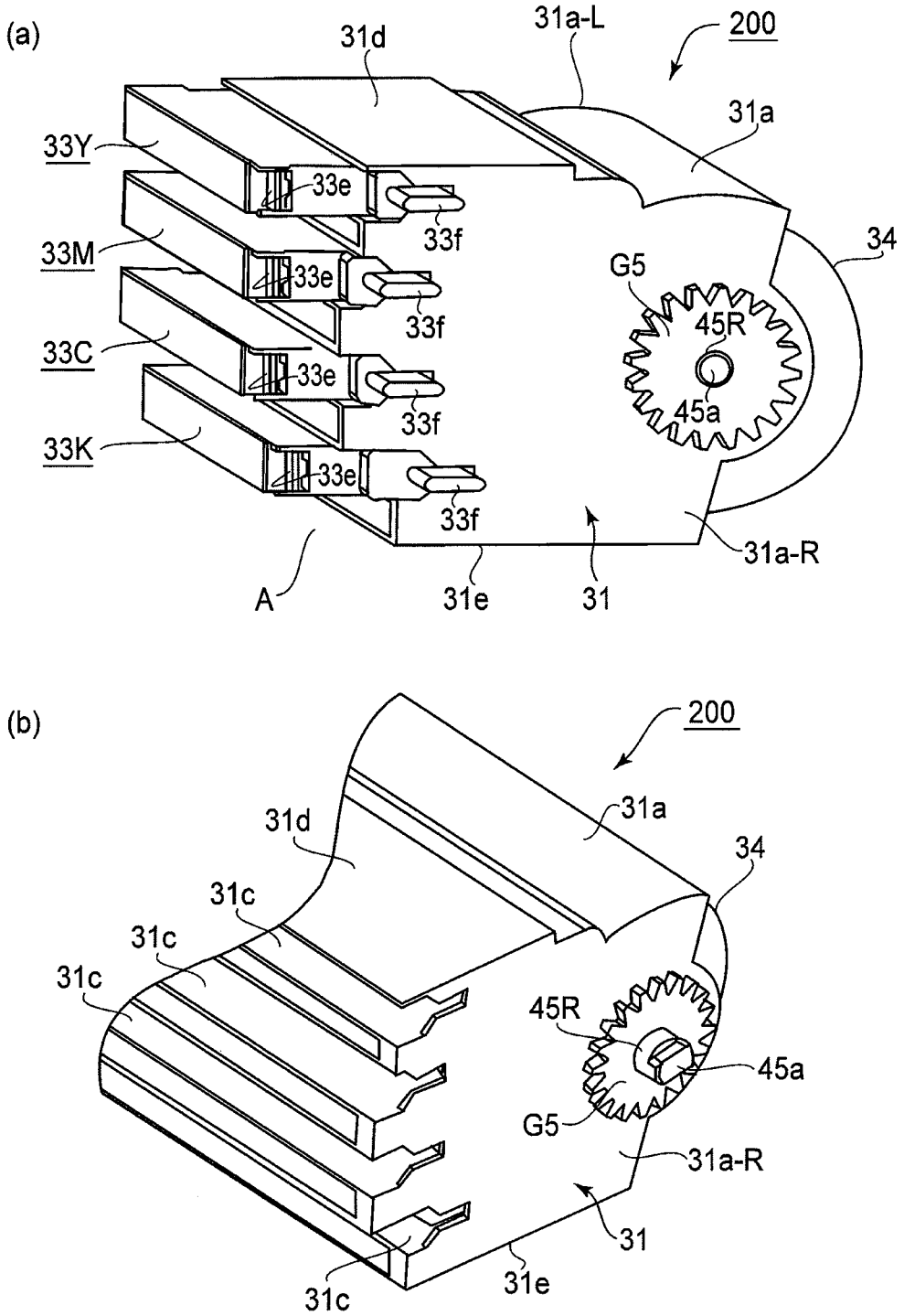
In FIG. 4, (*a*) is an outer appearance perspective view of an image forming unit, and (*b*) is a perspective view of a right half of the image forming unit in the state that a developing cartridge is dismounted.
Figure 5:
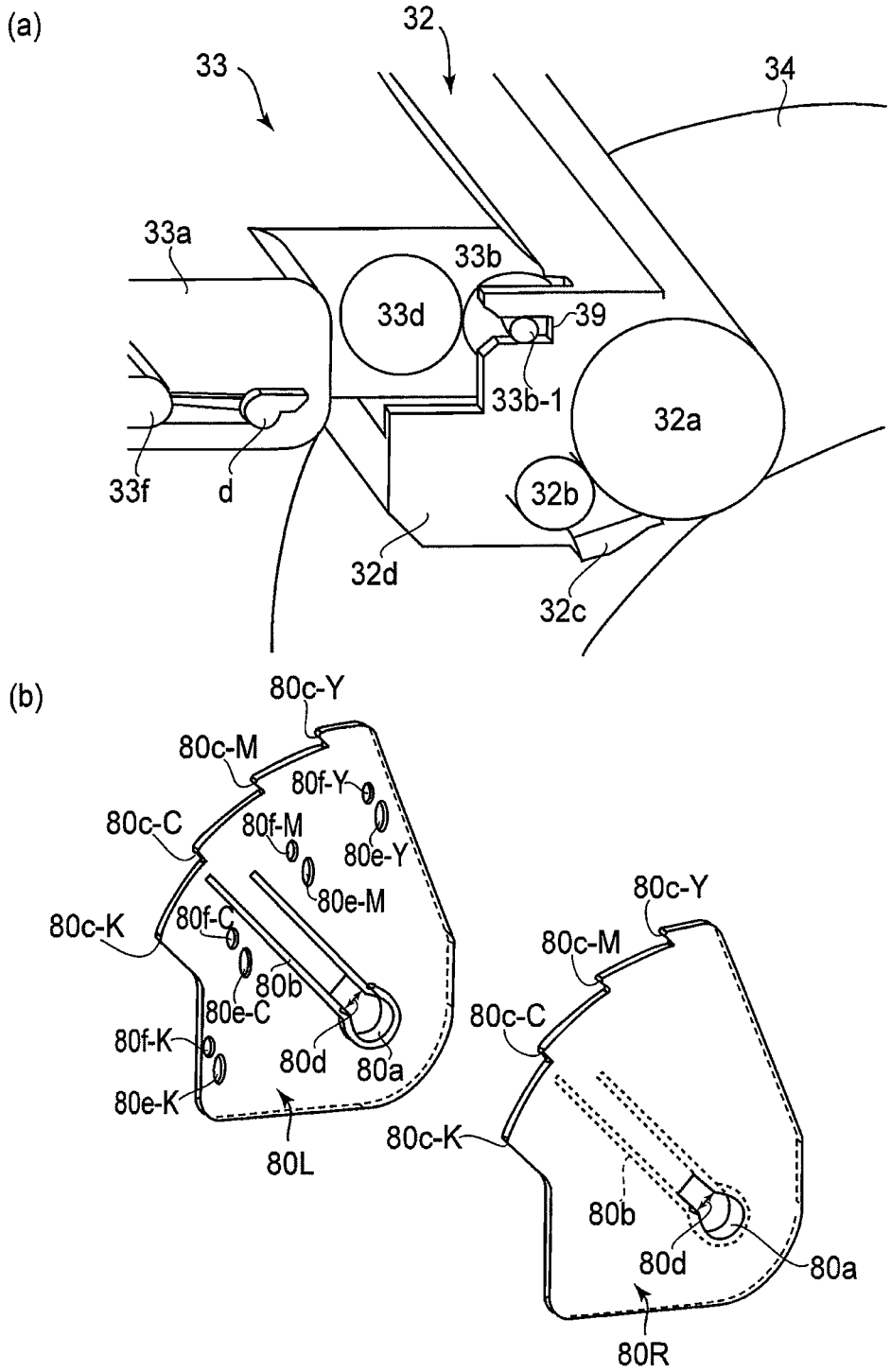
In FIG. 5, (*a*) is a perspective view of a positioning portion between the developing cartridge of the image forming unit and a photosensitive unit thereof, and (*b*) is a perspective view of left and right guiding plates.

Referring mainly to FIG. 2A, FIG. 2B, FIG. 4, and FIG. 5, the structure of the image forming unit 200 will be described. (a) of FIG. 4 is an outer appearance perspective view of the unit 200. (b) of FIG. 4 is a perspective view of the substantially right-half part of the unit 200 of the state that the cartridges 33 are dismounted. (a) of FIG. 5 is a perspective view of positioning portions for the developing cartridge 33 and the photosensitive unit 32 of the unit 200. The unit 200 is provided with a sub-frame 31 detachably mountable relative to the main frame 110 of the main assembly 100A. The sub-frame 31 is provided with an intermediary transfer frame 31*a* rotatably supporting the intermediary transfer member 34. The intermediary transfer member 34 is provided with a shaft (rotation axis) 34*a*, and the left-hand end portion and right-hand end portion thereof are supported rotatably between a left side plate 31*a*-L of the intermediary transfer frame 31*a* and a right side plate 31*a*-R thereof. On the outer sides of the left side plate 31*a*-L and the right side plate 31*a*-R of the intermediary transfer frame 31*a*, a left shaft portion 45L (unshown) and a right shaft portion 45R co-axial with the center axis 34*a* of the intermediary transfer member 34 is fixed to the side plates 31*a*-L, 31*a*-R, respectively. The free end portions of the shaft portions 45L, 45R are reduced in the width into a key-shaped portion 45*a*. On the outer sides of the left side plate 31*a*-L and the right side plate 31*a*-R of the intermediary transfer frame 31*a*, a sub-frame gear G5 concentric with the shaft portions 45L, 45R is fixed to the shaft portions 45L, 45R or the side plates 31*a*-L, 31*a*-R.

The sub-frame 31 is provided with a photosensitive member supporting unit 31*b* (FIG. 2B) for supporting the photosensitive unit 32 of each cartridge 33. A photosensitive member case 32*d* of the photosensitive unit 32 is coupled to a unit 31*b*. The photosensitive unit 32 supported by the unit 31*b* is elastically urged toward the intermediary transfer member 34 by an engagement between an elastic material a provided on the unit (31*b*) and the projection material b provided on the photosensitive unit (32). By this, a photosensitive drum 32*a* is in contact, with a predetermined urging force, to the intermediary transfer member 34. The sub-frame 31 is provided with the cartridge mounting portions 31*c* for mounting the cartridge 33 dismountably. In this embodiment, the cartridge mounting portions 31*c* are the developing cartridge mounting portions (developing device coupling unit for tentatively holding developing cartridge 33) for mounting the cartridges 33 independently and dismountably. A mounting portion 31*c* has such a guiding configuration that the cartridge 33 is coupled to the photosensitive unit 32 mounted to the unit 31*b*. The developing device case 33*a* of the cartridge 33 is coupled to the mounting portion 31*c*. The cartridge 33 is provided with supporting means 33*f* for supporting ((a) it in FIG. 4), so that it may stably be held to the mounting portion 31*c* (mounting). The end of the rotation axis 33*b*-1 of the developing roller 33*b* is engaged with the positioning means 39 ((a) in FIG. 5) provided on the photosensitive member case 32*d* and supported by this, so that the position thereof is determined relative to the drum 32*a*. As shown in FIG. 2B, the cartridge 33 is provided with a projecting member d (locking claw (locking portion)). The mounting portion 31*c* (unit 200) is provided with an elastic material c (locking claw (locking portion)). The cartridge 33 mounted to the mounting portion 31*c* is tentatively held by the mounting portion 31*c* by the engagement between the projecting member d and the elastic material c. More particularly, by the elastic material c and the projecting member d locking with each other releasably, the cartridge 33 is dismountably mounted to the mounting portion 31*c* (unit 200). However, this embodiment is not limited to this. For example, the claw (locking portion) provided on one side may elastically be releasably locked with the hole (locking portion) provided on another side.

As shown in (b) of FIG. 5, on the inside of a left-hand side frame 110L, and the inside of a right-hand side frame 110R of the main frame 110 of the main assembly 100A, a left-hand side guiding plate 80L and a right-hand side guiding plate 80R which are opposed to each other and which are symmetrical with each other are provided fixedly. Guiding plates 80L, 80R are provided with a positioning portion 80*a* rotatably supporting the left and right shafts 45L, 45R of the sub-frame 31 and a guide 80*b* for guiding the shaft portions 45L, 45R. The guiding plates 80L, 80R are provided with the four symmetrical projections 80*c* (80*c*-Y, 80*c*-M, 80*c*-C, 80*c*-K). The positioning portion 80*a* is provided with an entrance opening 80*d* opened with the width smaller than the diameter of the shaft portions 45L, 45R toward the opening 100B of the main assembly 100A. The widths of the key-shaped portions 45*a* of the shaft portions 45L, 45R are the same as or slightly smaller than the width of the entrance opening 80*d*. In the image forming apparatus 100 of this embodiment, the left-hand side frame (110L) of the main frame 110 is the driving side, and the right-hand side frame (110R) is the non-driving side. A left guiding plate 80L in the driving side is provided with a hole portion 80*e* (80*e*-Y, 80*e*-M, 80*e*-C, 80*e*-K) for the entering and leaving of a drive outputting portion for the photosensitive unit 32 mounted to the sub-frame 31. The left guiding plate 80L is provided with a hole portion 80*f* (80*f*-Y, 80*f*-M, 80*f*-C, 80*f*-K) for the entering and leaving of the drive outputting portion for each cartridge 33.

In the unit 200, the left and right shaft portions 45L, 45R are rotatably supported between the left and right guiding plates 80L, 80R in the main assembly 100A by the left and right positioning portions 80*a*, respectively. More particularly, the unit 200 is rotatable about the shaft portions 45L, 45R, i.e., a rotational center 34*a* of the intermediary transfer member 34, between the left and right guiding plates 80L, 80R in the main assembly 100A. By this, the unit 200 can take the transfer position A (FIG. 2A) for transferring the developer image which has been transferred onto the intermediary transfer member 34 from the drum 32*a* onto recording material S. The unit 200 can take the mounting and dismounting position B (FIG. 10B) for mounting and demounting the cartridge 33 relative to the mounting portion 31*c*. More particularly, the unit 200 is movable between the transfer position A and the mounting and dismounting position B. This will be described hereinafter.

A rear side of the cover (opening and closing member) 10 is rotatably coupled through a hinge shaft 10*a* to the main assembly 100A, and it is movable between the closing position for closing a top opening 100B of the main assembly 100A and the open position for opening the opening 100B. The cover 10 is an opening and closing member for opening and closing the opening 100B in the upper portion of the main assembly 100A about the hinge shaft 10*a*. Through the opening 100B, the cartridge 33 is mounted and demounted relative to the cartridge mounting portion 31*c* of the unit 200 (FIG. 10B) placed in mounting and dismounting position B. As shown in FIG. 1 and FIG. 2A, the cover 10 normally closes the opening portion 100B. The closed state of the cover 10 is maintained by the engagement (latch engagement) between a locking claw portion (main assembly side locking portion) 36*a* provided on a maintenance button (36) provided on a front side of the main assembly 100A and the locking claw portion (opening and closing member side locking portion) 10*b* provided on cover (10). In this embodiment, the locking claw portion 36*a* and the locking claw portion 10*b* is elastically locked releasably. However, this embodiment is not limited to this example. For example, the hole (locking portion) provided in one side and the claw (locking portion) provided in another side may elastically be locked releasably with each other. The inner side of the cover 10 is provided with the urging spring (elastic material) 3. In the state that the cover 10 is closed, a spring 35 is compressed against an elastic force between the inner side of the cover 10 and an upper surface 31*d* of the sub-frame 31 of a unit 100. By a compressive reaction force (elastic force) of the spring 35, the frame 31 is urged counter-clockwisely in FIG. 2A about the axis of the shaft portion 45L, 45R so that a lower surface 31*e* of the frame 31 is pressed against a main stay 37 (main assembly side positioning portion) in the main assembly (100A) side. By this, the frame 31 is held in the positioned state. In other words, the unit 200 is maintained in the state in which it is positioned in the transfer position (the operative position for the image formation) (FIG. 2A, FIG. 2B) A for transferring the developer image which has been transferred onto the intermediary transfer member 34 from the drum 32*a*, onto recording material S. That is the unit 200 is locked at image forming position A by the cooperation of the cover 10, the locking claw portion 10*b* of the cover, the spring 35, and the main stay 37 (FIG. 2A). Here, the cover 10, the locking claw portion 10*b* on the cover side, the spring 35, and main stay 37 constitute a locking member (first locking member). The locking member releases the lock of the unit 200 when the cover 10 moves from the closed position to the open position. According to this embodiment, the unit 200 can be positioned with high precision to the main assembly 100A. In addition, a releasing of the positioning is easy. The structure of the locking member is not limited to this example, but other proper structures can be employed.

Figure 6A:
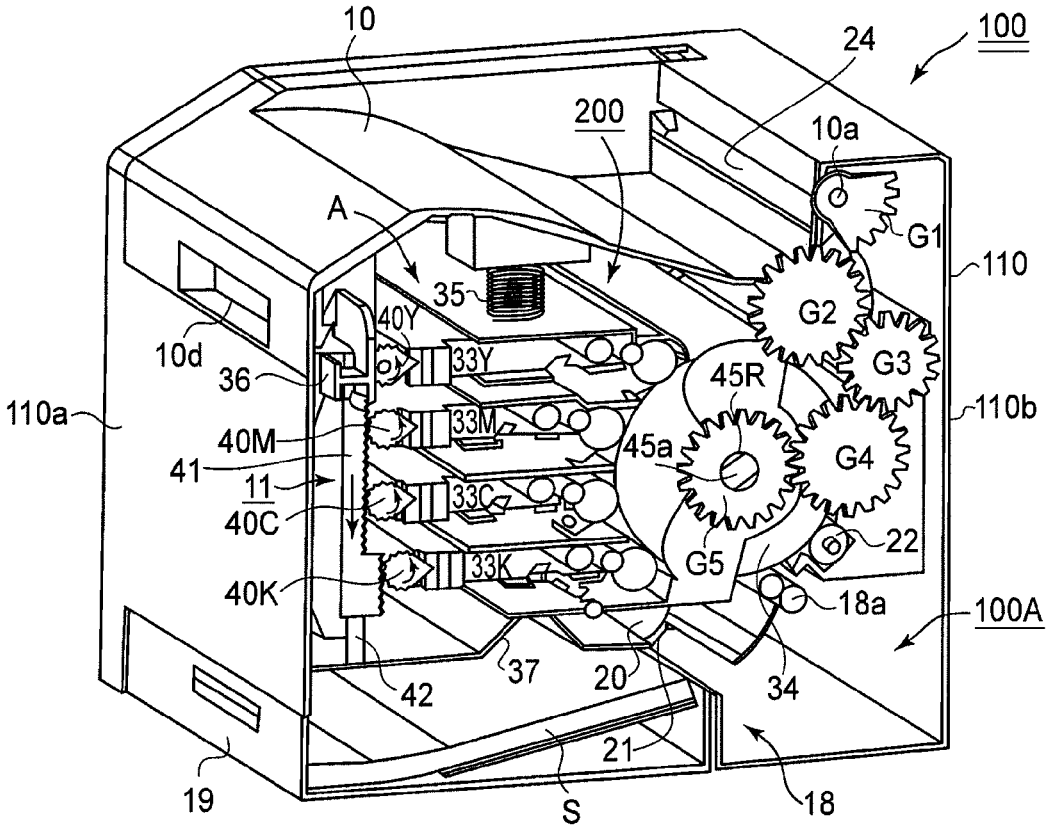
FIG. 6A illustrates the image forming apparatus (1), wherein a positioning member has been moved to a positioning place, and a developing cartridge 33 of each cartridge is positioned.
Figure 6B:
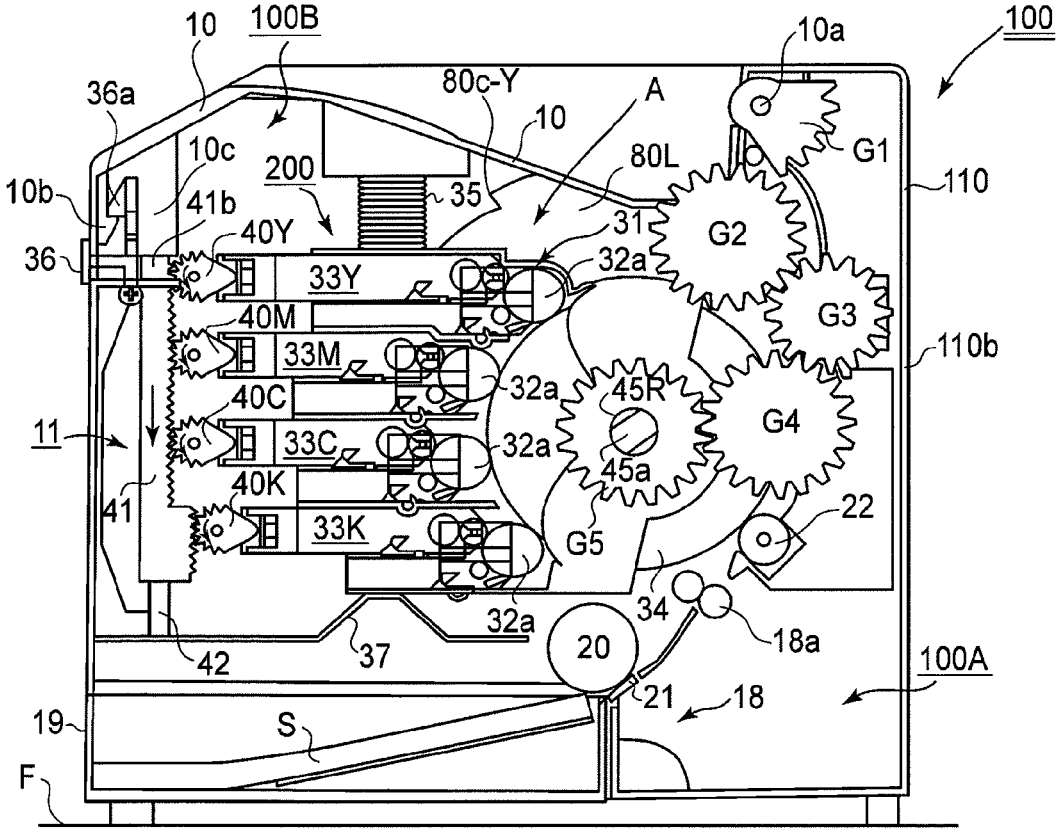
FIG. 6B illustrates the image forming apparatus (2), wherein the positioning member moves to the positioning place, and the developing cartridge 33 of each cartridge is positioned.
Figure 7:
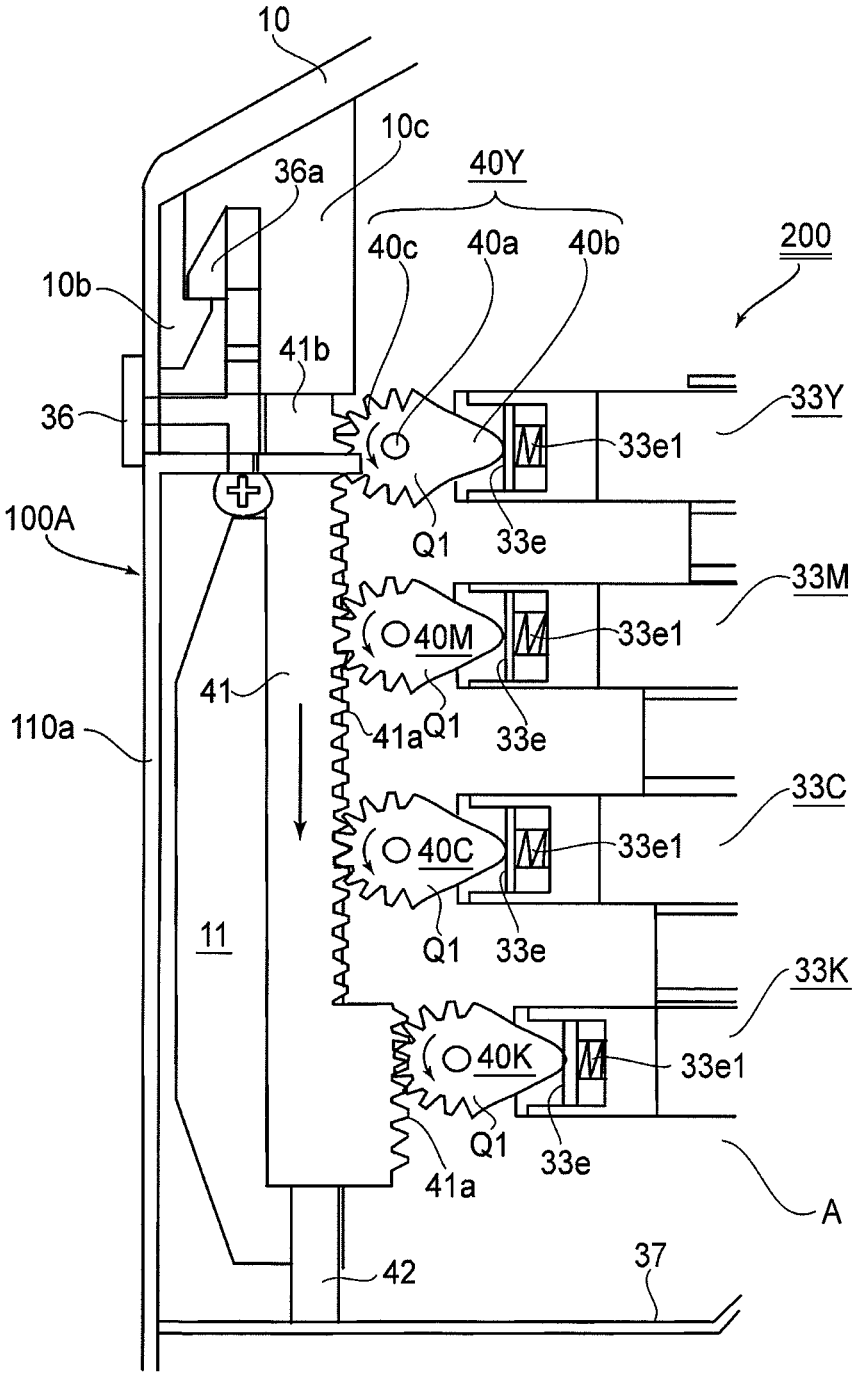
FIG. 7 is a partial enlarged view of FIG. 6B.
Figure 8A:
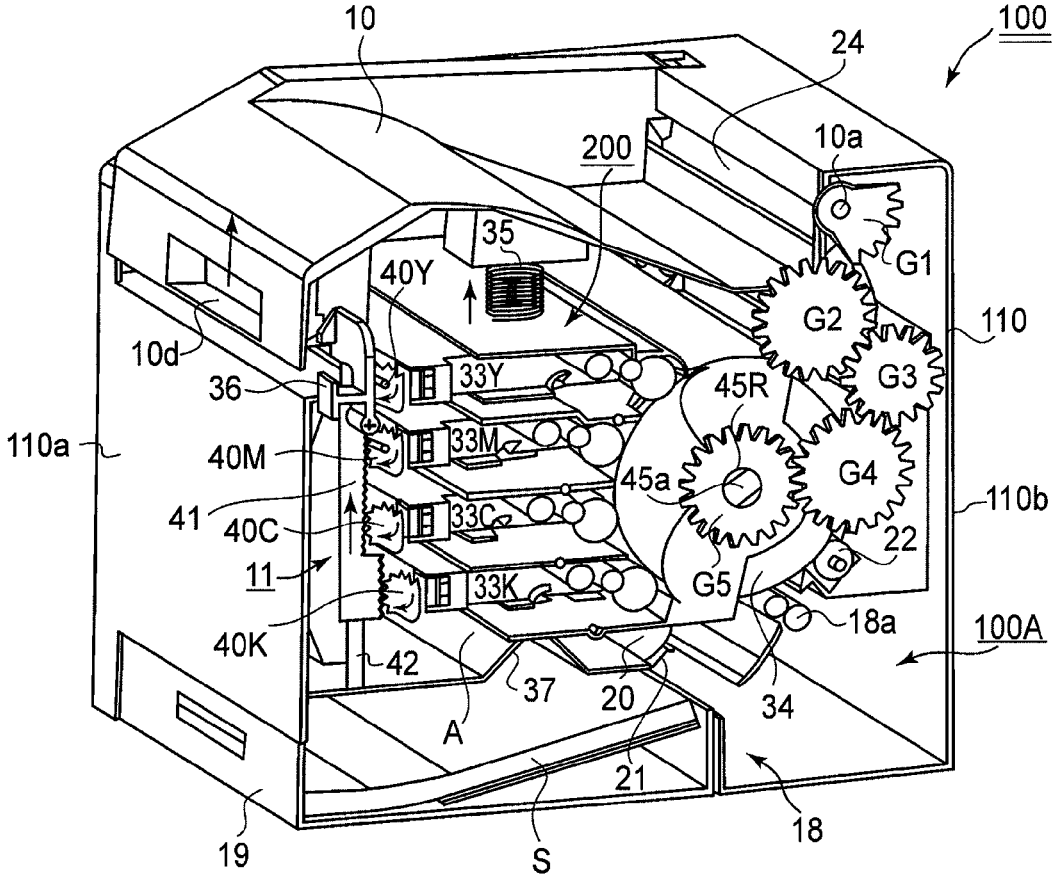
FIG. 8A illustrates the image forming apparatus (1), wherein a cover is partially open.
Figure 8B:
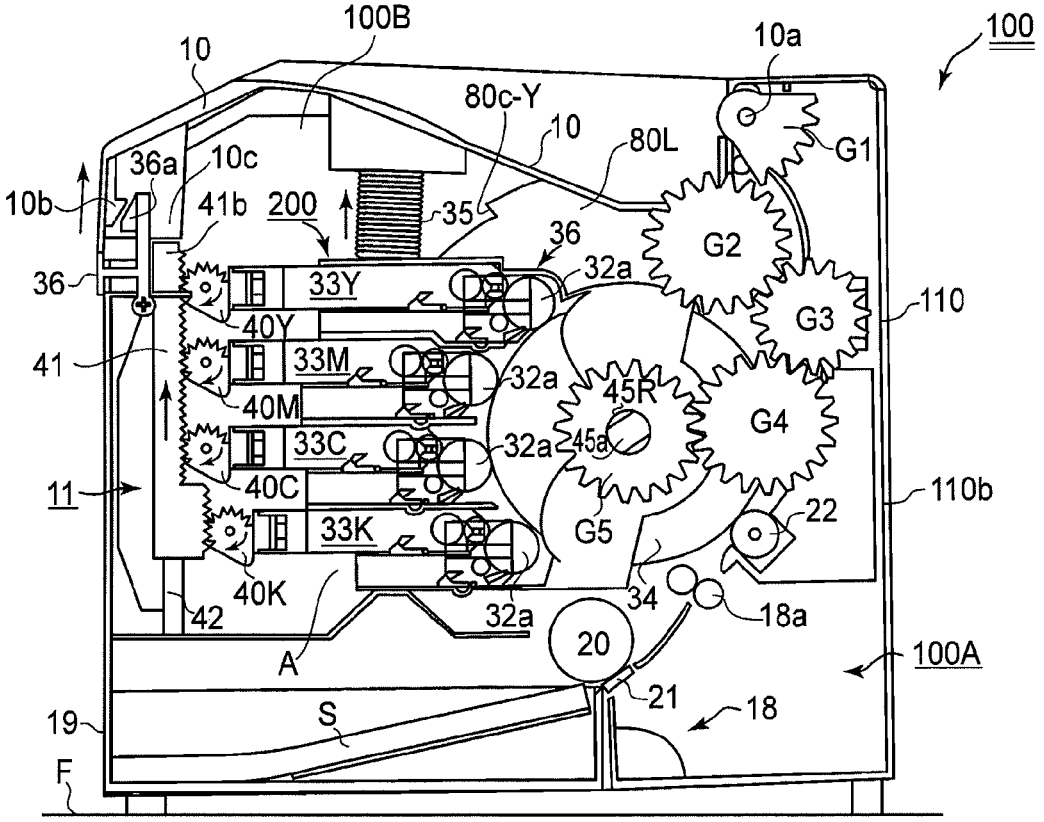
FIG. 8B illustrates the image forming apparatus (2) wherein the cover is partially open.
Figure 9:
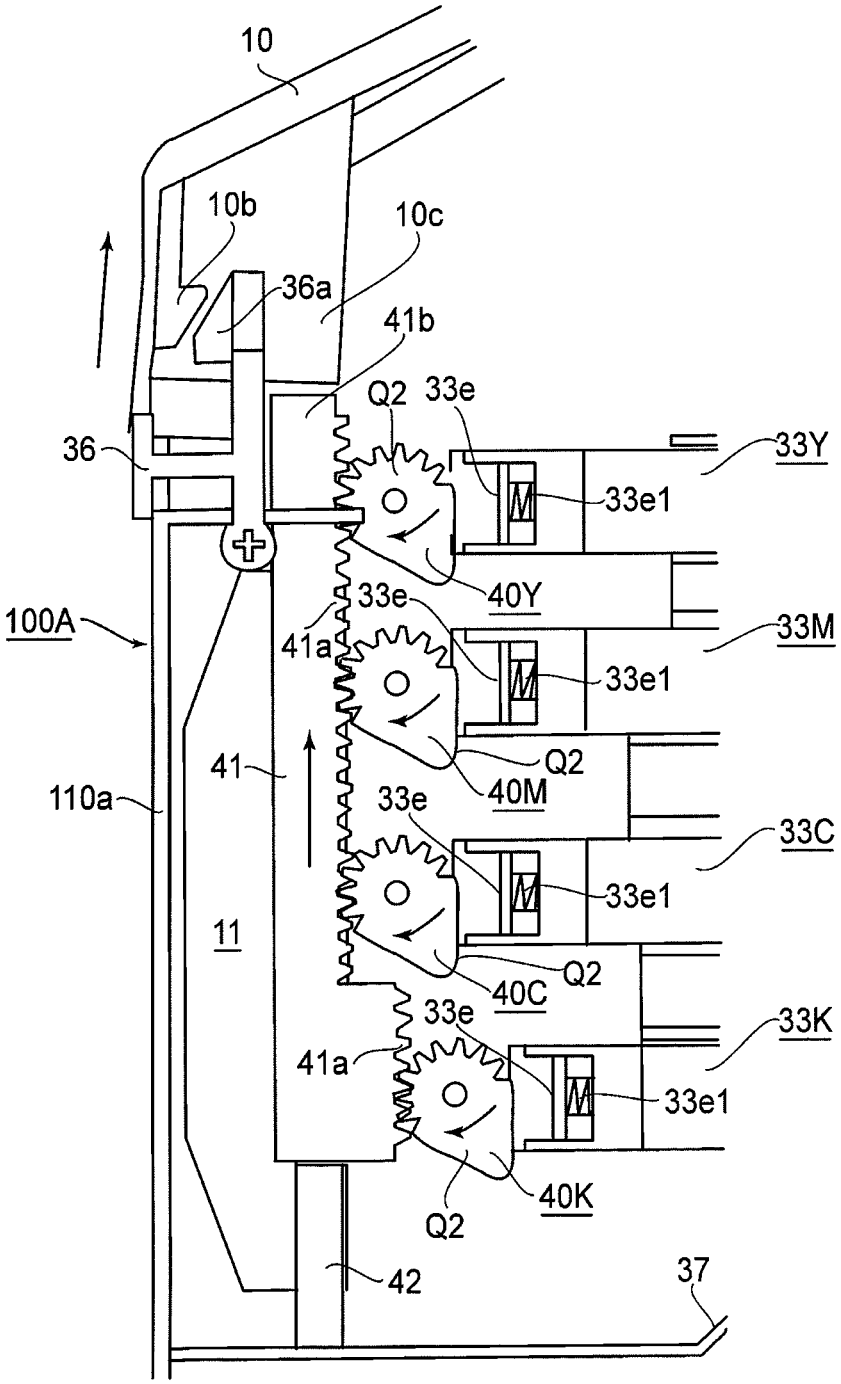
FIG. 9 is a partial enlarged view of FIG. 8B.

The main assembly 100A is provided with a positioning member 40. In the state where the unit 200 is placed in transfer position A, the positioning member 40 is movable between a positioning place Q1 (FIG. 6A and FIG. 6B, and FIG. 7) for positioning the cartridge 33 in the predetermined position and a retracted position Q2 (FIG. 8A and FIG. 8B, and FIG. 9) retracted from the positioning place Q1. In the state that the cover 10 is closed, the cartridge 33 supported by the unit 200 placed in transfer position A is pushed to the positioning member 40 to be positioned in a predetermined position. More particularly, the cartridge 33 is urged and positioned so that the developing roller 33*b* is positioned relative to the drum 32*a*. FIG. 6A and FIG. 6B show the state in which the urging members 40 (40Y, 40M, 40C, 40K) as the positioning member moves to the positioning place and each cartridge 33 is positioned. FIG. 7 shows a partial enlarged view of FIG. 6B. Referring to FIG. 7, each urging member 40 is disposed correspondingly to each cartridge 33 to the inside of the front frame 110*a* of the main assembly 100A perpendicularly adjacent to each other. Each urging member 40 is rotatable about a supporting shaft 40*a*. Each urging member 40 is provided with a projection 40*b* for pressing the contact unit 33*e* of the cartridge 33 and a gear portion (pinion) 40*c* in the opposite side from the projection (40*b*) side with respect to the supporting shaft 40*a*. A gear portion 40*c* is in meshing engagement with rack teeth 41*a* of a pressing rack 41 as a common interrelating member extended perpendicularly. The pressing rack 41 is perpendicularly slidable in the main assembly 100A. The rack 41 is normally urged upwardly by the elastic force of a spring 42. Each urging member 40 is rotated in the clockwise direction or the counterclockwise direction in FIG. 7 around the supporting shaft 40*a* in the same phase in interrelation with a lowering movement or a rising movement of the rack 41. In the state that the cover 10 is closed, a top end 41*b* of the rack 41 contacts to an inside member 10*c* of the cover 10 to descend to a predetermined lower position against the raising force (elastic force) of the spring 42, and it is held in the lower position. As shown in FIGS. 6A and 6B and FIG. 7, the projection 40*b* of each urging member 40 takes a backward angular attitude (positioning place Q1) opposed to the contact unit 33*e* of the corresponding cartridge 33. By this, each urging member 40 presses the contact unit 33*e* with the predetermined pressure. The cartridge 33 is urged in the direction of the photosensitive unit 32. By this, the cartridge 33 is positioned relative to the photosensitive unit 32. By the positioning of the cartridge 33, the developing roller 33*b* is positioned relative to the drum 32*a*. A unit 33*e* is disposed at a trailing end of the cartridge 33 in the state that the cartridge 33 is mounted to the mounting portion 31*c*. The unit 33*e* is provided with a spring (resilient member) 33*e*1 (FIG. 9). Therefore, the trailing end (unit 33*e*) is urged against the elastic force of a spring 33*e*1 by the urging member 40, by which the cartridge 33 is positioned. Here, the urging members 40 (40Y, 40M, 40C, 40K) as the positioning member and the pressing rack 41 as the interrelating member are provided symmetrically in each of a left-hand side and a right-hand side in the main assembly 100A. The drive inputting portion (unshown) of the intermediary transfer member 34 of the unit 200 placed in transfer position A couples with the drive outputting portion (unshown) in the main assembly side. The drive inputting portions for the photosensitive unit 32 and the cartridge 33 is coupled through the hole portions 80*e*, 80*f* ((b) of FIG. 5) of the left guiding plate 80L to the drive outputting portions of the main assembly (100A) side. The electrical contacts of the photosensitive unit 32 and the cartridge 33 are electrically connected to the electric power supply system in the main assembly (100A) side. By this, an image forming operation (print operation) of the image forming apparatus 100 is enabled, and the above-mentioned image forming operation is carried out on the basis of an image formation start signal (print start signal).

According to the embodiment described above, as shown in FIGS. 2A and 2B, the scanner unit 11, the cartridge 33, the drum 32*a*, the intermediary transfer member 34, and the feeding path Z for the recording material S are provided substantially along installation surface F. In the upper portion of the apparatus 100, the cover 10 functioning also as the discharging tray is provided, and the cassette 19 is provided in the lower portion of the device 100. The laser beams L (LY, LM, LC, LK) are projected from the scanner unit 11 to the drum 32*a* in the rear part of the cartridge 33. the color developer image transferred onto the intermediary transfer member 34 from each drum 32*a* is transferred onto recording material S in the opposite side from each drum 32*a* with respect to the intermediary transfer member 34. Furthermore, according to this embodiment, the unit 200 can be rotated between the transfer position A (image forming position) and the mounting and dismounting position B in the state that the drum 32*a* is mounted to the unit 200, and the cartridge 33 is dismountably mounted to the unit 200 (mounting portion 31*c*). By rotating the unit 200 to the mounting and dismounting position B from the transfer position A, the cartridge 33 is mounted and demounted relative to the unit 200. According to the embodiment described above, with such a structure, the apparatus 100 can be downsized.

(Exchanging System of Developing Cartridge)

Each of the cartridges 33 (33Y, 33M, 33C, 33K), the developer contained in a developing device (developer accommodating portion) 33*c* is consumed, with the image forming operation. In view of this, for example, the means (unshown) for detecting a remaining amount of the developer of each cartridge 33 is provided in the main assembly 100A. The control circuit portion 300 compares a detected remaining amount value with the threshold for a lifetime fore notice and a lifetime warning of the cartridge 33 preset beforehand. The lifetime fore notice or the lifetime warning of the cartridge 33 is displayed on the display portion 102 of an operating portion 101 (FIG. 1) of the image forming apparatus 100 for the cartridge 33 exhibiting the detected remaining amount value less than the threshold. Or, the lifetime fore notice or the lifetime warning for the cartridge 33 is displayed on the display portion of the external host device 400 (FIG. 2A). By this, a preparation of the cartridge 33 for the exchange is prompted, or, the exchange of the cartridge 33 is prompted for the user, to maintain the quality of the output image. In this embodiment, in an exchange of the cartridge 33 mounted to the unit 200, the opening 100B is exposed by opening the cover 10. In this embodiment, for closure and opening of the cover 10, the user pushes a maintenance button 36 provided on the front side of the main assembly 100A. When the user pushes a button 36 rearwardly against the spring (unshown), the locking claw portion 36*a* on the button (36) side escapes from the locking claw portion 10*b* on cover (10) side backwardly to release the latch engagement. By this, the cover 10 is pushed up by the compressive reaction force (elastic force) of the spring (elastic material) 35 compressed between itself and the upper surface of the sub-frame 31 of the unit 200. The cover 10 is rotated in an open direction from the main assembly 100A by an angle corresponding to an operation distance (restoration length to a free length) of the spring 35 about the hinge shaft 10*a*. More particularly, the cover 10 is automatically partly opened by the elastic force of the spring 35. FIG. 8A and FIG. 8B and FIG. 9 show the partly open state of the cover 10. Thereafter, when the user lifts the finger from the button 36, the force (elastic force) of the urging spring (unshown) restores it to the previous position. At this time, the locking claw portion 10*b* is placed in the upper portion by the partly opening of the cover 10, and therefore, it is not engaged with the locking claw portion 36*a* which has been restored.

By the interrelating mechanism (unshown) in interrelation with the partially opening rotation of the cover 10, the coupling of the drive outputting portion of the main assembly side with the drive inputting portion of the intermediary transfer member 34 of the unit 200 is released. The coupling of the drive outputting portion of the main assembly (100A) side with the photosensitive unit 32 of each cartridge and the drive inputting portion of the developing cartridge 33 is released. The electrical connection of the electric power supply system in the main assembly (100A) with the photosensitive unit 32 of each cartridge P and the electrical contact of the developing cartridge 33 is released. The pressing, to the main stay of the unit 200, 37 of the spring (resilient member) 35 is released by the partially opening rotation of the cover 10. The suppression of the top end 41*b* of the pressing rack 41 by the inside member 10*c* of the cover 10 is released by the partially open rotation of the cover (opening and closing member) 10. By this, the pressing rack 41 rises to a predetermined upper position by the elastic force of the spring (resilient member) 42. In interrelation with the rising movement of the pressing rack 41, each urging member 40 rotates through substantially 90 degrees in the same phase about the supporting shaft 40*a* from the positioning place Q1 shown in FIG. 7 to move to a rotation angle attitude (retracted position Q2) in which the projection 40*b* is downward substantially, as shown in FIG. 9. By this, the projection 40*b* of each urging member 40 separates from the corresponding contact unit 33*e* so that pressing of the contact unit 33*e* by each urging member 40 is released. More particularly, each of the urging member 40 moves to the retracted position Q2 (FIG. 9) retracted from the positioning place Q1 of the corresponding cartridge 33 (FIG. 7). By this, the positioning of the developing cartridge 33 is released.

Figure 11:
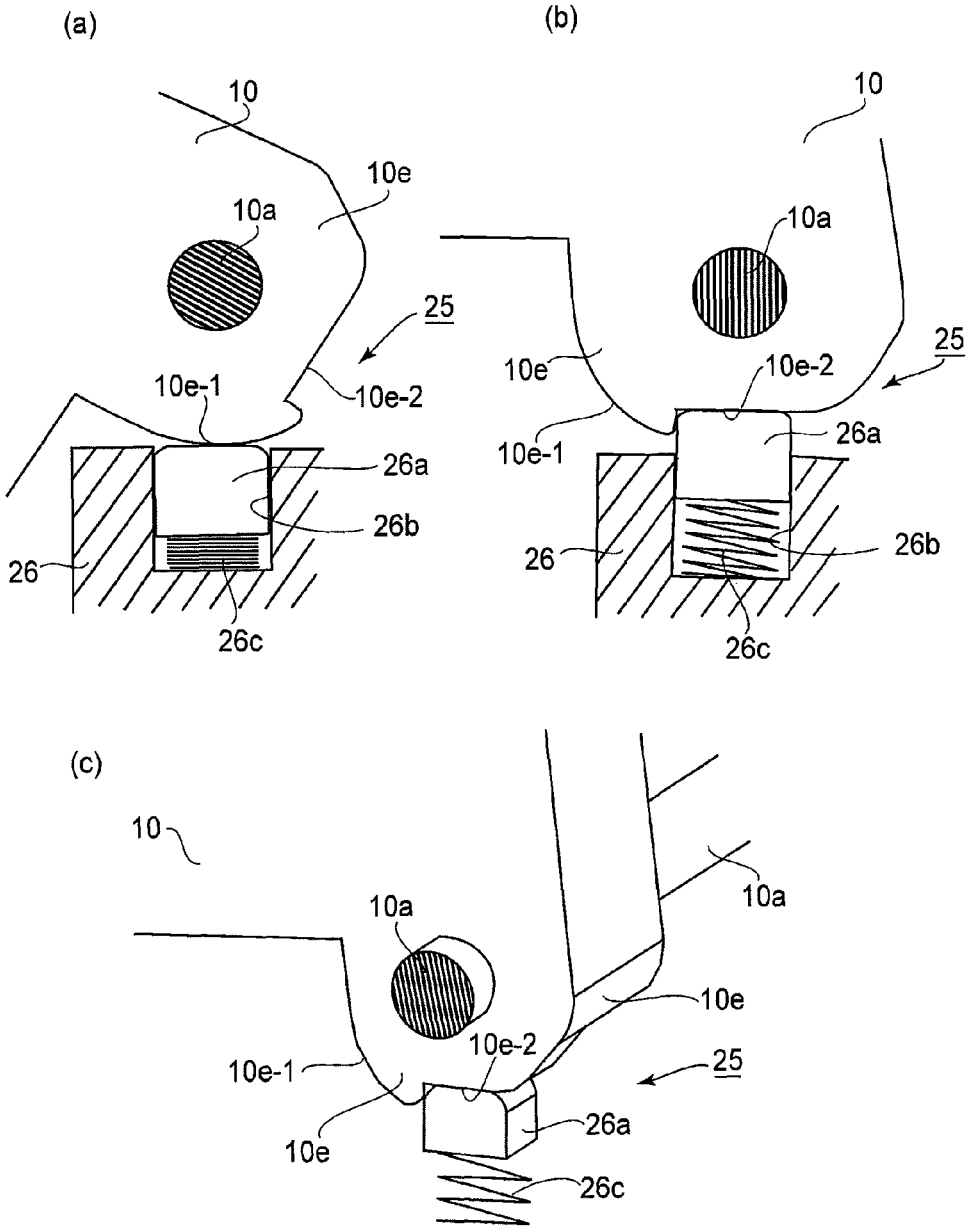
FIG. 11 is an illustration of a click mechanism of the cover.

Then, the user manually operates a grip portion 10*d* of the cover 10, to sufficiently rotate the cover 10 to the predetermined open position for opening the opening portion 100B about the hinge shaft 10*a*. FIG. 10A and FIG. 10B illustrate the state that the cover 10 is opened to the predetermined open position. When the cover 10 is opened to the open position, the open state is maintained by locking means. Thereafter, even if the hand is lifted from the cover 10, the cover 10 is not automatically rotated in the returning direction. The locking means may have another structure. In this embodiment, the locking means has a click stop mechanism 25 as shown in FIG. 11. In (a) of this Figure, the cover 10 is in the closing position, and in (b) and (c), the cover 10 is in the open position. The cover 10 is provided with an integral cam part 10*e*. The stationary member 26 provided in the main assembly 100A is provided with a click protrusion 26*a* normally contacted elastically to the cam portion 10*e*. The protrusion 26*a* is sinkably inserted in a hole portion 26*b* of the stationary member 26, and it is normally urged elastically in the projecting direction by the elastic force of the raising spring (resilient member) 26*c*. In the state that the cover 10 is in the closing position ((a) of FIG. 11), an arcuate surface portion 10*e*-1 of the cam portion 10*e* is correspondingly to the position of the protrusion 26*a*. The surface portion 10*e*-1 is extended with the center thereof aligned with a shaft axis of the hinge shaft 10*a* (arcuate shape). In the state that the cover 10 is in the open position, ((b) (c) of FIG. 11), a recess 10*e*-2 of the cam portion 10*e* corresponds to the position of the protrusion 26*a*. The protrusion 26*a* is in engagement with the recess 10*e*-2. The cover 10 is maintained in the open position by this engagement. Therefore, even if the user lifts the hand from the cover 10, the cover 10 is not rotated in the closing direction (returning direction).

The left and right ends of the hinge shaft 10*a* are rotatably supported by the left and right frames 110L, 110R of the main assembly 100A. The cover 10 is unified with this hinge shaft 10*a*. Therefore, the hinge shaft 10*a* is rotated with the opening and closing rotation of the cover 10. The left and right ends of the hinge shaft 10*a* are provided with an integral sector cover gears G1 which are symmetrical in the same phase. The left-hand side cover gear G1 and the left-hand side sub-frame gear G5 are engaged with each other by idle gears G2, G3, G4, and the right-hand side cover gear G1 and the right-hand side sub-frame gears G5 are engaged with each other by idle gears G2, G3, G4. The left-hand side idle gears G2, G3, G4 are rotatably provided on the left-hand side frame 110L of the main assembly 100A. The right-hand side idle gears G2, G3, G4 are rotatably provided on the right-hand side frame 110R of the main assembly 100A. The cover 10 and the image forming unit 200 are rotatable interrelatedly with each other by gear coupling. More particularly, the gears G1-G5 constitute an interrelating member between the cover 10 and the image forming unit 200.

In the state that the cover 10 is in the closing position which closes the opening portion 100A, the sector cover gear G1 is in the angular attitude of not engaging with the idle gear G2, as shown in FIGS. 6A and 6B. More particularly, the cover 10 and the unit 200 are not in the gear connection state. By this, the unit 200 can be positioned relative to the main assembly 100A irrespective of the position of the cover 10, in the state that the unit 200 is assuredly abutted to the main stay 37 by the spring 35. Even when the cover 10 is partly opened by depression of the button 36, the sector cover gear G1 takes the angular attitude of the non-engagement with the idle gear G2, as shown in FIG. 8A and FIG. 8B. More particularly, the cover 10 and the unit 200 are not in the gear connection state. The user operates the grip portion 10*d* of the partly opening cover 10 shown in FIG. 8A FIG. 8B to open the cover 10 by the manual operation to the open position as shown in FIGS. 10A and 10B. When the cover 10 is opened beyond the partly opening angle the cover gear G1 is engaged with the idle gear G2. The continuing rotation force in the open direction for the cover 10 is transmitted from the cover gear G1 through the idle gears G2, G3, G4 to the sub-frame gear G5. By this, the unit 200 rotates in the clockwise direction as seen from the right of the image forming apparatus 100 about the left and right shafts 45L, 45R in the main assembly 100A. By the cover 10 being opened, the top opening 100B of the main assembly 100A is opened. When the cover 10 is sufficiently opened to the open position, the opening state thereof is kept by the click stop mechanism 25 (FIG. 11). By this, the opening portion 100B is opened sufficiently greatly, as shown in FIGS. 10A and 10B. The unit 200 rotates through substantially 45 degrees clockwisely from transfer position A (FIG. 6A and FIG. 6B) to move to the angular attitude in which the cartridge 33 faces to the opening portion 100B (FIGS. 10A and 10B). The unit 200 maintains the angular attitude. More particularly, the unit 200 rotates to the mounting and dismounting position B in interrelation with the movement of the cover 10 to the opening direction where the cartridge 33 can be dismounted through the opening portion 100B. Here, the mounting and dismounting position B is the position in which the user mounts and demounts the cartridge 33 relative to the mounting portion 31*c*. The positioning member 40 moves from the positioning place to the retracted position with the movement of the unit 200 to the mounting and dismounting position B from the transfer position A. The cartridge 33 can be mounted and demounted relative to the mounting portion 31*c* in the mounting and dismounting position B.

Figure 12A:
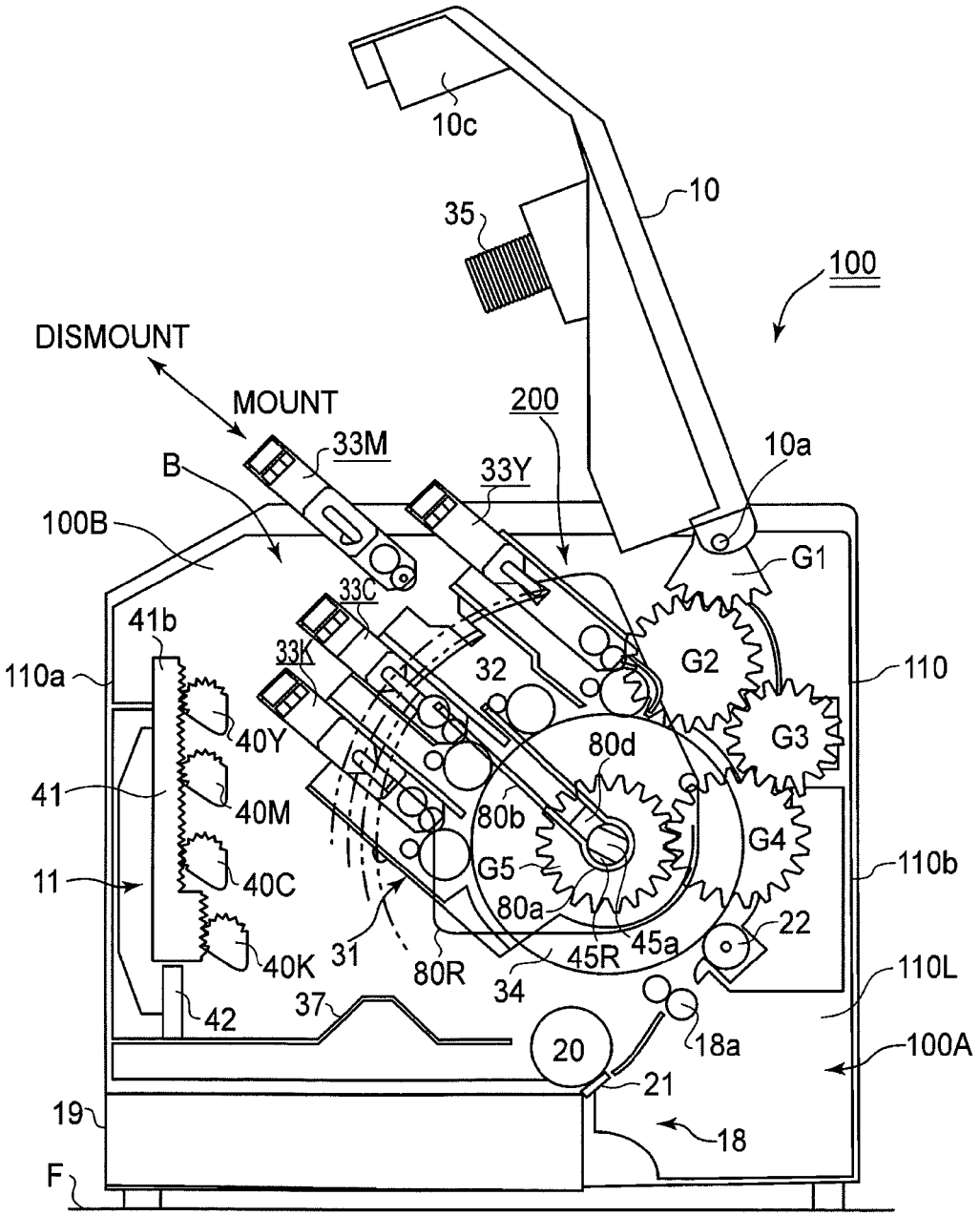
FIG. 12A is an illustration of a mounting and demounting process of the developing cartridge.
Figure 12B:
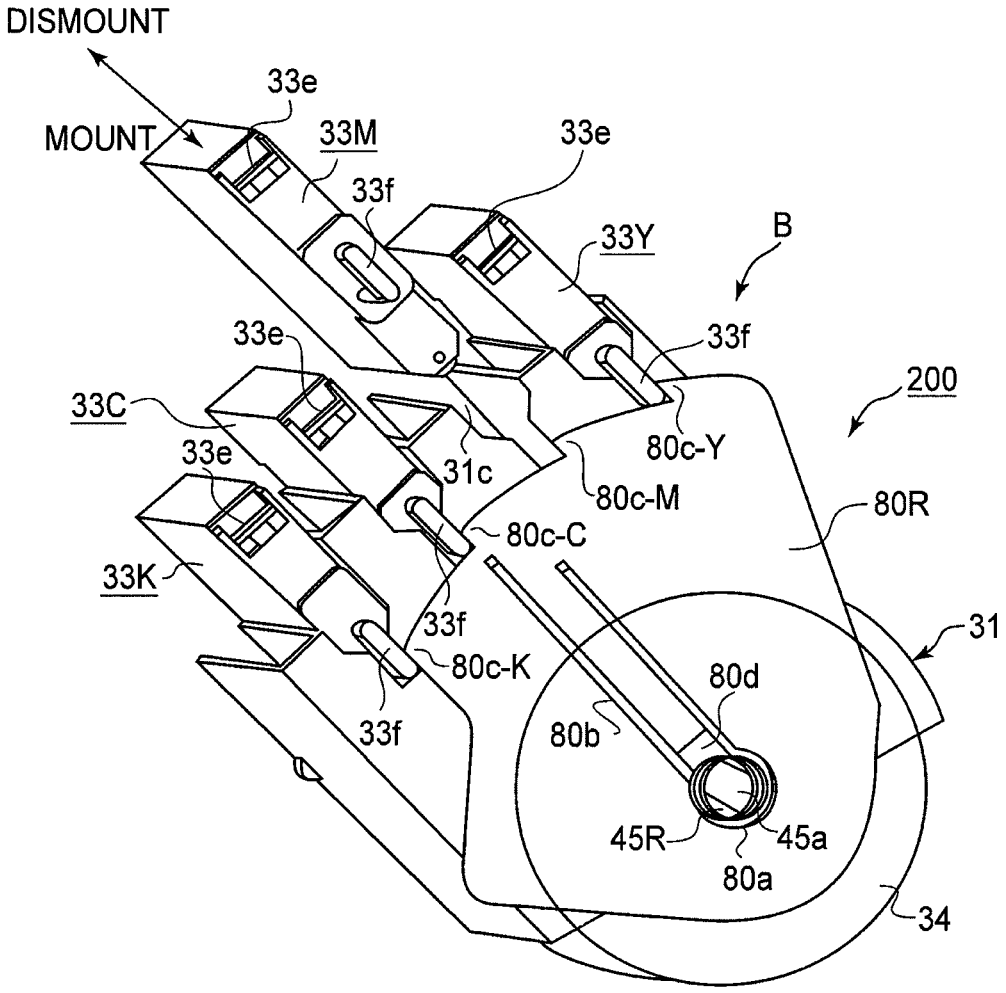
FIG. 12B is a partial enlarged perspective view of FIG. 12A.

According to the embodiment described above, by the user pushing the button 36, the cover 10 opens by a predetermined small angle by the spring. Then, the user moves the cover 10 opened through the predetermined angle to the fully-open position by the manual operation. In interrelation with this movement, the unit 200 moves from the transfer position A to the mounting and dismounting position B. And, in interrelation with this movement, the positioning member 40 moves from the positioning place to the retracted position. Therefore, only if the user moves the cover 10 to the fully-open position by the manual operation, the unit 200 can be moved from transfer position A to the mounting and dismounting position B, and the positioning of the cartridge 33 by the positioning member 40 can be released. Therefore, the mounting and dismounting operativity of the cartridge 33 relative to the mounting portion 31*c* can be improved. With the structure of the image forming apparatus 100 described above, the cartridge 33 can be exchanged, without retracting the scanner unit 11. By this, the user can exchange the cartridge 33 easily. FIG. 12A is a schematic right sectional view of the image forming apparatus including a guiding plate 80R in the mounting and dismounting position B of the unit 200. FIG. 12B is a perspective view of the guiding plate 80R and the image forming unit 200. The cartridge 33 is provided with left and right locking members 33*f*. In the unit 200 which is in the mounting and dismounting position B, the locking member 33*f* is locked with projections 80*c* (80*c*-Y, 80*c*-M, 80*c*-C, 80*c*-K) of the guiding plate 80R when at least one cartridge 33 is mounted to the sub-frame 31 This applies similarly to the left-hand side guiding plate 80L. Here, the locking members 33*f* of the cartridges 33 are provided at the different radial distances from the shaft portions 45L, 45R. For this reason, the cartridges 33 are locked with the projection 80*c* independently from each other.

With the structure described above, when at least one cartridge 33 is mounted to the sub-frame 31 (unit 200), the rotation of the unit 200 is prevented beyond the mounting and dismounting position B (FIG. 12A). At this time, the key-shaped portions 45*a* of the free end portion of the left and right shafts 45L, 45R do not align with the entrance openings 80*d* of the left and right guiding plates 80L, 80R in the direction. For this reason, the sub-frame 31 and the intermediary transfer member 34 cannot be dismounted from the main assembly 100A. More particularly, in the case that at least one cartridge 33 is mounted to the unit 200, the unit 200 and the intermediary transfer member 34 cannot be dismounted from the main assembly 100A. This is because the unit 200 cannot rotate to the mounting and dismounting position B. When all the cartridges 33 are dismounted from the unit 200 placed in the mounting and dismounting position B, the unit 200 can be dismounted from the main assembly 100A integrally with the intermediary transfer member 34 mounted rotatably to the unit 200 ((b) of FIG. 4). In a mounting direction in which the unit 200 is mounted to a main assembly 100*a*, a leading end of the unit 200 is provided with the intermediary transfer member 34, and the trailing end thereof is provided with the mounting portion 31*c*. The side of the unit 200 is provided with a gear G5.

Figure 13A:
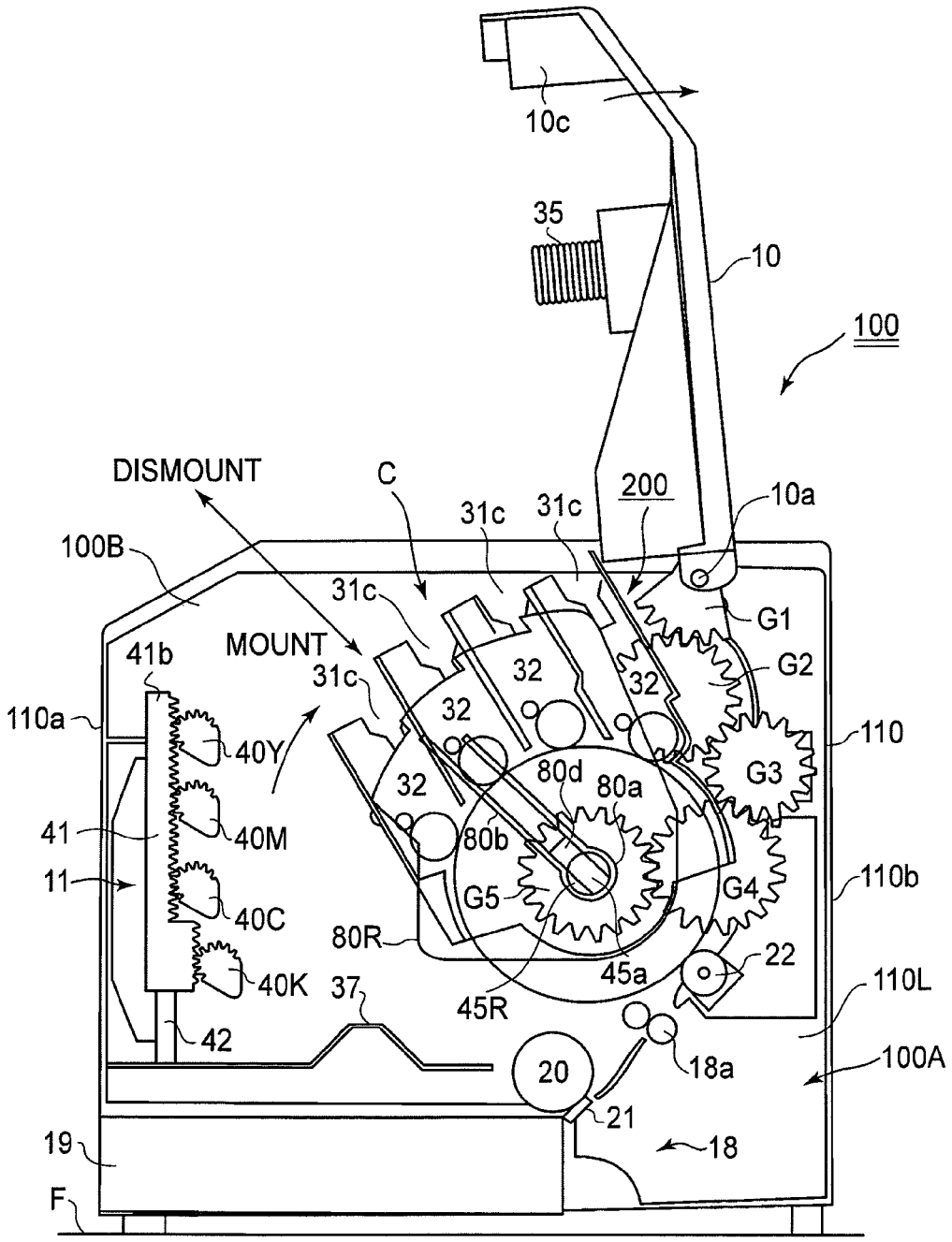
FIG. 13A is an illustration (1) of the mounting and demounting process of a sub frame and an intermediary transfer member.
Figure 13B:
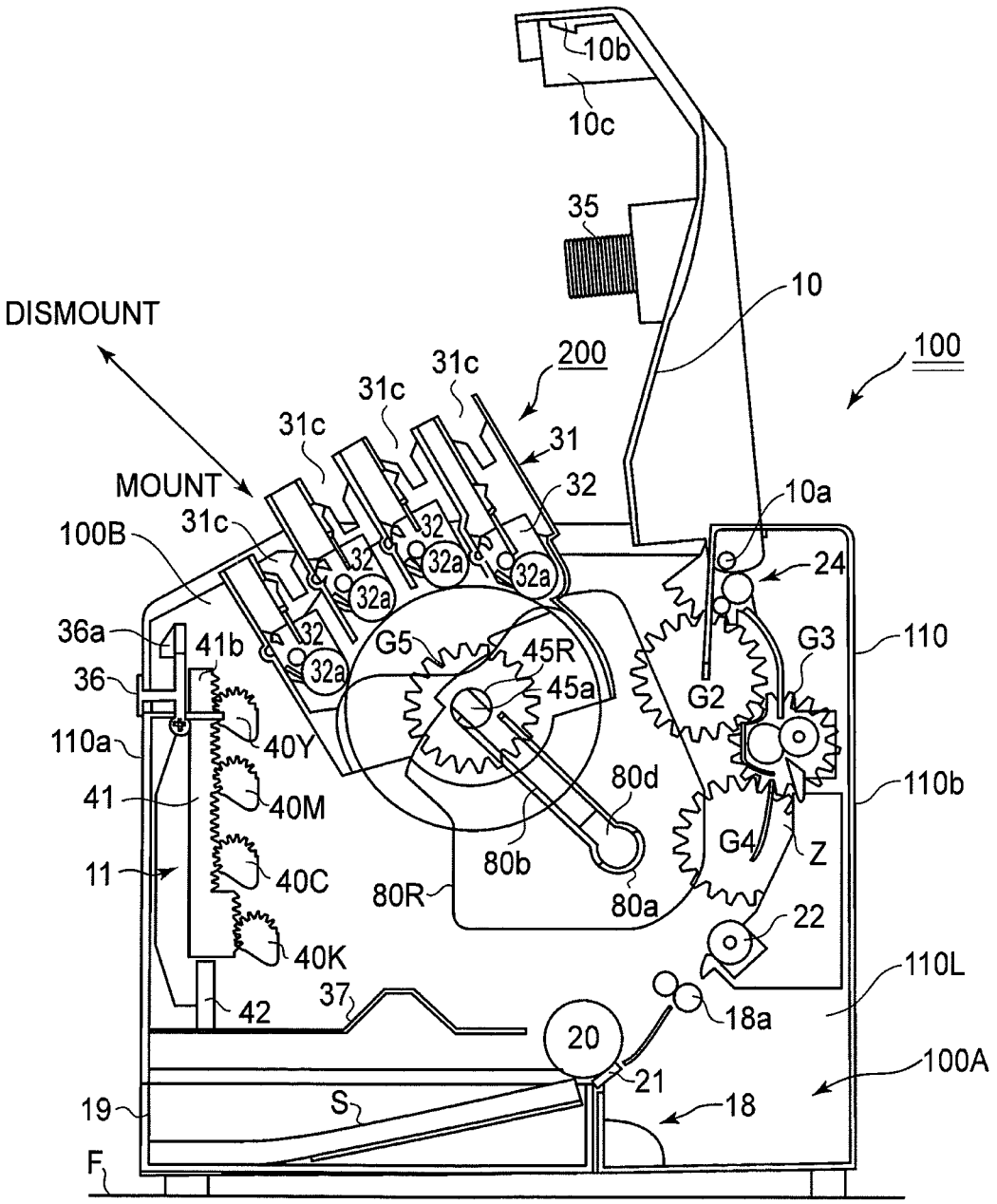
FIG. 13B is an illustration (2) of the mounting and demounting process of the sub frame and the intermediary transfer member.

FIG. 13A is a vertical section right side view of the image forming apparatus 100 in which all of the cartridges 33 are removed, and the sub-frame 31 and the intermediary transfer member 34 are dismountable from the main assembly 100A. Since the cartridge 33 is all dismounted from the frame 31 (unit 200 and mounting portion 31*c*), the locking members 33*f* are not locked with the projections 80*c* of the left and right guiding plates 80L, 80R. For this reason, the frame 31 can be rotated further clockwisely from the mounting and dismounting position B (FIG. 12A). More particularly, the frame 31 (unit 200) can be rotated until the key configurations 45*a* of the free end portions of the shaft portions 45L, 45R align with the loading slots 80*d* of the guiding plates 80L, 81R in the direction. The user rotates the frame 31 (unit 200) further clockwisely from the mounting and dismounting position B to move the key configurations 45*a* of the free end portions of the shaft portions 45L, 45R to an angular position C aligned with the entrance openings 80*d* of the guiding plates 80L, 81R, as shown in FIG. 13A. As shown in FIG. 13B, in angular position C, the frame 31 and the intermediary transfer member 34 are moved from the main assembly 100A toward the opening portion 100B along the guides 80*b* of the guiding plates 80L, 80R, so that it can be taken out of the main assembly 100A. More particularly, the user moves the unit 200 and the intermediary transfer member 34 along the guide 80*b* so that main assembly 100A can be taken out through the opening portion 100B. In addition, the user moves the unit 200 and the intermediary transfer member 34 along the guide 80*b* to mount it into the main assembly 100A through the opening portion 100B. In this embodiment, the mounting and demounting of the unit 200 relative to the main assembly 100A is carried out in the state that the cartridge 33 is not mounted to the unit 200. Therefore, in mounting and demounting the unit 200 relative to the main assembly 100A, the damage of the cartridge 33 can be prevented.

Here, when the frame 31 (unit 200) is further rotated from the mounting and dismounting position B (FIG. 12A) to the position C clockwisely, the rotation force is transmitted from a frame gear G5 through the idle gears G4, G3, G2 to the cover gear G1. For this reason, it further rotates in the open direction from the open position in which the cover 10 is held by the click stop mechanism 25. At this time, the further rotation of the cover 10 in the open direction is permitted by the sinking of the click protrusion 26*a*. Therefore, no straining force is applied to the gears G1-G5. By this, the frame 31 (unit 200) and the intermediary transfer member 34 can be taken out of the main assembly 100. The intermediary transfer member 34 can be removed from the intermediary transfer frame 31*a* (FIG. 2B) provided in the frame 31 (unit 200). By removing the intermediary transfer member 34 from the frame 31*a*, the photosensitive unit 32 can be removed from the supporting unit 31*b* (FIG. 2B). By this, as needed, the intermediary transfer member 34 or/and the photosensitive unit 32 can be exchanged with the new one relative to the frame 31. Through the reverse process, the frame 31 and the intermediary transfer member 34 can be mounted into the main assembly 100.

In this embodiment, the unit 32 is dismountable relative to the unit 200. In such a case, the unit 32 can also be called process cartridge. This is because, the drum 32*a*, the charging roller 32*b* and the cleaning blade 32*c* as the process means are unified, and the unit is detachably mountable to the main assembly 100A. However, the unit 32 may be securedly fixed to the unit 200. In this embodiment, when the unit 32 are securedly fixed to the unit 200, four sets of the drum 32*a*, the charging roller 32*b*, the cleaning blade 32*c* as the process means are provided. The unit 200 unifies them and is dismountably mounted to the main assembly 100A. Therefore, in the case of such a structure, the unit 200 can also be called process cartridge. In FIG. 2B, designated by b is a locking claw (locking portion, projecting member) and is provided on the unit 32. Designated by a is a locking claw (locking portion, resilient member) and is provided on the unit 200. By the releasable locking between the locking claw b and the locking claw a, the unit 32 is dismountably mounted to the unit 200. However, this embodiment is not limited to this example. For example, the claw (locking portion) provided on one side may be elastically and releasably locked with the hole (locking portion) provided in another side.

A unit 200 is rotated about the rotation axis 34*a* of the intermediary transfer member 34 to move between the transfer position A and the mounting and dismounting position B. At the time of an image formation (image transfer) and during the dismounting operation of the cartridge 33, the intermediary transfer member 34 is positioned by the shaft portions 45L, 45R and the positioning portion 80*a*. For this reason, the rattling of the intermediary transfer member 34 is suppressed. The shaft portions 45L, 45R are provided on the frame 31. The positioning portions 80*a* are provided on the guiding plates 80L, 80R, respectively. The intermediary transfer member 34 is cylindrical, and the unit 200 rotates about the center axis of the drum 34. More particularly, the unit 200 is rotated co-axially with the drum 34. By this, the spacing required to move the unit 200 between the transfer position A and the mounting and dismounting position B can be reduced. Therefore, the image forming apparatus 100 is downsized. If all the cartridges 33 mounted to the unit 200*s* are not dismounted, the intermediary transfer member 34 and the unit 200 (sub-frame 31) cannot be removed from the main assembly 100A. By this, at the time of the exchange of the cartridge 33, the intermediary transfer member 34 which is less frequently exchanged can be prevented from being removed inadvertently. When the cartridge 33 and the intermediary transfer member 34 are integrally dismounted from the main assembly 100A, there is a liability that the cartridge 33 or the intermediary transfer member 34 may disengage, but this can also be prevented according to the present invention.

A process will be described in which after the cartridge 33 is exchanged in the state where the unit 200 is placed in the mounting and dismounting position B, the unit 200 is again moved to the transfer position A. As shown in FIG. 12A and FIG. 12B, the cartridge 33 is inserted into the mounting portion 31*c* of the unit 200 placed in the mounting and dismounting position B. By this, the cartridge 33 is temporarily held on the mounting portion 31*c* by the engagement between the resilient member c (FIG. 2B) provided on the mounting portion (31*c*) side and the projecting member d provided on the cartridge (33) side. After the exchange of the cartridges 33, the user rotates the cover 10 which is in the open position in the closing direction against the clicking engagement force of the click stop mechanism 25. In interrelation with the rotation of the cover 10 in the closing direction, the unit 200 rotates in the counterclockwise direction (FIG. 12A) about the shaft portions 45L, 45R. In this case, the moving force of the cover 10 is transmitted to the unit 200 through the gears G1-G5. Here, the gears G1-G5 are a fourth interrelating member. When the cover 10 is closed to the neighborhood of the partly-open position, the engagement of the cover gear G1 with the idle gear G2 is released. More particularly, the gear coupling between the cover 10 and the unit 200 is released. For this reason, the unit 200 is rotated counter-clockwisely about the shaft portions 45L, 45R by the weight. The unit 200 is supported on the main stay 37. More particularly, the unit 200 is placed in the transfer position A. By the further rotation of the cover 10 in the closing direction, the spring 35 provided on the inner surface of the cover 10 contacts to the upper surface of the frame 31. The user moves the cover 10 to the closing direction while pushing and contracting the spring 35, until the locking claw portion 10*b* provided on the cover 10 engages with the locking claw portion 36*a* of the button 36. If a claw portion 10*b* engages with a claw portion 36*a*, the cover 10 maintains the closed state.

By the interrelating mechanism (unshown) in interrelation with the rotation of the cover 10 in the closing direction from the partly-open position to the closed position, the drive outputting portion (unshown) of the main assembly side couples with the drive inputting portion (unshown) of the intermediary transfer member 34. The drive outputting portions (unshown) of the main assembly (100A) side is coupled to the drive inputting portions (unshown) of the photosensitive unit 32 and the cartridge 33. The electrical contacts on main assembly (100A) side connects to the electrical contacts of the photosensitive unit 32 and the cartridge 33. The unit 200 is positioned and maintained at the transfer position A (FIGS. 2A and 2B) by the compressive reaction force of the spring 35 in the state that the frame 31 is locked with the stay 37. While rotating in the closing direction from the partly-open position of the cover 10 to the closed position, the inside member 10*c* of the cover 10 contacts to the top end 41*b* of the pressing rack (third interrelating member) 41 raised by the elastic force of the spring (resilient member) 42. By the continuing rotation of the cover 10 in the closing direction, the rack 41 lowers to the predetermined lower position against the raising force of the spring 42. By this, the cover 10 is maintained in the closed position, by which the cover 10 is maintained in the lower position. In interrelation with the lowering movement of the rack 41, each urging member (positioning member) 40 moves from the retracted position Q2 (FIG. 9) to the positioning place Q1 (FIG. 7). By this, the unit 33*e* of the cartridge 33 is pressed with the predetermined pressure by each urging member 40. Therefore, the cartridge 33 is urged toward the unit 32 to be positioned relative to the unit 32. More particularly, by the positioning of the cartridge 33, the developing roller 33*b* is positioned relative to the drum 32*a*.

By this, the image forming apparatus 100 returns to the state shown in FIG. 6B to enable the image forming operation. Here, in the image forming apparatus 100 described above, each urging member 40 may also have the function as the electrical contact for supplying a bias voltage to the developing roller 33*b*. The gear portion 40*c* may be integral or unintegral with the urging member 40. A combination of the gears may be employed in place of a rack-and-pinion, by which the positioning member is moved between the positioning place and the retracted position. The gear G1 and the gear G5 are integral or unintegral with the cover 10 and the frame 31. The interrelated operation between the cover 10 and the unit 200 may be accomplished by the structure of the combination of the rotation and the linear motion such as the rack-and-pinion. In this embodiment, the exchangeable cartridge is a developing cartridge 33. However, it may be the process cartridge integrally containing the photosensitive unit 32 and the developing cartridge 33.

The structure of the image forming apparatus 100 of the above described Embodiment 1 is summarized as follows. The apparatus is an image forming apparatus 100 for forming a color image on recording material S. The apparatus is provided with two or more cartridge mounting portions 31*c* for mounting the cartridges 33 dismountably. It includes one intermediary transfer member 34 onto which developed images formed on the plurality of electrophotographic photosensitive member drums 32*a* are transferred, the intermediary transfer member being provided opposed to the electrophotographic photosensitive member drums. The apparatus includes two or more mounting portions 31*c* and the unit 200 which is provided with the intermediary transfer member 34. The unit 200 is movable between the transfer position A for transferring the developer image transferred onto the intermediary transfer member 34 from the drums 32*a* onto recording material S, and the mounting and dismounting position B for mounting and demounting the cartridge 33 relative to the mounting portion 31*c*. It further includes an opening portion 100B for permitting the mounting and demounting of the cartridge 33 relative to the mounting portion 31*c* of the unit 200 placed in the mounting and dismounting position B. The apparatus further includes a cover (openable member) 10 capable of opening and closing said opening 100B, the openable member being movable between a closing position for closing the opening and an opening position for opening the opening 100B. It further includes an interrelating member G1-G5 which moves the unit 200 from the image forming position A to the mounting and dismounting position B in interrelation with the cover 10 moving from the closed position to the open position by the manual operation. The interrelating member G1-G5 moves the unit 200 from the mounting and dismounting position B to the image forming position A in interrelation with the cover 10 moving from the open position to the closed position by the manual operation. The unit 200 can take the transfer position A and the mounting and dismounting position B by rotating about the rotation axis 34*a* of the intermediary transfer member 34. In the state that the cartridge 33 is mounted to the mounting portion 31*c*, and the unit 200 is placed in the image forming position A, an electrostatic latent image formed on the drum 32*a* is developed into a developer image with the non-contact developing system. The cartridge 33 includes the developing roller 33*b* for developing an electrostatic latent image formed on the electrophotographic photosensitive member drum 32*a* into a developed image, and wherein developing roller develops the electrostatic latent image with a gap a from the electrophotographic photosensitive member drum The cartridges 33 are developing cartridges mounted opposed to the drums 32, respectively, and are dismountable respectively. This developing cartridge 33 is provided with the developing roller 33*b* for developing, into the developer image, the electrostatic latent image formed on the drum 32*a*, and a developer accommodating portion 33*c* which accommodates the developer to be used for the development by the developing roller. The urging member (positioning member) 40 is movable between the positioning place for positioning the cartridge 33 in predetermined and the retracted position retracted from the positioning place in the state that the unit 200 is placed in the transfer position A. The apparatus is provided with the opening portion 100A for mounting and demounting the cartridge 33 relative to the cartridge mounting portion 31*c* of the unit 200 placed in the mounting and dismounting position B. With the movement of the unit 200 from the transfer position A to the mounting and dismounting position B, the urging member (positioning member) 40 moves from the positioning place Q1 to the retracted position Q2. In the mounting and dismounting position B, the mounting and demounting of the cartridge relative to the mounting portion 31*c* of the unit 200 is permitted. The pressing rack (third interrelating member) 41 moves the urging member 40 from the positioning place to the retracted position in interrelation with the movement of the cover (opening and closing member) 10 by the manual operation to the open position from the closed position. The pressing rack 41 moves the urging (pressing) member 40 from the retracted position to the positioning place in interrelation with the movement of the cover 10 by the manual operation to the closed position from the open position.

As has been described hereinbefore, the gears G1-G5 as the fourth interrelating member move the unit 200 from the transfer position A to the mounting and dismounting position B in interrelation with the movement of the cover 10 from the closing position to the open position. The gears G1-G5 move the unit 200 from the mounting and dismounting position B to the transfer position A in interrelation with the movement of the cover 10 to the closed position from the open position. The apparatus is provided with a locking member (first locking member) for locking the unit 200 to the transfer position A. As has been described hereinbefore, in this embodiment, the apparatus includes, as the locking member, the cover 10, the locking claw portion 10*b*, the spring 35, and the main stay 37 (FIG. 2B). As has been described hereinbefore, the locking member locks the unit 200 to the transfer position A in the state that the cover 10 is in the closed position. The locking member releases the lock of the unit 200 in the state that the cover 10 is moved from the closed position to the open position. According to this embodiment, the unit 200 can be positioned in the main assembly 100A with high precision. In addition, the releasing of the positioning is easy. In this embodiment, the cartridge 33 is a developing cartridge which is dismountably mountable opposed to one of the drums 32*a* provided in the unit 200*s*. The developing cartridge 33 is provided with the developing roller 33*b* for developing, into the developer image, the electrostatic latent image formed on the drum 32*a*, and the developer accommodating portion 33*c* for accommodating the developer to be used for the development of the electrostatic latent image by the developing roller.

In this embodiment, the urging member (positioning member) 40 (40Y, M, C, K) is movable between the positioning place Q1 (FIG. 7) for positioning the cartridge 33 at the predetermined position in the state that the unit 200 is placed in the transfer position A. The urging member 40 is movable between the retracted position Q2 (FIG. 9) retracted from the positioning place Q1 in the state that the unit 200 is placed in the transfer position A. The urging member 40 placed in the positioning place Q1 urges the trailing end of the cartridge 33 frontwardly. The apparatus is provided with the opening portion 100A for mounting and demounting the cartridge 33 relative to the cartridge mounting portion 31*c* of the cartridge 33 or the image forming unit 200 placed in the mounting and dismounting position B. With the movement of the image forming unit 200 to the mounting and dismounting position B from the transfer position A, the positioning member 40 moves from the positioning place Q1 to the retracted position Q2 to enable the mounting and demounting of the cartridge relative to the mounting portion 31*c* in the mounting and dismounting position B.

Embodiment 2

Figure 14A:
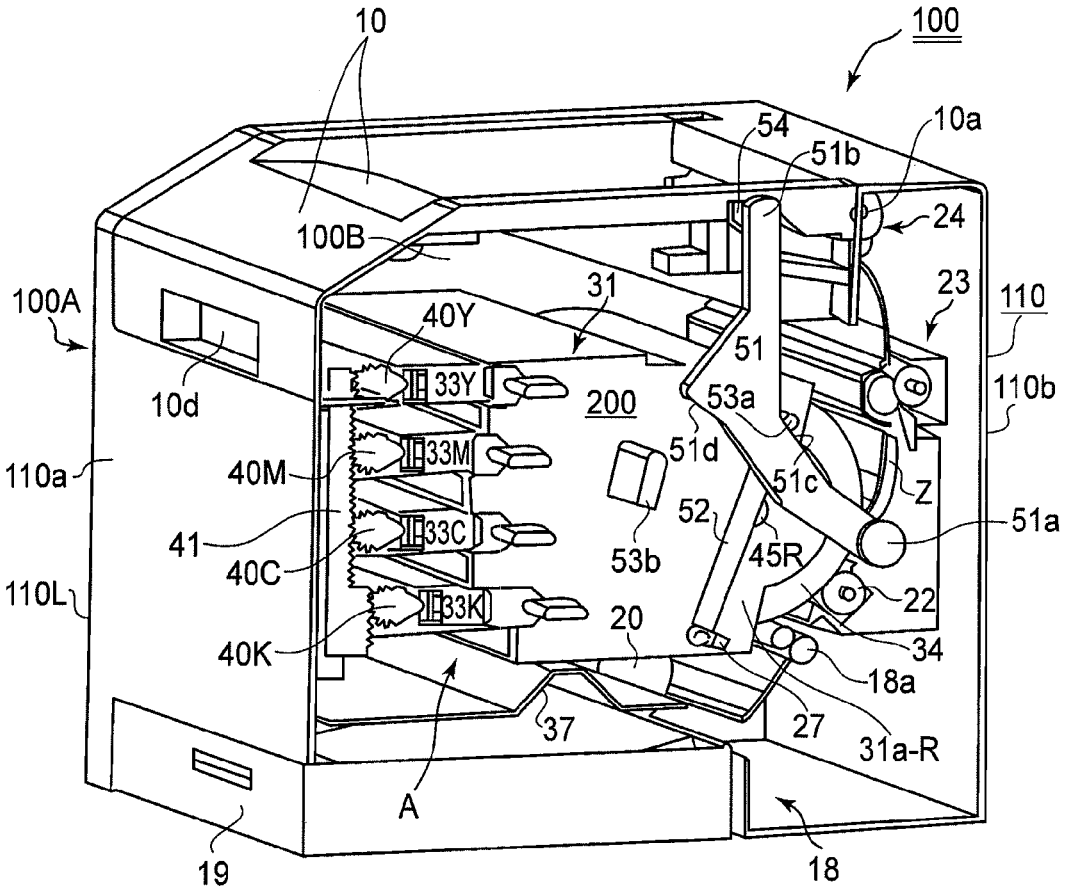
FIG. 14A is a schematic right-side sectional perspective view of an image forming apparatus according to Embodiment 2.
Figure 14B:
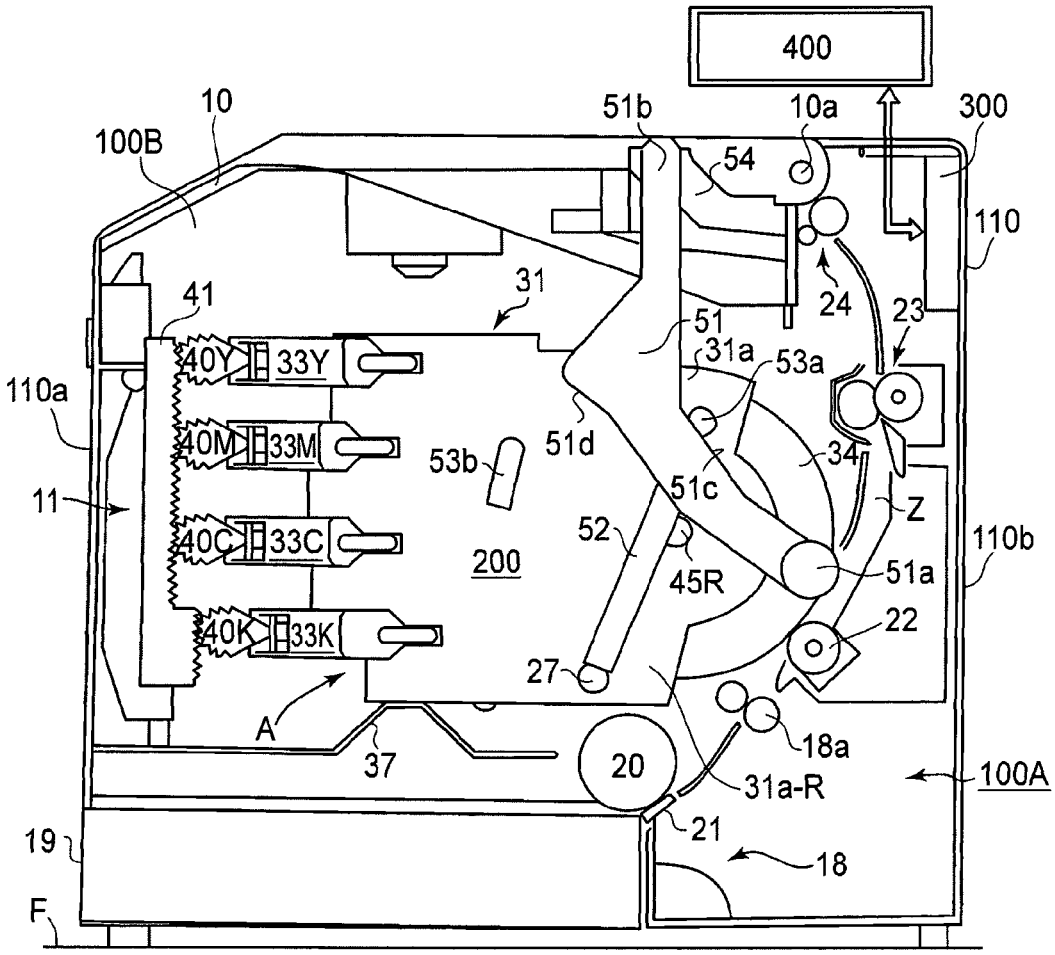
FIG. 14B is a schematic right sectional view of the image forming apparatus according to Embodiment 2.
Figure 15:
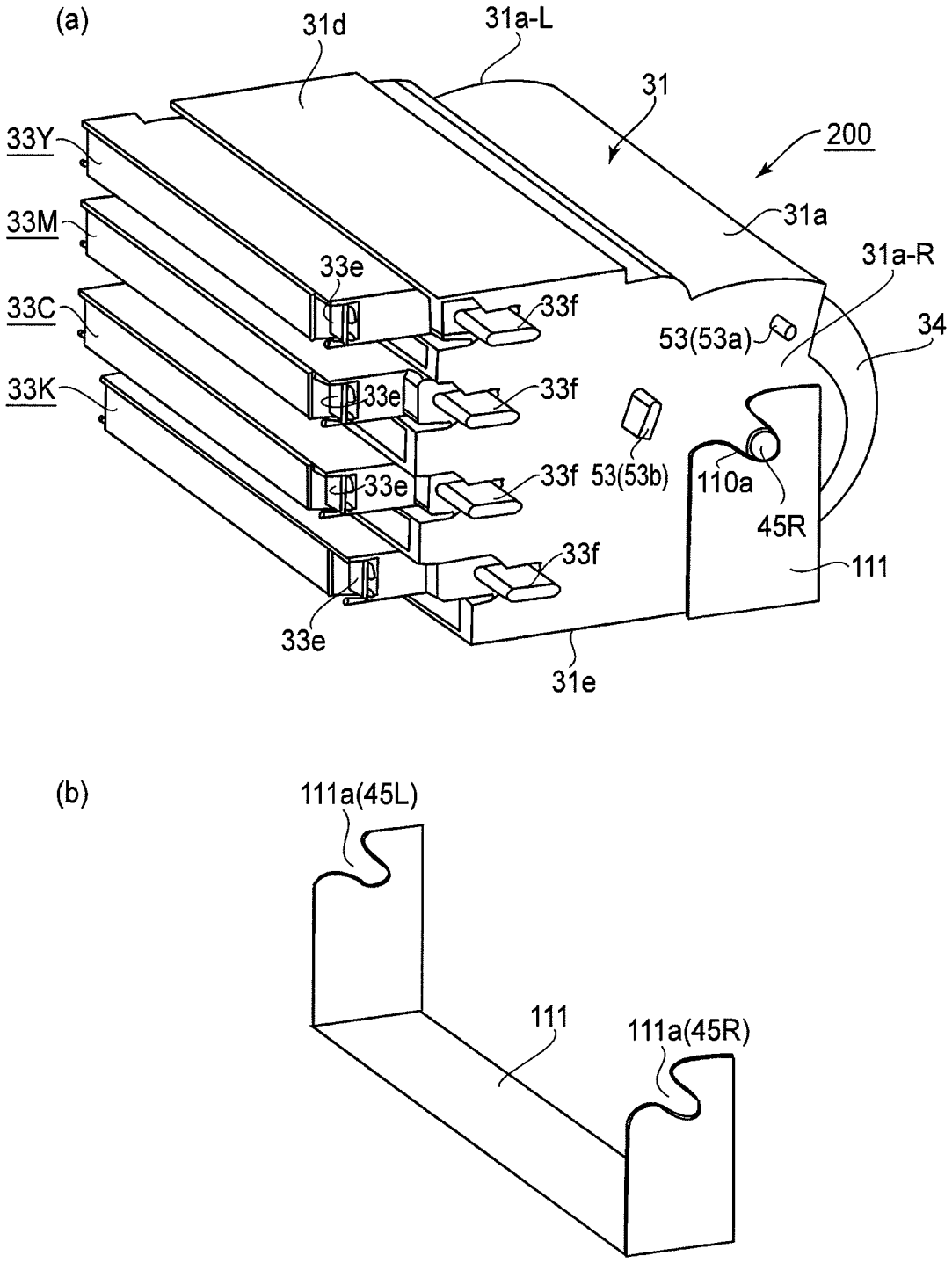
FIG. 15 is an illustration of a supporting member for the image forming unit.

FIG. 14A-FIG. 18B are perspective views of the image forming apparatus 100 according to Embodiment 2. In Embodiment 2, the interrelating member for interrelation between the cover 10 and the unit 200 is a toggle mechanism in place of the gears G1-G5 of the image forming apparatus 100 of Embodiment 1. In the description of this embodiment, the same reference numerals as in Embodiment 1 are assigned to the elements having the corresponding functions in this embodiment, and the detailed description thereof is omitted for simplicity FIG. 14A and FIG. 14B are a right sectional perspective view and a right sectional view of the image forming apparatus 100, respectively, in which the cover 10 closes the opening portion 100B, and the image formation is possible. (a) of FIG. 15 is an outer appearance perspective view of the unit 200 portion.

As shown in (a) of FIG. 15, the shaft portions 45L, 45R of the unit 200 are supported rotatably by the left and right bearing portions 111*a* of a supporting member 111 disposed fixedly in the main assembly 100A. (b) of FIG. 15 is an outer appearance perspective view of the supporting member 111. A toggle lever 51 is rotatably pivoted at a bottom end 51*a* on the inside of the right-hand side frame 110R (unshown) of the main assembly 100A A top end 51*b* of a lever 51 is movably engaged with an engagement groove 54 provided in the right side of the cover 10. By this, the lever 51 is clockwisely rotatable about a pivot portion of the bottom end 51*a* in interrelation with the rotation of the open direction of the cover 10 (FIG. 14A and FIG. 14B). The lever 51 is counterclockwisely rotatable about the pivot portion of the bottom end 51*a* in interrelation with the rotation of the closing direction of the cover 10. In the frame 31, the outer side of the right side plate 31*a*-R of the intermediary transfer frame 31*a* is provided with the projections 53 (first projection 53*a* and second projection 53*b*) ((a) of FIG. 15, (b) of FIG. 16). The first and second projections 53*a*, 53*b* are in a rear position and a front position interposing the lever 51, respectively. A toggle spring (resilient member) 52 is stretched between the first projection 53*a* and the projection 27 provided inside of the right-hand side frame 110R. In the image forming apparatus 100, in the state that the cover 10 closes the opening portion 100B (FIG. 14A and FIG. 14B), a spring 52 is placed in front of the position (dead point) of a shaft portion 45R of the unit 200. For this reason, to the unit 200, a counterclockwise rotation force is applied to the shaft portions 45L, 45R by a pulling force of the spring 52 (FIG. 14A and FIG. 14B). By the rotation force of the unit 200, a lower surface of the frame 31 is pressed and positioned to the stay 37. By this, the unit 200 is stably held in the transfer position A. Similarly to the case of the image forming apparatus 100 of Embodiment 1, the rack 41 descends to the predetermined position against the raising force of the spring 42 by the contact to the inside member 10*c* of the cover 10 closed, and is maintained at the position. By this, the cartridge 33 mounted to the unit 200 placed in the transfer position A is pressed by the urging member (positioning member) 40 which is in the positioning place. More particularly, the cartridge 33 is urged toward the photosensitive unit 32 to be positioned relative to the photosensitive unit 32.

Figure 16:
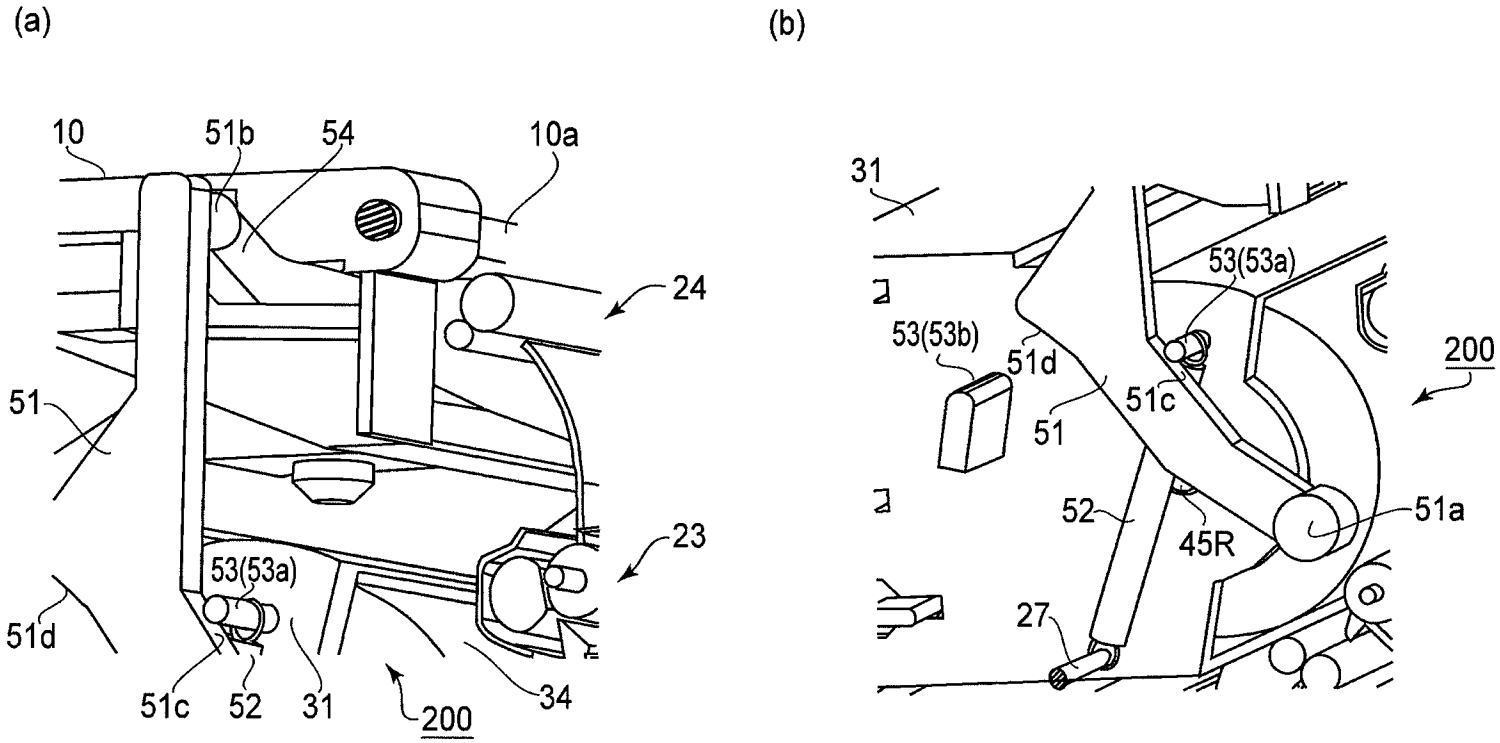
In FIG. 16, (*a*) is an illustration (1) of the operation of a toggle lever, and (*b*) is an illustration (2) of an operation of the toggle lever.
Figure 17:
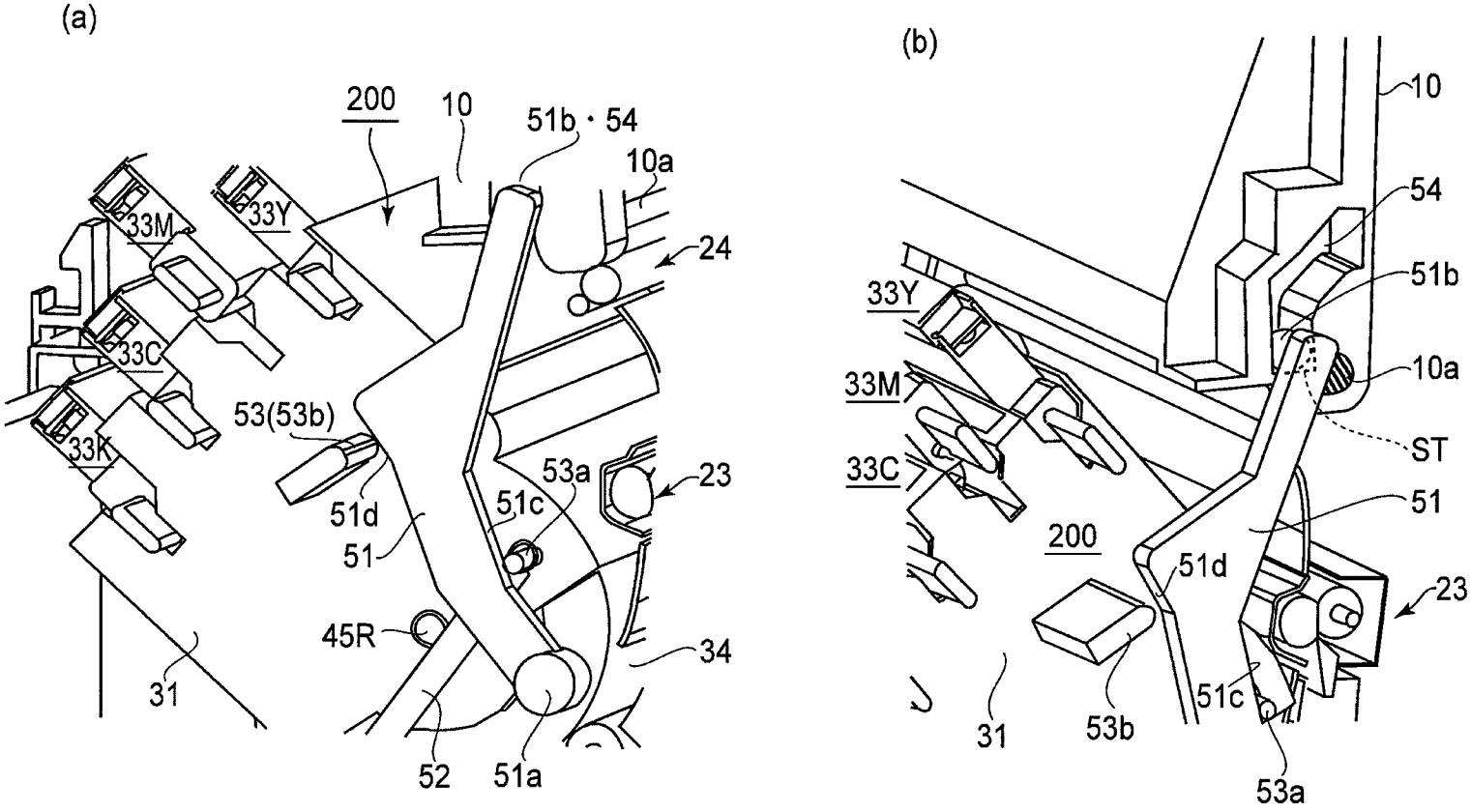
In FIG. 17, (*a*) is an illustration (3) of the operation of the toggle lever, and (*b*) is illustration (4) of the operation of the toggle lever.

In an initial stage of the rotation of the cover 10 in the open direction, the confinement of the top end 41*b* of the rack 41 by the inside member 10*c* is released. By this, the rack 41 rises so that the urging member 40 moves from the positioning place to the retracted position. By this, the positioning by the urging member 40 of the cartridge 33 mounted to the unit 200 placed to the transfer position A is released. In interrelation with the further rotation of the cover 10 in the open direction, in the portions 54, 51*b* ((a) of FIG. 16), the lever 51 connected with the cover 10 rotates clockwisely about the pivot portion of the bottom end 51*a* (FIG. 14B and FIG. 14A). By the rotation of the lever 51, the contact surface 51*c* of the lever 51 contacts to the first projection 53*a* of the frame 31. (b) of FIG. 16 is an enlarged perspective view illustrating the neighborhood of the lever 51 immediately after beginning to open the cover 10.

Figure 18A:
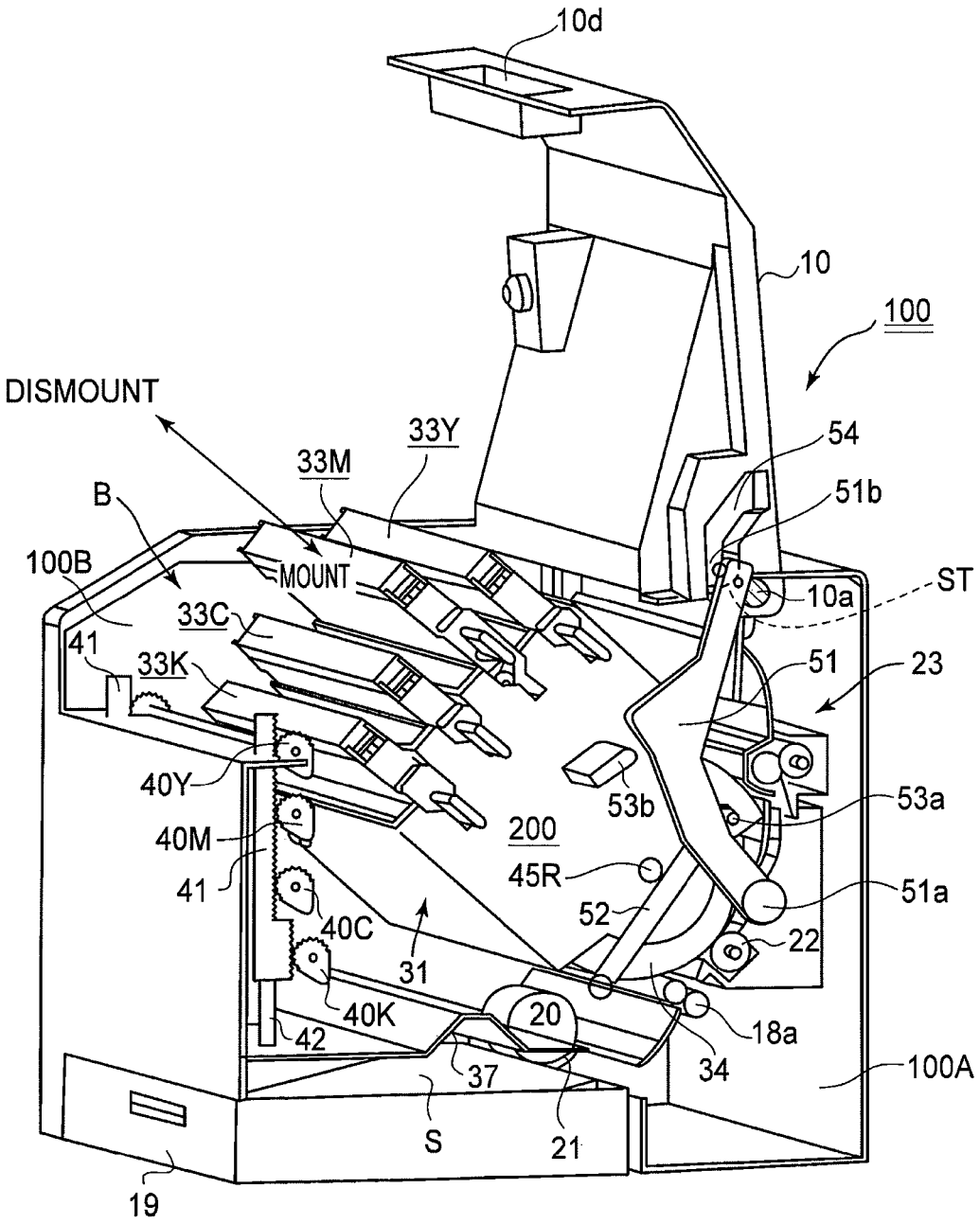
FIG. 18A illustrates the image forming apparatus (1), wherein the cover is opened to the open position, and the image forming unit is in the mounting and dismounting position.
Figure 18B:
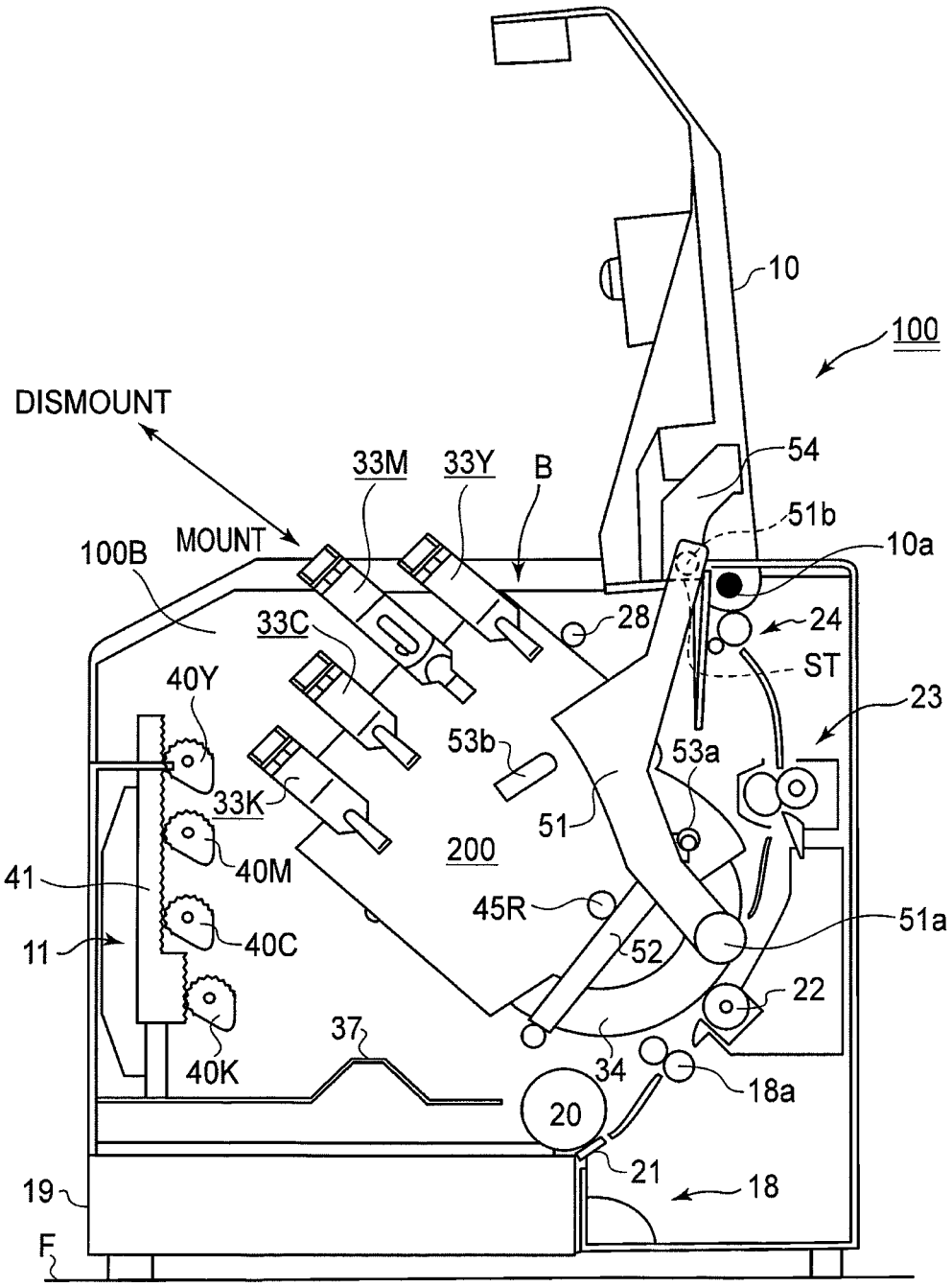
FIG. 18B illustrates the image forming apparatus (2) wherein the cover is opened to the open position, and the image forming unit is in the mounting and dismounting position.
Figure 19A:
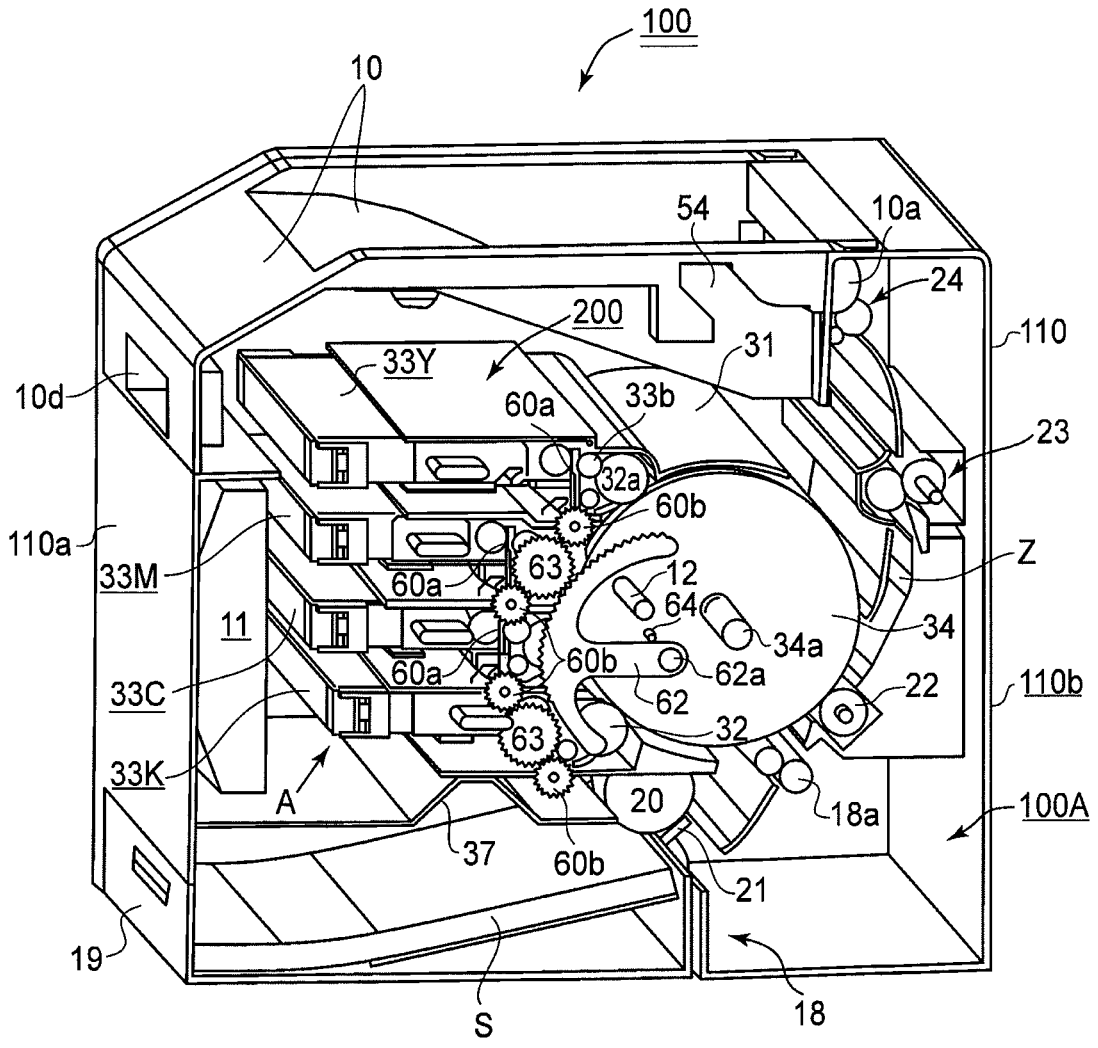
FIG. 19A is a schematic right-side sectional perspective view of the image forming apparatus according to Embodiment 3.
Figure 19B:
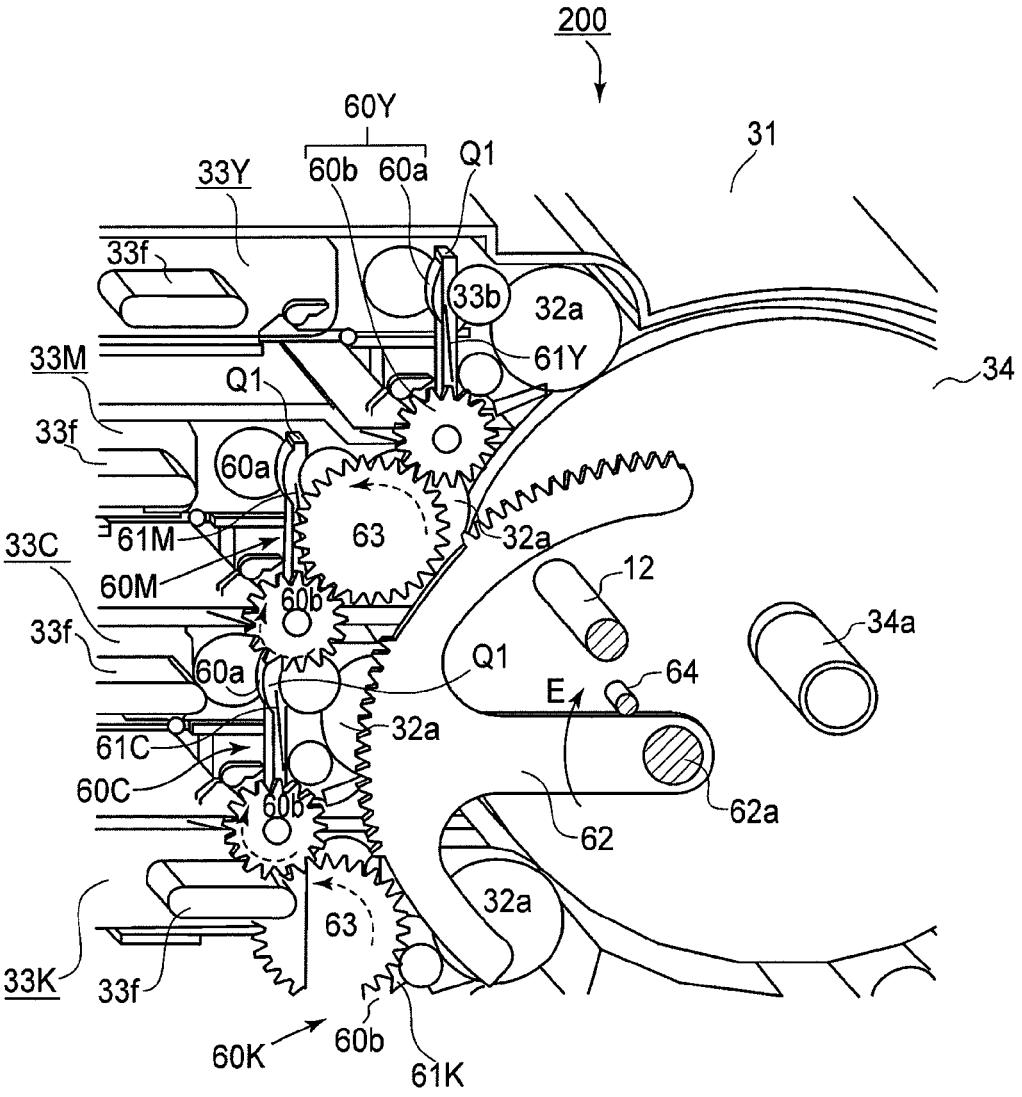
FIG. 19B is a partial enlarged perspective view of FIG. 19A.

After the contact between the contact surface 51*c* and the projection 53*a*, the user rotates the cover 10 in the open direction against the pulling force of the toggle spring (resilient member) 52 while expanding the spring 52. By this rotation, the projection 53*a* is pushed rearwardly by the contact surface 51*c* so that the unit 200 placed in the transfer position A rotates in the clockwise direction about the shaft portions 45L, 45R (FIG. 14B). Further, the opening motion of the cover 10 is continued. Then, as shown in (a) of FIG. 17, the projection 53*b* moves rearwardly beyond the dead point (position of shaft portion 45R). By this, a clockwise rotation force is applied to the unit 200 by the pulling force of the spring 52 about the shaft portions 45L, 45R (FIG. 14A and FIG. 14B). By this rotation force, the unit 200 rotates in the clockwise direction until it abuts to a stopper portion ST ((b) of FIG. 17, and FIG. 18A and FIG. 18B) provided in the main assembly side. By this, the unit 200 is clockwisely rotated by substantially 45 degrees from the transfer position A (FIG. 14A and FIG. 14B). As shown in FIG. 18A and FIG. 18B, the cartridge 33 moves to the position faced to the opening portion 100B and is maintained in the position thereof. More particularly, the unit 200 moves to the mounting and dismounting position B for mounting and demounting the cartridge 33 relative to the mounting portion 31*c*. The user further rotates the cover 10 to the open position ((b) of FIG. 17). By this, the opening portion 100B is widely opened. By this, the dismounting of the cartridge 33 through the opening portion 100B is enabled (FIG. 18A and FIG. 18B).

With the structure of the above described image forming apparatus, the exchange of the cartridge 33 is possible, without retracting a scanner unit (image exposure device) 11. Therefore, the user can exchange the cartridge 33 easily.

The process will be described in which the unit 200 is again moved to the transfer position A after the unit 200 is placed in the mounting and dismounting position B, and the cartridge 33 is exchanged. As shown in FIG. 18A and FIG. 18B, the cartridge 33 is inserted into the mounting portion 31*c* of the unit 200 placed in the mounting and dismounting position B. Then, the cartridge 33 is temporarily held in the mounting portion 31*c* by the engagement between the resilient member c (FIG. 2B) provided in the mounting portion 31*c* and the projecting member d of the cartridge 33. The user exchanges the necessary cartridge 33, and thereafter, the user rotates the cover 10 held in the open position in the closing direction. The lever 51 rotates counter-clockwisely in interrelation with the rotation of the cover 10 toward the closing direction. By this, the contact surface 51*d* provided on the lever 51 contacts to the second projection 53*b* provided on the frame 31. After this contact, the user rotates the cover 10 in the closing direction against the pulling force of the spring 52 while extending the spring 52. By this rotation, the contact surface 51*d* of the lever 51 pushes the projection 53*b* frontwardly, so that the unit 200 placed in the mounting and dismounting position B rotates in the counterclockwise direction about the shaft portions 45L, 45R. Furthermore, with continuation of the closing operation of the cover 10, the projection 53*b* moves rearwardly beyond the dead point (position of the shaft portion 45R). Then, the rotation force is applied to the unit 200 counter-clockwisely about the shaft portions 45L, 45R by the pulling force of the spring 52. By this rotation force, the unit 200 rotates in the counterclockwise direction until it is abutted to the stay 37. By this, the unit 200 is rotated by substantially 45 degrees counter-clockwisely from the mounting and dismounting position B (FIG. 18A and FIG. 18B) to move to the transfer position A.

The inside member 10*c* of the cover 10 contacts to the top end 41*b* of the rack 41 placed in the upper position by the spring 42. The rack 41 lowers to a predetermined lower position against the raising force of the spring 42 by the continuing rotation of the cover 10 in the closing direction. By the cover 10 closing, the rack 41 is maintained in the lower position. For the cartridge 33 mounted to the unit 200 placed to the transfer position A, each urging member 40 moves from the retracted position (FIG. 18A and FIG. 18B) to the positioning place (FIG. 14A and FIG. 14B) in interrelation with the lowering movement of the rack 41. By this, by each urging member 40, the unit 33*e* is pressed with the predetermined pressure, so that the cartridge 33 is urged toward the photosensitive unit 32 to be positioned relative to the unit 32. More particularly, the developing roller 33*b* is positioned relative to the drum 32*a* for which the cartridge 33 is positioned. In the manner described in the foregoing, the image forming apparatus 100 returns into the state shown in FIG. 14A and FIG. 14B to enable the image forming operation.

With the structure of such a image forming apparatus, the exchange of the cartridge 33 is possible without retracting the scanner unit 11. Therefore, the user can exchange the cartridge 33 easily. The fundamental apparatus structure of the image forming apparatus 100 of Embodiment 2 is the same as the those of the image forming apparatus 100 of Embodiment 1. In this embodiment, a toggle mechanism 51-54 corresponds to the interrelating member. The rack 41 corresponds to the third interrelating member. The toggle mechanism 51-54 corresponds to the fourth interrelating member. The frame 31, the stay 37, and the toggle mechanism 51-54 correspond to the locking member.

Embodiment 3

FIG. 19A-FIG. 23 illustrate the image forming apparatus 100 of Embodiment 3. The Embodiment 3 uses the toggle mechanism as the interrelating member between the cover 10 and the unit 200 similarly to Embodiment 2. Embodiment 3 is different in the positioning member for the cartridge 33. In the description of this embodiment, the same reference numerals as in Embodiment 2 are assigned to the elements having the corresponding functions in this embodiment, and the detailed description thereof is omitted for simplicity. In this embodiment, in order to press the cartridge 33, with the predetermined pressure, to the photosensitive unit 32, the sub-frame 31 of the unit 200 is provided with the following structure. The description will be made mainly referring to FIG. 19B. The device of this embodiment is provided with a pressing portion 60*a* and a pressing lever (positioning members) 60 (60Y, 60M, 60C, 60K) which is provided with a gear configuration portion (pressing lever gear portion) 60*b* for releasing the pressure. Furthermore, it is provided with an urging spring (resilient members) 61 (61Y, 61M, 61C, 61K) for normally urging the pressing lever 60 clockwisely. In addition, it is provided with a spacing gear 62 rotatable about a rotation axis 62*a* and a gear 63 for transmitting a driving force between a lever gear portion 60*b* and spacing gear 62.

A gear 62 is normally urged in the direction (clockwise) indicated by an arrow E (FIG. 19B) by the urging member (unshown), and during the image formation, the rotation thereof is regulated by contacting to a positioning boss 64 provided inside of the frame 31. At this time, the driving force is not transmitted to the gear portion 60*b* and the gear 62. For this reason, a roller shaft 33*b*-1 ((a) of FIG. 5) of the developing roller 33*b* is pressed by a lever 60 which is in the positioning place by the elastic force of the urging spring (resilient member) 61. By this, a shaft 33*b*-1 is abutted to a positioning portion 39 ((a) of FIG. 5) provided in the photosensitive unit 32. By this, the developing roller 33*b* is assuredly positioned relative to the drum 32*a* ((a) of FIG. 3). The gear portion 60*b* is integral or unintegral with the pressing portion 60*a*.

Figure 20A:
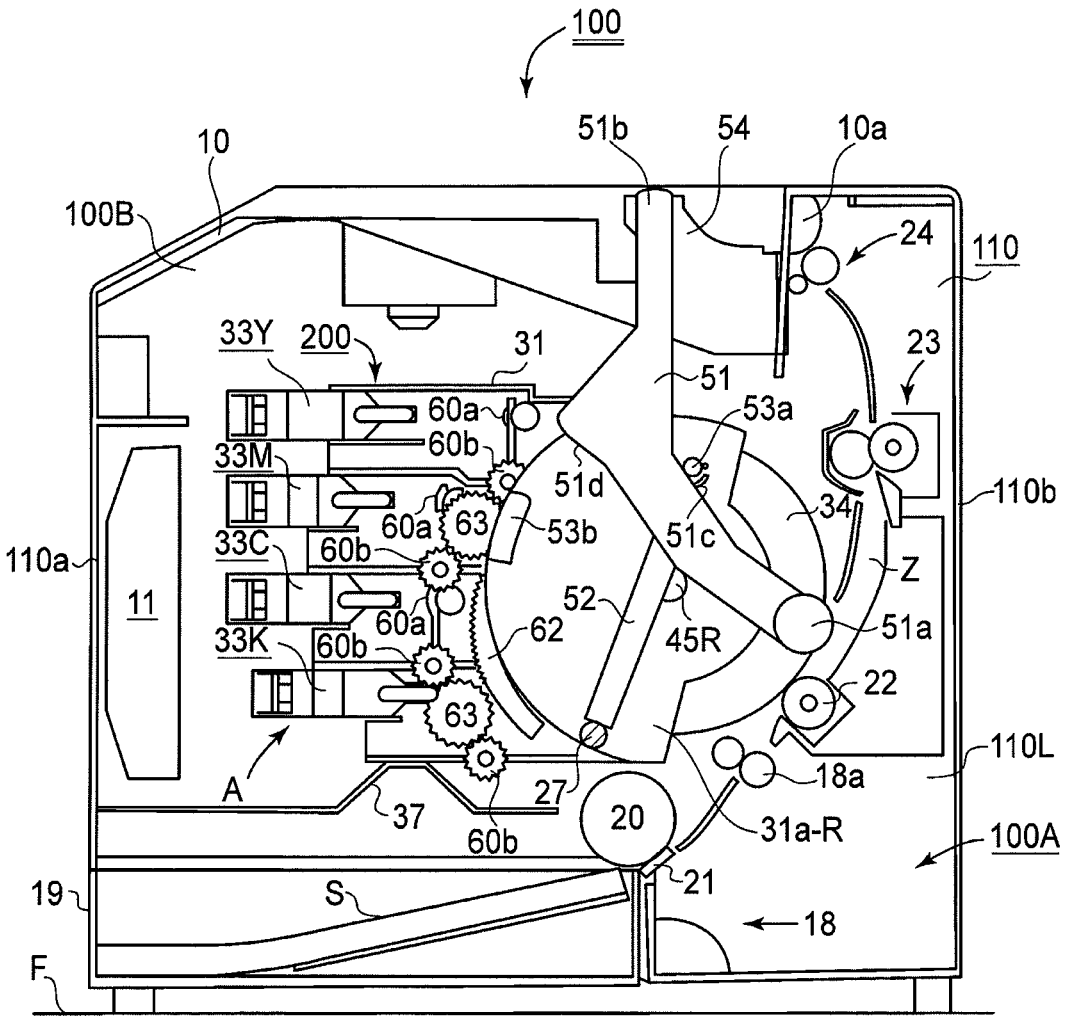
FIG. 20A is a schematic right side longitudinal sectional view of an image forming apparatus according to Embodiment 3.
Figure 20B:
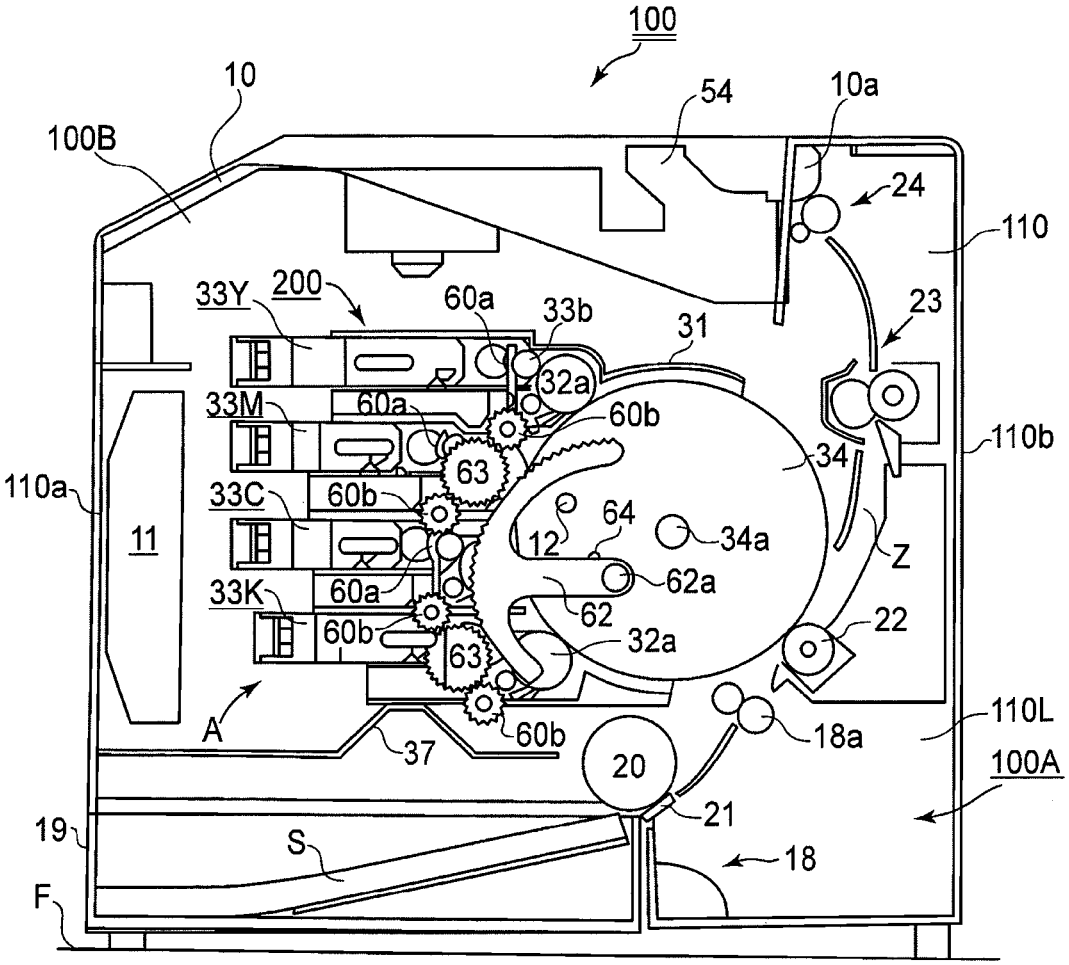
FIG. 20B is a schematic right side longitudinal sectional view of the image forming apparatus according to Embodiment 3.
Figure 21A:
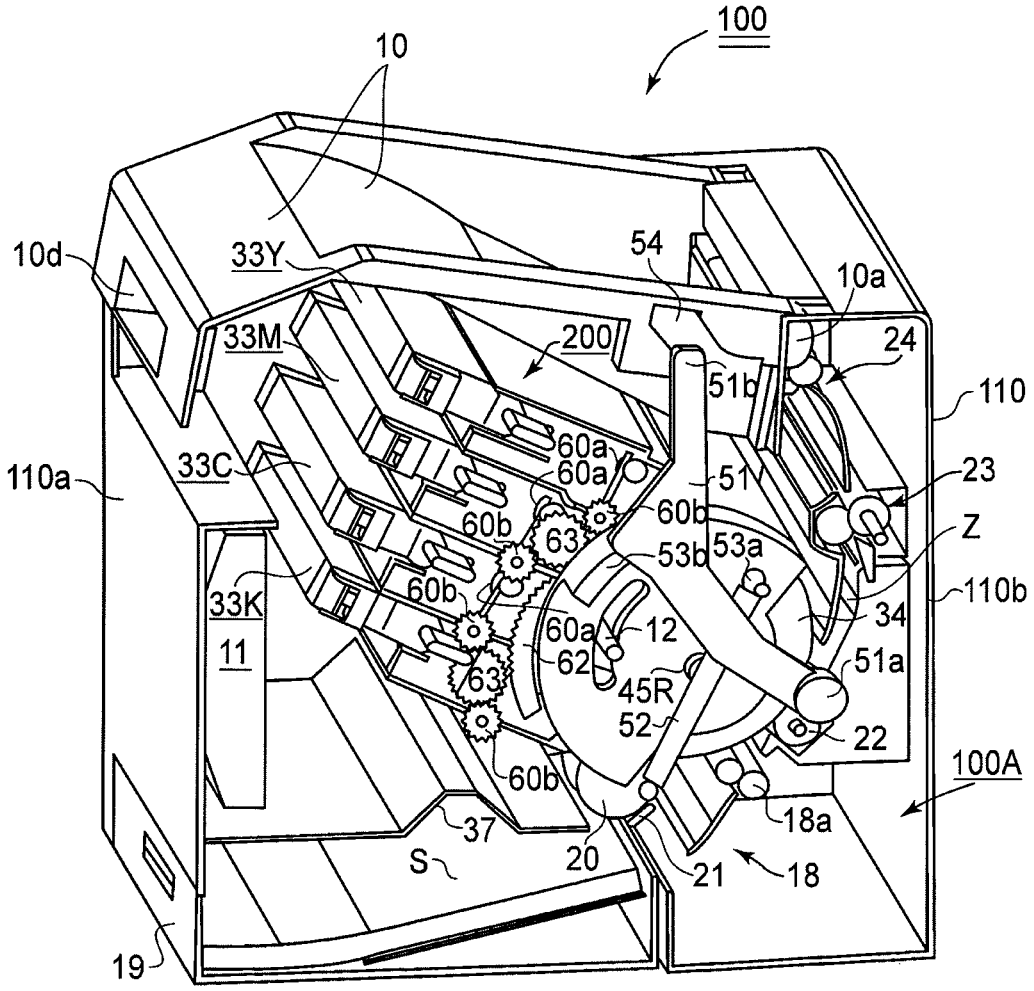
FIG. 21A illustrates the image forming apparatus (1), wherein the cover is partially open.
Figure 21B:
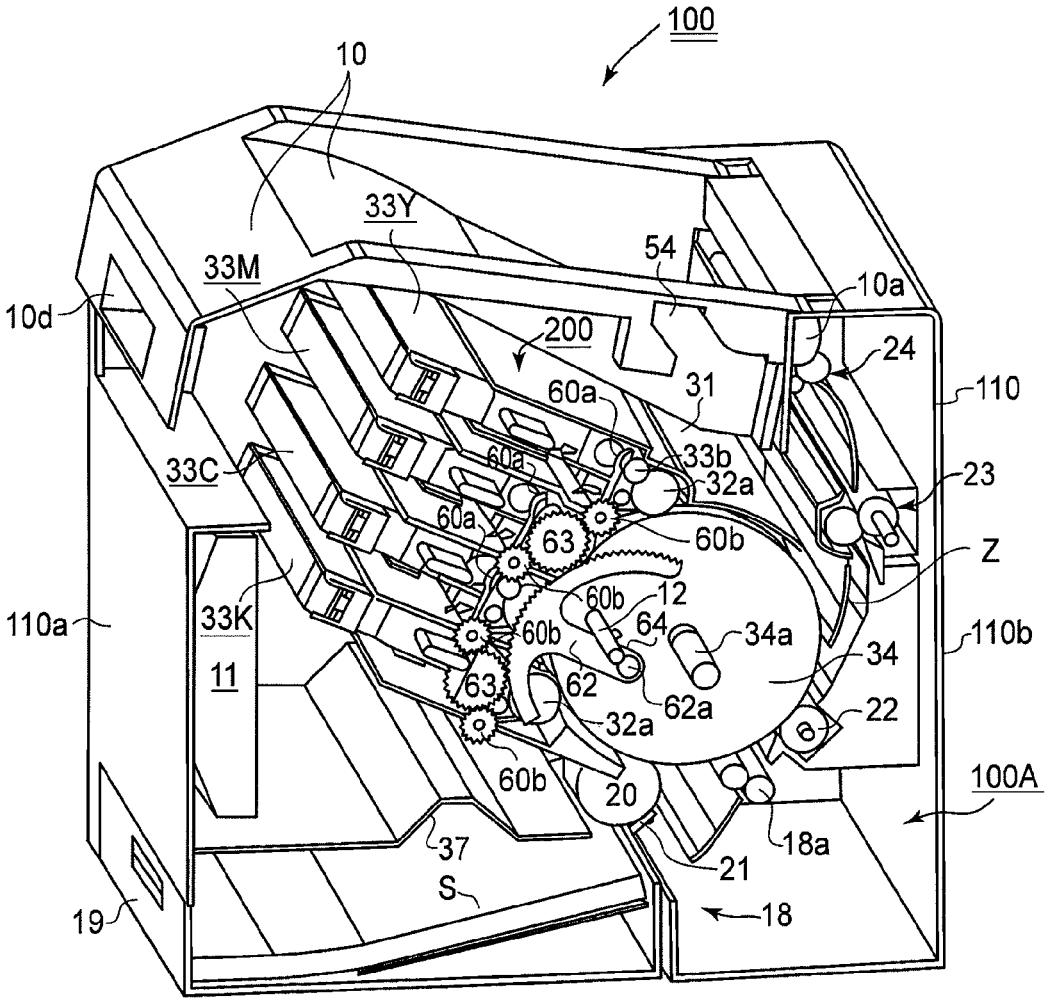
FIG. 21B illustrates the image forming apparatus (2), wherein the cover is partially open.

In FIGS. 19 and 20, the cover 10 closes the main assembly 100A. Similarly to the case of Embodiment 2, when the user opens the cover 10, the toggle lever (second interrelating member) 51 is interrelatedly rotated in a clockwise direction, so that a lever contact surface 51*c* contacts to the projection 53*a* of the frame 31. By this, the unit 200 begins to rotate in the clockwise direction. Furthermore, with the continuing opening motion of the cover 10, a spring hooking portion 53*a* functioning also as the projection of the frame 31 is also rotated, so that the urging direction of the unit 200 by the elastic force of the toggle spring (resilient member) 52 changes from the counterclockwise direction to the clockwise direction. By this, the unit 200 is moved to the mounting and dismounting position B (FIG. 21A and FIG. 21B). Here, the movement to the mounting and dismounting position B of the unit 200 by the toggle mechanism in interrelation with the opening motion of the cover 10 is substantially the same as those of Embodiment 2.

Here, it is desirable that an urging spring force (elastic force) for moving the unit 200 to the mounting and dismounting position B clockwisely is set such that the mounting of an empty cartridge 33 will establish the balance at the mounting and dismounting position B. As shown in FIG. 21B, in this case, the unit 200 rises. Here, the lever 60 maintains the state of pressing the developing roller 33*b*. When an attempt is made to move the unit 200 to the separating operation position of the lever 60 only by the urging force (elastic force) of a toggle spring 52, the urging force of the spring 52 is large. The weight of the cartridge 33 changes depending on the amount of the accommodated developer, and therefore, if the urging force is so large as to be capable of driving the lever 60 when the developer amount is full, the rotation of the unit 200 may be too vigorous when the amount of the developer is zero. For this reason, the urging spring force (elastic force) of the degree which balances with the empty cartridge 33 is selected, the rotation to the open direction of the cover 10 beyond it, is carried out by the user. By this, the operating force required to the user is small, and the vigorousness in the releasing of the cover 10 can be suppressed.

Figure 22A:
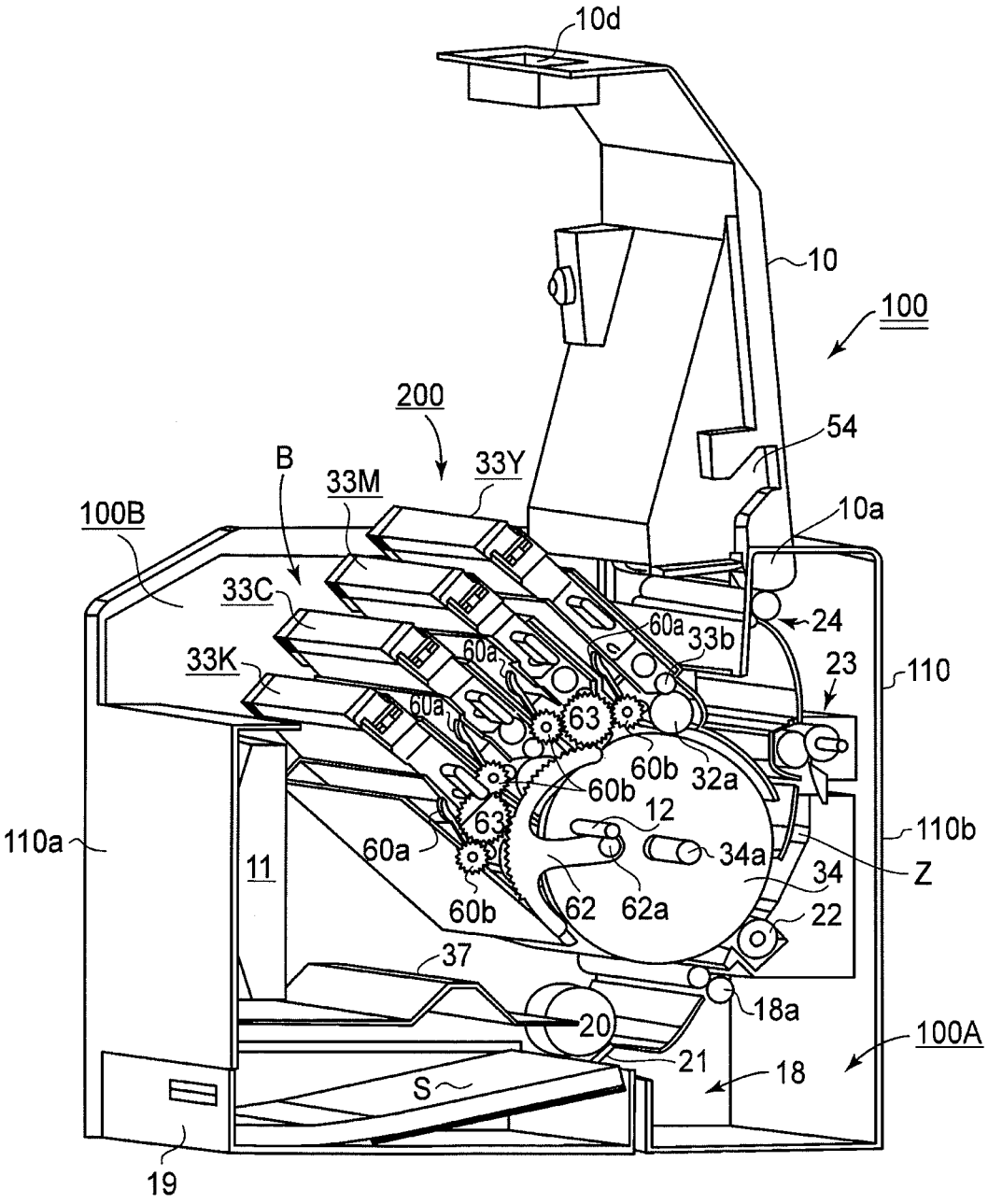
FIG. 22A illustrates the image forming apparatus, wherein the cover is opened to the open position and the image forming unit is in the mounting and dismounting position.
Figure 22B:
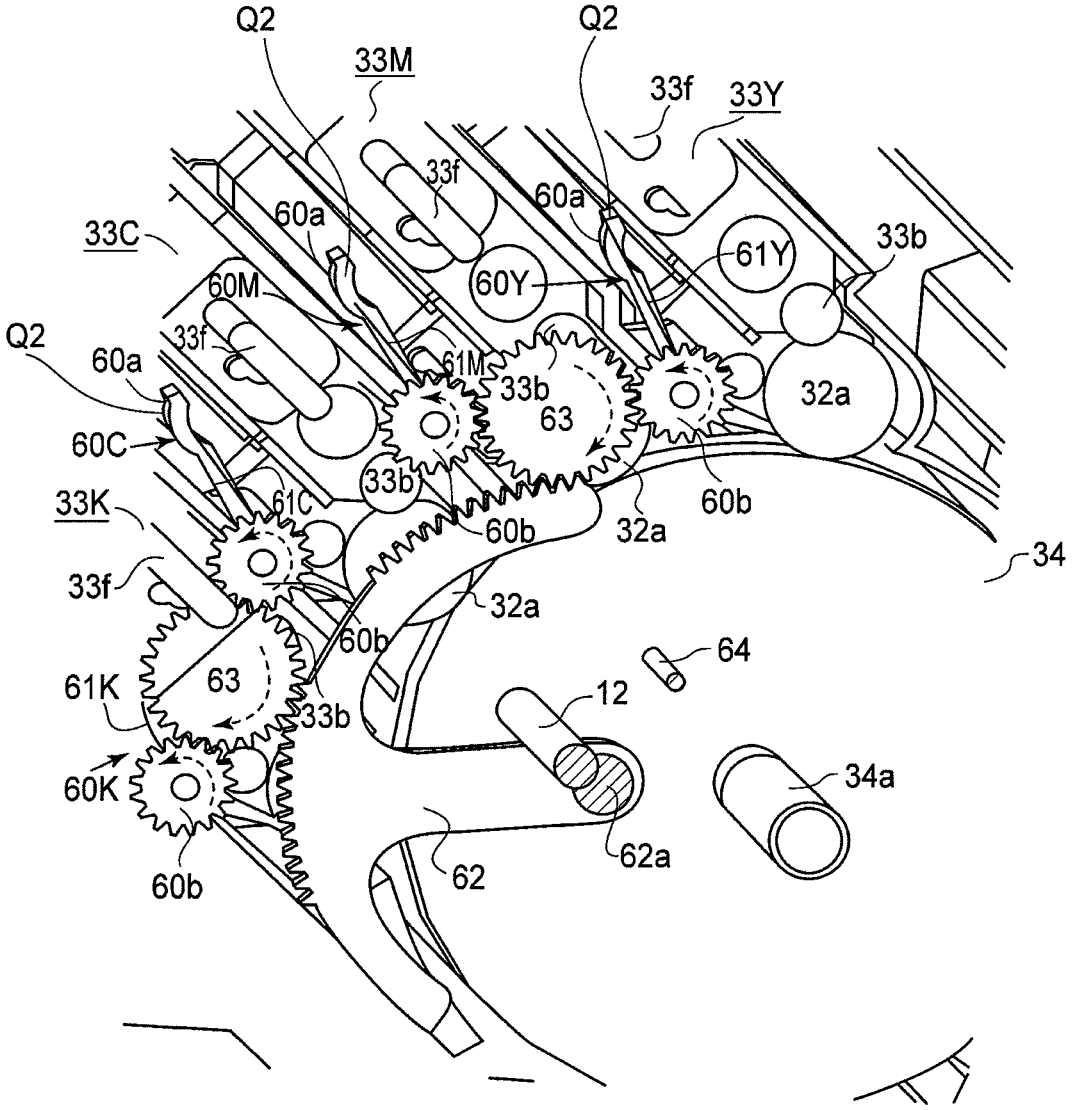
FIG. 22B is a partial enlarged perspective view of FIG. 21B.
Figure 23:
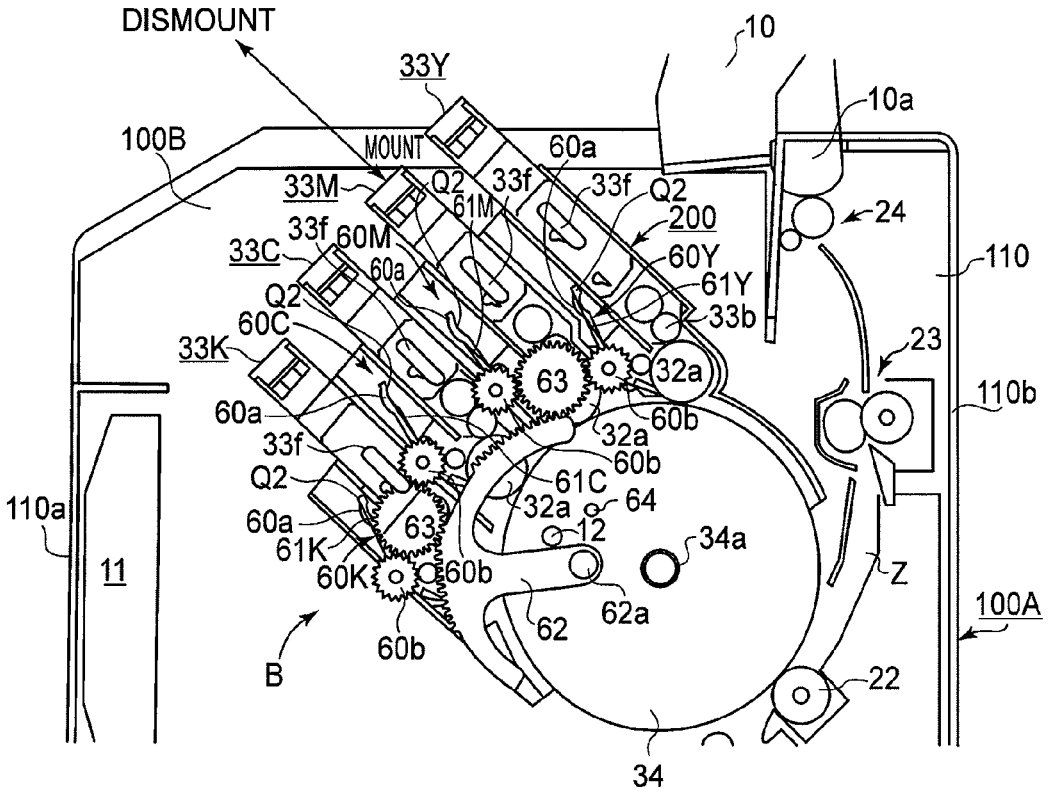
FIG. 23 is a partial sectional view of the image forming apparatus, wherein the image forming unit is in the mounting and dismounting position.

As shown in FIGS. 2A and 2B, the user opens the cover 10 which balances with the urging force (elastic force) of the spring 52 in the partly open state to a predetermined open position upwardly as shown in FIG. 22A. Then, the unit 200 is rotated in the clockwise direction, and the cartridge 33 rotates to the mounting and dismounting position B. FIG. 22B is a sectional view illustrating the state of the levers 60 (60Y, 60M, 60C, 60K) in the case where the unit 200 is in the mounting and dismounting position B. FIG. 23 is a sectional view of the image forming apparatus in the state that the unit 200 is placed in the mounting and dismounting position B.

When the unit 200 rotates in the open direction to some extent, the spacing gear 62 which has a rotation axis 62*a* supported on the frame 31 contacts to a pin 12 which is provided on the main assembly (100A) side. As shown in FIG. 22B, after the gear 62 contacts to the pin 12, the unit 200 further rotates clockwisely. By this, the gear 62 rotated in the direction of E (FIG. 19B) by the urging member (unshown) starts counter-clockwise rotation relative to the frame 31 about the rotation axis 62*a* against the clockwise urging force (elastic force) by the urging member (resilient member). The drive engagement between the gear 62 and the gear 60*b* is established, and each pressing lever 60 rotates in the counter-clockwise direction about the gear 60*b* against the elastic force of each urging spring (resilient member) 61. By this, the pressing portion 60*a* simultaneously spaces from all the cartridges 33 (FIG. 22B, and FIG. 23). More particularly, the lever 60 (60Y, 60M, 60C, 60K) as the positioning member moves to the retracted position from the positioning place which positions the cartridge 33 in predetermined location to release the positioning of each cartridge 33. In this manner, the lever 60 is in the retracted position Q2 in the state that the unit 200 rises. Furthermore, the lever 60 is moved to the positioning place Q1 in the process in which the unit 200 moves to the transfer position A. When the locking by the locking member (cover 10, cover side locking claw portion 10*b*, spring 35, and main stay 37) locked to the transfer position A is released, the unit 200 rises by the elastic force and is placed in the mounting and dismounting position B.

By the above described structure, the exchange of the developing cartridge 33 is possible without retracting the scanner unit 11. Therefore, the user can replace the cartridge 33 easily.

After the user replace the cartridge 33, the process in which the cartridge 33 is moved to the transfer position A (image forming position) will be described. When the cartridge 33 is mounted to the unit 200, the cartridge 33 is temporarily held by the coupling unit 31*c* provided on the frame 31. When the user closes the cover 10 after the exchange of the cartridge 33, the toggle lever (second interrelating member) 51 is rotated counter-clockwisely in interrelation with the closing operation of the cover 10. The contact surface 51*d* provided on the lever 51 contacts to the projection 53*b* provided on the frame 31. By this, the unit 200 rotates counter-clockwisely.

The gear 62 is normally clockwisely urged relative to the unit 200. When the gear 62 is spaced from a lever 12, the driving force transmission is disconnected between the gear 62 and the gear portion 60*b*. For this reason, the lever 60 is moved from the retracted position (FIGS. 22A and 22B) to the positioning place (FIGS. 19A and 19B) by the urging force (elastic force) of the urging spring (resilient member) 61. The lever 60 is contacted to the cartridge 33. By this, the developing roller 33*b* is pressed and positioned with the predetermined pressure against the photosensitive unit 32. More particularly, the positioning of the developing roller 33*b* relative to the drum 32*a* can be released in interrelation with the movement of the unit 200 to the mounting and dismounting position B from the transfer position A. The developing roller 33*b* can be positioned relative to the drum 32*a* in interrelation with the movement of the unit 200 from the mounting and dismounting position B to the transfer position A. Here, the lever 60 may have the function of the electrical contact for the cartridge 33.

When the closing operation of the cover 10 is continued, the urging direction of the unit 200 by the elastic force of the toggle spring (resilient member) 52 changes to the counter-clockwise direction from the clockwise direction. By this, until the unit 200 abuts to the main stay 37, it rotates counter-clockwisely to be positioned in the transfer position A.

The fundamental apparatus structure of Embodiment 3 is the same as those of Embodiment 1. In this embodiment, the toggle mechanisms 51-54 correspond to the interrelating member. In Embodiments 1-3, a maintenance gear train G1-G5 is employed. The toggle mechanism comprises a toggle lever 51, a toggle spring (resilient member) 52, a projection 53 (first projection 53*a* and second projection 53*b*), and an engagement groove 54. Here, the maintenance gear train G1-G5 and the toggle mechanism (lever 51, spring 52, projection 53, and groove 54) correspond to the interrelating member. The interrelating members G1-G5, 51-54 move the unit (200) from the image forming position A to the mounting and dismounting position B in interrelation with the movement of the cover 10 to the open position from the closed position by the manual operation. The interrelating members G1-G5, 51-54 move the unit 200 from the mounting and dismounting position B to the image forming position A in interrelation with the movement of the cover 10 to the closed position from the open position by the manual operation. Therefore, according to the embodiments, the mounting and dismounting operativity of the cartridge 33 can be improved.

According to Embodiments 1-3 described above, the subframe 31, the rack 41, the toggle mechanism (51-54), and the lever 60, the spring (resilient member) 61, the gear 62, the gear 63, and the boss 64 as a first interrelating member are employed. Here, the frame 31, the rack 41, the toggle mechanism (51-54), and the first interrelating member (60-64) correspond to the third interrelating member. As for the third interrelating members (41, 31, 51-54, 60-64), the urging member 40 and the lever 60 (positioning member) are moved from the positioning place to the retracted position in interrelation with the movement of the cover 10 to the open position from the closed position by the manual operation. The third interrelating members (41, 31, 51-54, 60-64) move the urging member 40 and the lever 60 from the retracted position to the positioning place in interrelation with the movement of the cover 10 to the closed position from the open position by the manual operation. By this, according to this embodiment, the operativity in the positioning and releasing of the developing cartridge 33 can be improved. The gears G1-G6 according to Embodiments 1-3 described above and the toggle mechanism (51-54) are employed. Here, the gear G1-G6 and the toggle mechanism (51-54) correspond to the fourth interrelating member. As for the fourth interrelating members (G1-G6, 51-54), the unit 200 is moved from the image forming position A to the mounting and dismounting position B in interrelation with the movement of the cover 10 to the open position from the closed position. As for the fourth interrelating members (G1-G6, 51-54), the unit 200 is moved from the mounting and dismounting position B to the transfer position A in interrelation with the movement of the cover 10 to the closed position from the open position. By this, according to the embodiments described above, the mounting and dismounting operativity of the cartridge 33 relative to the unit 200 can be improved.

Embodiment 4

Figure 24A:
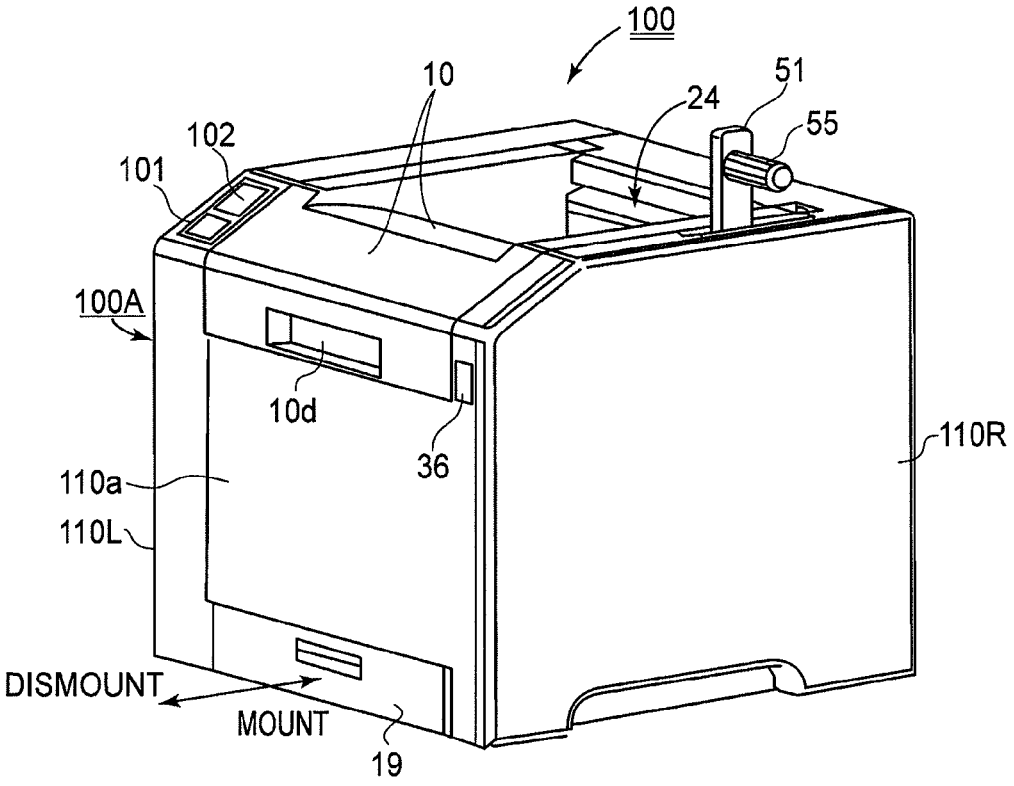
FIG. 24A is an outer appearance perspective view of an image forming apparatus according to Embodiment 4.
Figure 25A:
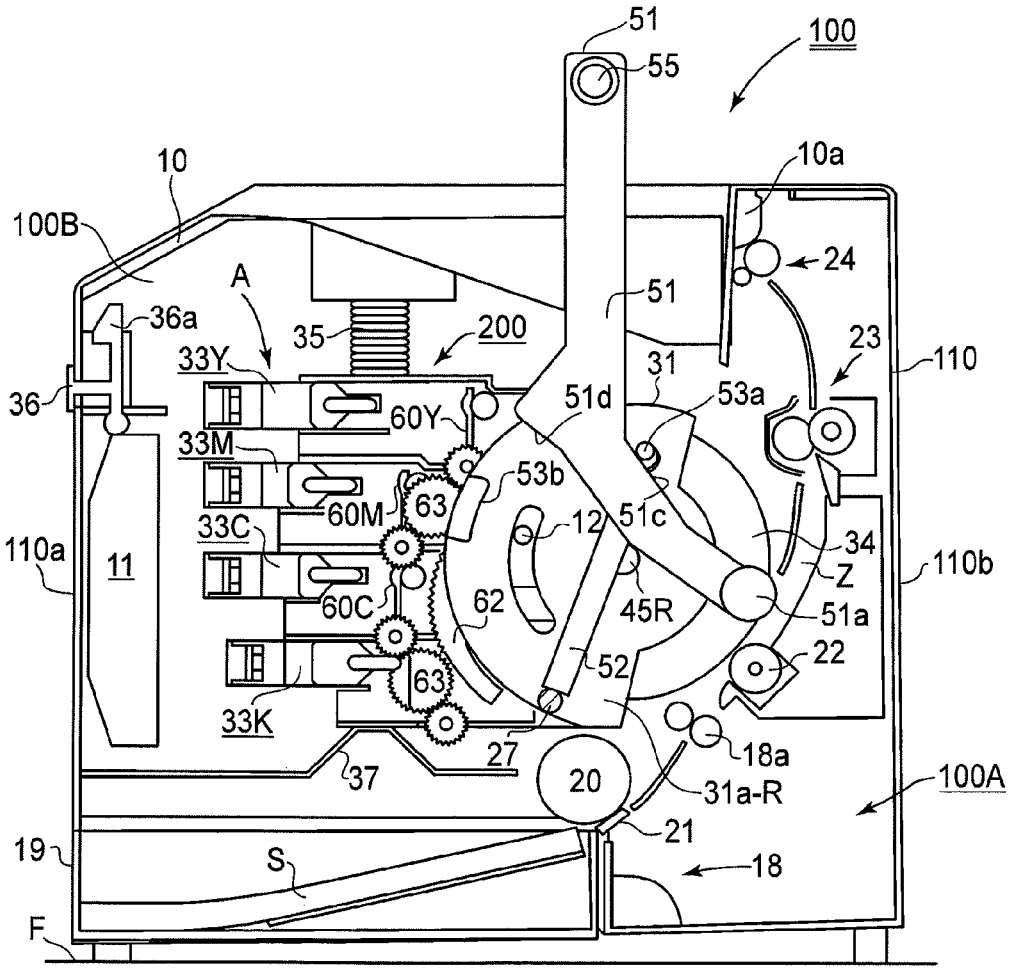
FIG. 25A is a schematic right side sectional view of the image forming apparatus according to Embodiment 4.
Figure 25B:
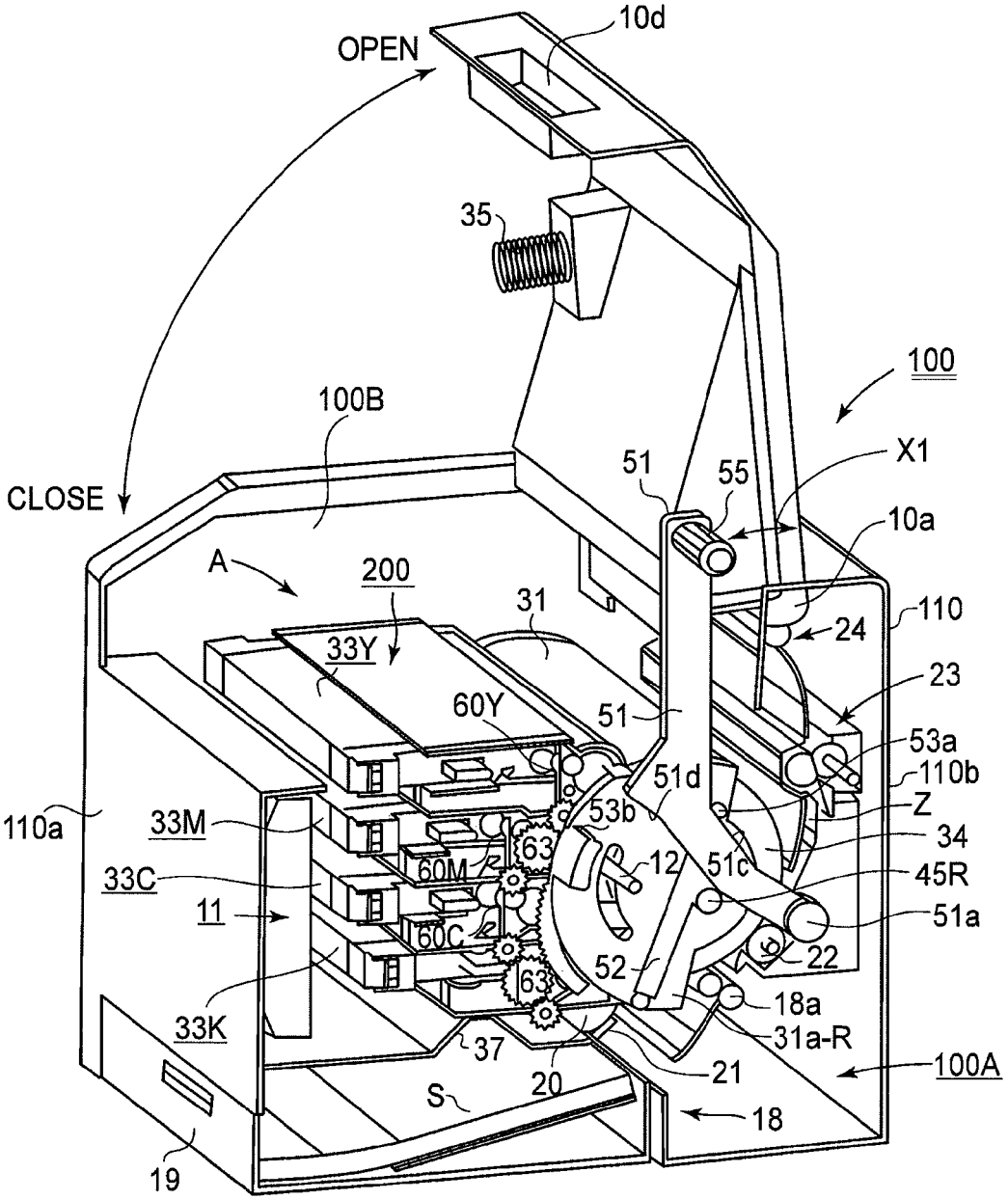
FIG. 25B illustrates the image forming apparatus, wherein the cover is opened to the open position.
Figure 26A:
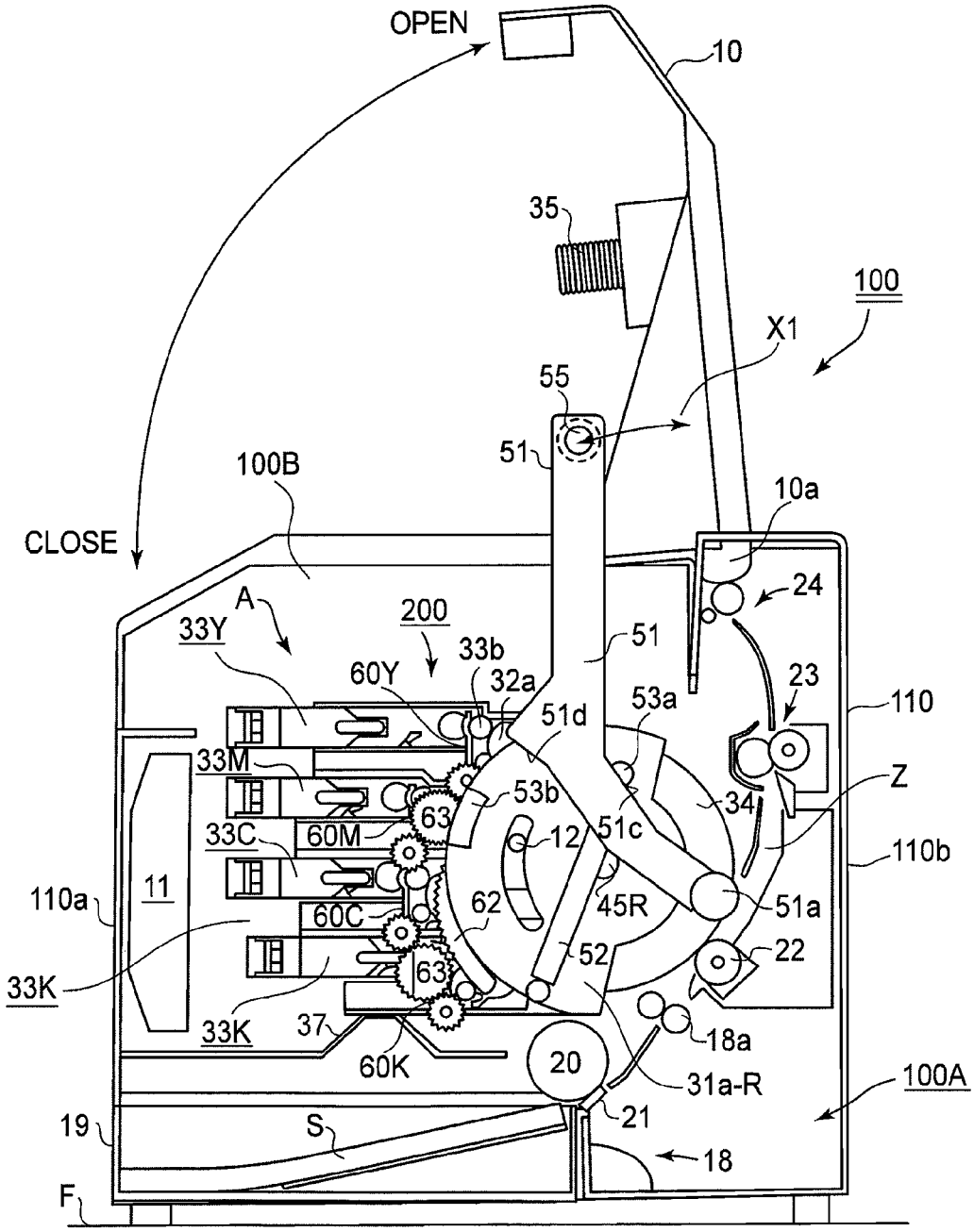
FIG. 26A illustrates the image forming apparatus (2), wherein the cover is opened to the open position.
Figure 26B:
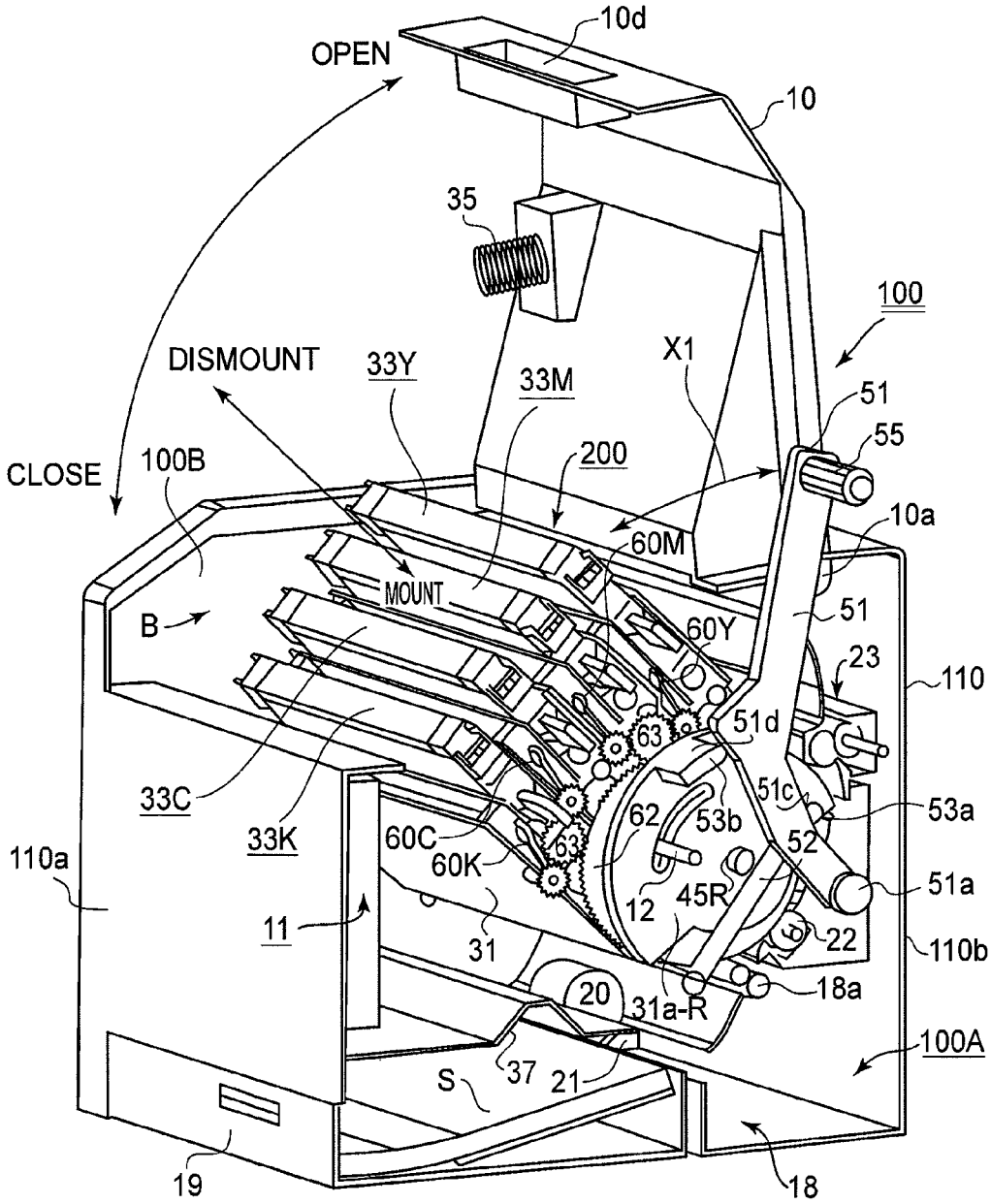
FIG. 26B illustrates the image forming apparatus, wherein the cover is opened to the open position, and the image forming unit is moved in the mounting and dismounting position.
Figure 27:
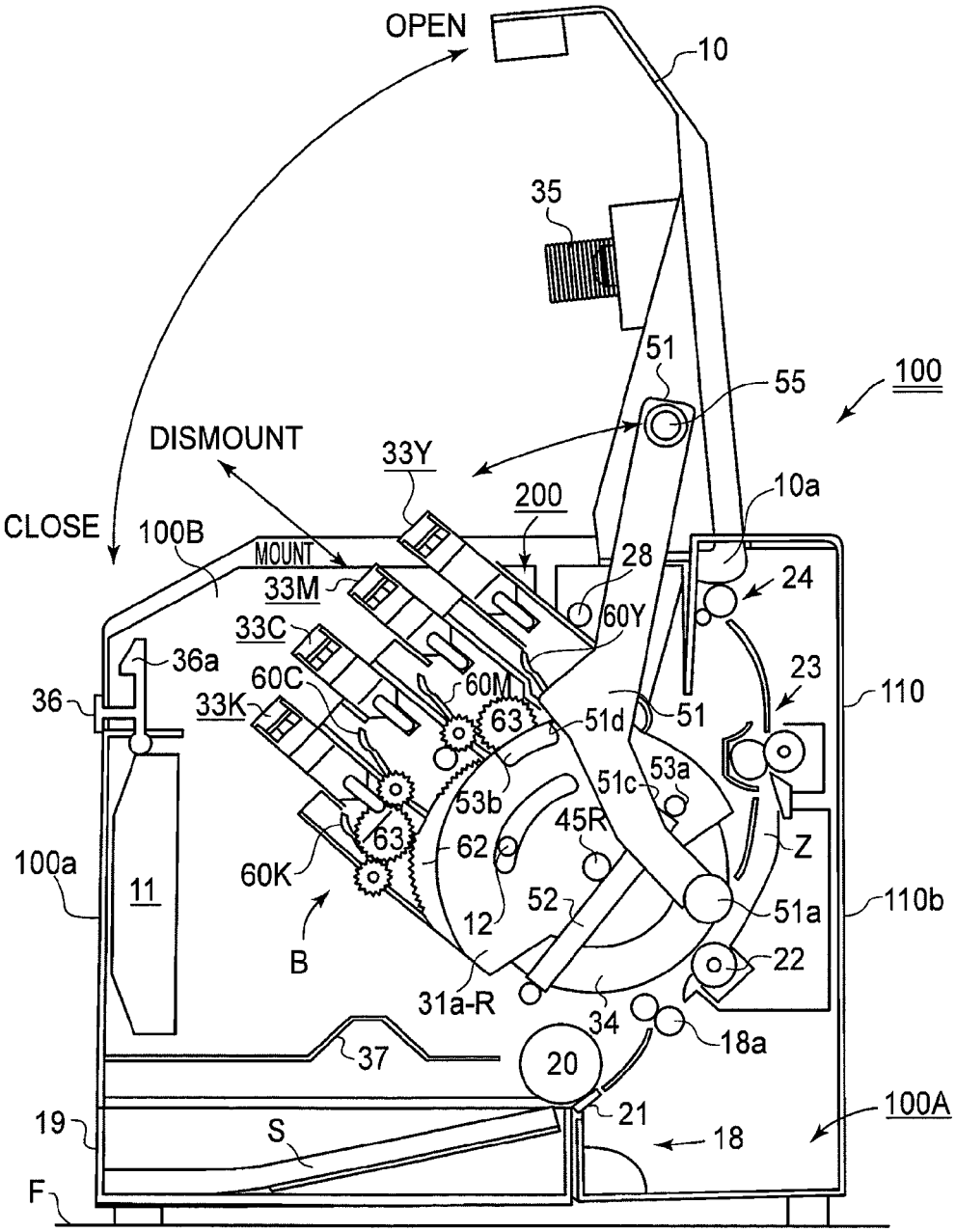
FIG. 27 illustrates the image forming apparatus (2), wherein the image forming unit is in the mounting and dismounting position.

FIG. 24A-FIG. 27 is an illustration of the image forming apparatus 100 of Embodiment 4. An opening and closing operation of the cover 10 and a rotating operation of the unit 200 are not interrelatedly with each other in Embodiment 4. The like reference numerals as in the foregoing embodiments are assigned to the elements having the corresponding functions 1-3 FIG. 24A is an outer appearance perspective view of the image forming apparatus 100 of this embodiment. FIG. 24B and FIG. 25A are a right sectional perspective view and a vertical section right side view s of the image forming apparatus 100 in which the cover 10 closes the opening portion 100B and the image formation is enabled. FIG. 25B and FIG. 26A are a right sectional perspective view and a vertical section right side view of the image forming apparatus 100 in the state that the cover 10 is sufficiently opened to the open position. FIG. 26B and FIG. 27 show a right sectional perspective view and a vertical section right side view of the image forming apparatus 100 in the state where the unit 200 is moved from the transfer position A to the mounting and dismounting position B.

In the image forming apparatus 100 of this embodiment, similarly to Embodiment 1, the cover 10 is operated, when the user pushes the button 36. By this, the cover 10 is released (releasing of the latch engagement). By this, the cover 10 is pushed up by the reaction force (elastic force) of the spring (resilient member) 35 between itself and the upper surface of the frame 31. The cover 10 is rotated in the open direction from the main assembly 100A by the angle corresponding to the operation distance (restoration length to free length) of the spring 35 about the hinge shaft 10*a*. More particularly, the cover 10 is in the partly opening state. The user further rotates the partially open cover 10 to the predetermined open position. The open state is stably held by the click stop mechanism 25 similarly to Embodiment 1. In this embodiment, when the button 36 is pushed, the latch engagement with the cover 10 is disconnected. The cover 10 is rotated by the amount corresponding to the operation distance of the spring 35. The cover 10 is opened to a slight degree. Thereafter, the user rotates the cover 10 in the open direction. In place of the spring 35, a tortion coil spring (resilient member) which normally urges the cover 10 clockwisely may be provided around a rotation axis 10*a*, and the spring which urges the cover 10 may be omitted. In this case, the user raises the cover 10.

In this embodiment, the opening and closing operation of the cover 10 and the rotating operation of the unit 200 are not interrelatedly with each other. In this embodiment, the rotating operation of the unit 200 is effected when the user rotates the toggle lever 51. More particularly, on the right-hand side of the upper surface of the image forming apparatus 100, a top end of the toggle lever 51 projects and a grip portion 55 as a manual operation member is provided. The toggle mechanism has the structures similar to those of Embodiments 2, 3, the unit 200 is moved to the mounting and dismounting position B from the transfer position A by the toggle mechanism, and from the mounting and dismounting position B to the transfer position A. As shown in FIG. 25B, and FIG. 26A, in this embodiment, the user opens the cover 10, and thereafter, the user grips the grip portion 55 of the toggle lever 51 and rotates the toggle lever 51 in the clockwise direction (backward) (the movement to the second position from the first position of the grip portion 55). In this manner, similarly to the image forming apparatus of Embodiments 2, 3, by the toggle mechanism, the image forming unit 200 is rotated from the transfer position a (FIG. 25B, FIG. 26B) to the mounting and dismounting position B (FIG. 26B and FIG. 27), and is maintained in the position. More particularly, the user opens the cover 10 upwardly of the main assembly 100A (FIG. 25B, FIG. 26B), and thereafter, the grip portion 55 is pushed down toward the rear side of the main assembly 100A. By this, the lever 51 is rotated about a rotation axis 51*a*. When the contact surface 51*c* of the lever 51 contacts to the projection 53*a* of the frame 31, the unit 200 begins to rotate clockwisely. As shown in FIG. 27, furthermore, when the pushing of the lever 51 is continued, the spring hooking portion 53*a* functioning also as the projection of the frame 31 is also rotated, the urging direction of the unit 200 by an elastic force of the toggle spring (resilient member) 52 changes to the clockwise direction from the counterclockwise direction. The unit 200 is clockwisely rotated by the urging force (elastic force) of the spring 52. The unit 200 abuts to a positioning portion 28 provided in the main assembly 100 to be positioned in the mounting and dismounting position B.

As has been described hereinbefore, a lever (positioning member) 60 is moved to the retracted position in interrelation with the movement of the grip portion (manual operation member) 55 to the second position from the first position by the urging spring 61, the gear 62, the gear 63, and the boss 64. The first position is the position shown in FIG. 25A. The second position is the tilted position shown in FIG. 26B tilted in the direction of the arrow X1 shown in FIG. 25B. The lever 60 is moved to the positioning place in interrelation with the movement of the grip portion 55 to the first position from the second position by the urging spring 61, the gear 62, the gear 63, and the boss 64. Here, the spring (resilient member) 61, the gear 62, the gear 63, and the boss 64 correspond to the first interrelating member. However, the first interrelating member is not limited to this structure, but another proper structure may be employed.

According to this embodiment, the first interrelating members (61-64) move the lever (positioning member) 60 to the retracted position Q2 in interrelation with the movement of the grip portion (manual operation member) 55 to the second position from the first position. The first interrelating member (61-64) moves the lever 60 to the positioning place Q1 in interrelation with the movement of the grip portion 55 to the first position from the second position. In this embodiment, the toggle lever (second interrelating member) 51 is employed. The lever 51 moves the unit 200 from the transfer position A to the mounting and dismounting position B in interrelation with the movement of the grip portion 55 to the second position from the first position. The lever 51 moves the unit 200 from the mounting and dismounting position B to the image forming position A in interrelation with the movement of the grip portion 55 to the first position from the second position. The structure described above applies also in Embodiment 6. Here, the opening of the cover 10 may be such that it is pushed by the rotating operation of the unit 200 in the clockwise direction, and it opens. The cartridge 33 can be exchanged by the above described structure without retracting the scanner unit 11. Therefore, the user can replace the cartridge 33 easily.

Figure 24B:
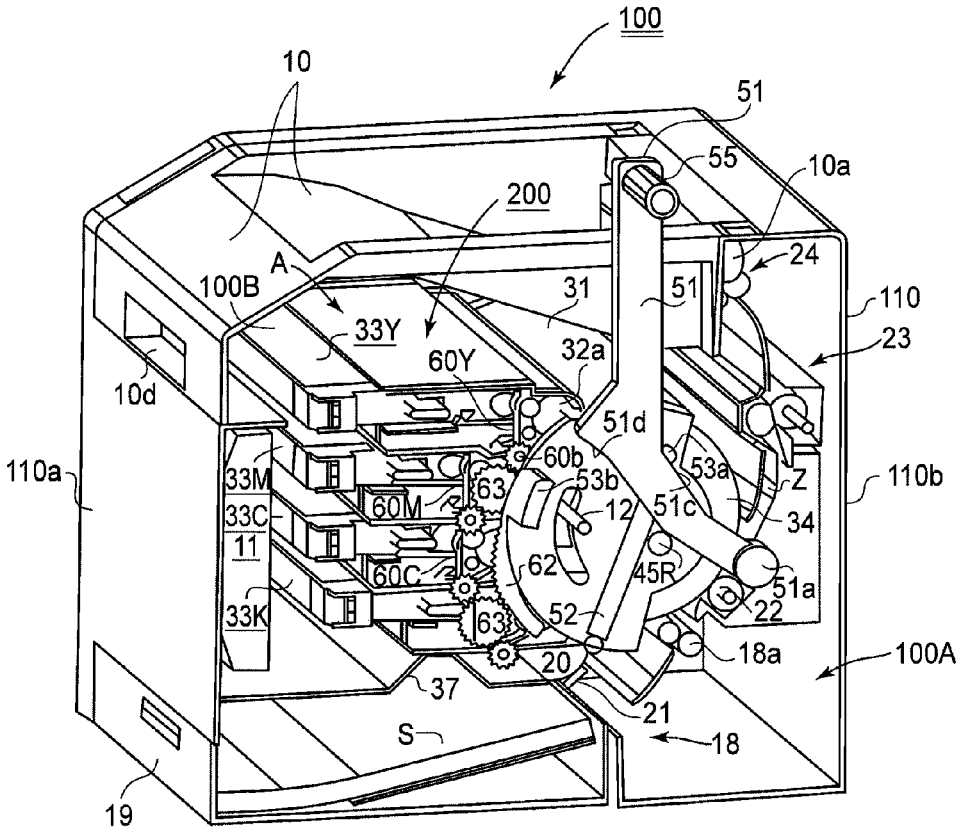
FIG. 24B is a schematic right-side sectional perspective view of an image forming apparatus according to Embodiment 4.

The description will be made as to the process of moving the cartridge 33 to the transfer position A (image forming position) after the user exchanges the cartridge 33. When the cartridge 33 is mounted to the unit 200, the cartridge 33 is temporarily held by the coupling unit 31*c* provided on the frame 31. After the exchange of the cartridge 33, the user grips the grip portion 55 and pulls the lever 51 to the front side (the movement to the first position from the second position of the grip portion 55). Then, the lever 51 is rotated counter-clockwisely and the contact surface 51*d* provided on the lever 51 contacts it to the projection 53*b* provided on the frame 31. By this, the unit 200 rotates counter-clockwisely. Similarly to Embodiments 2, 3, the toggle mechanism rotates the unit 200 from the retracted position B (FIG. 26B and FIG. 27) to the transfer position a (FIG. 25B, FIG. 26A), and is held in the position. The lever 60 moves from the retracted position to the positioning place with the movement of the unit 200 to the mounting and dismounting position A from the retracted position B. By this, the cartridge 33 is positioned relative to the photosensitive unit 32. Then, the cover 10 is closed relative to the opening portion 100B (FIG. 24A and FIG. 24B, FIG. 25A). By this, the image forming apparatus returns to the state that the image formation is enabled. Here, the lever 60 may also have the function of the electrical contact of the cartridge 33.

Embodiment 4 is summarized as follows. The apparatus is an image forming apparatus 100 for forming the color image on recording material S. It includes two or more cartridge mounting portions 31*c* for mounting the cartridge 33 dismountably. It further includes an independent intermediary transfer member opposed to a plurality of drums 32*a*, and the developer images formed in the drums 32*a* are transferred onto the a intermediary transfer member. The apparatus includes a unit 200 including two or more cartridge mounting portions 31*c* and the intermediary transfer member 34. The unit 200 is movable between the transfer position A for transferring the developer image transferred onto the intermediary transfer member 34 from photosensitive drums 32*a* onto recording material S, and the mounting and dismounting position B for mounting and demounting the cartridge 33 relative to the cartridge mounting portion 31*c*. It further includes an opening portion 100B for mounting and demounting the cartridge 33 relative to the mounting portion 31*c* of the unit 200 placed in a front deposition B. It includes a manual operation member 50. The apparatus includes interrelating member 51-53 for moving the unit 200 from the transfer position A to the mounting and dismounting position B in interrelation with the manual operation member 50 moving from the first position to the second position. It further includes an interrelating member 51-53 for moving the unit 200 from the mounting and dismounting position B to the transfer position A in interrelation with the manual operation member 50 moving from the second position to the first position.

Embodiment 5

Figure 28A:
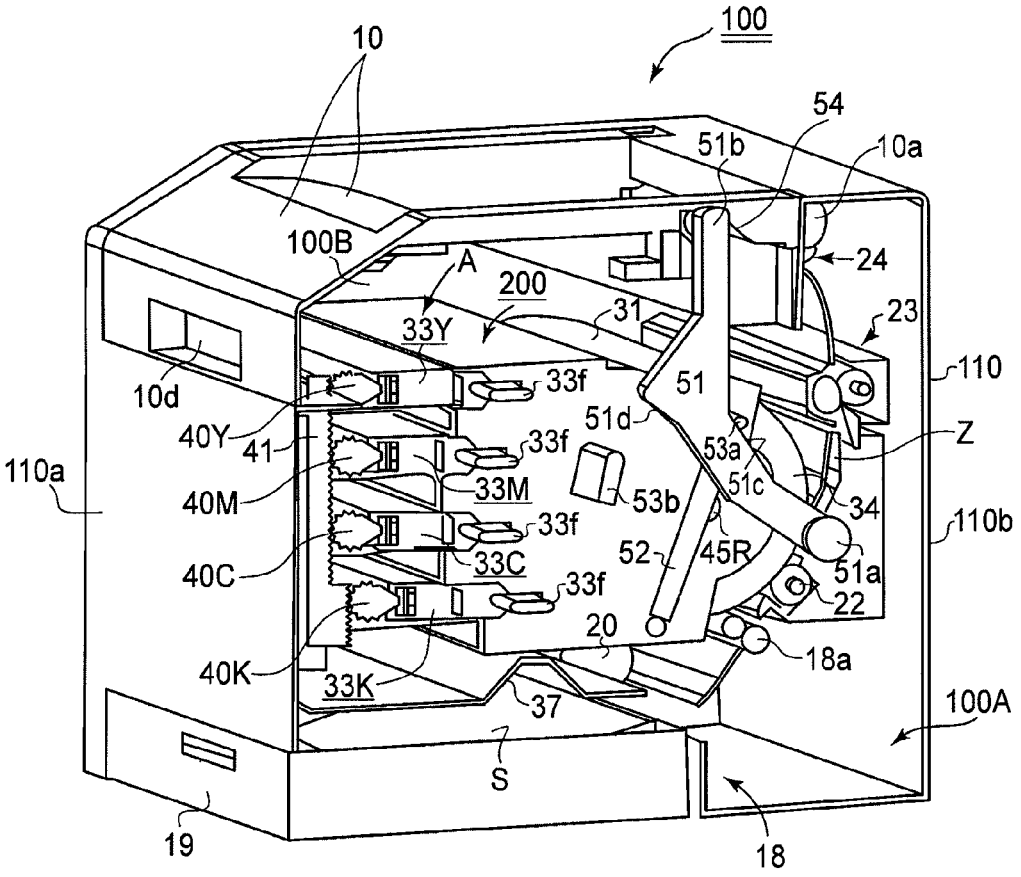
FIG. 28A is a schematic right-side sectional perspective view of an image forming apparatus according to Embodiment 5.
Figure 28B:
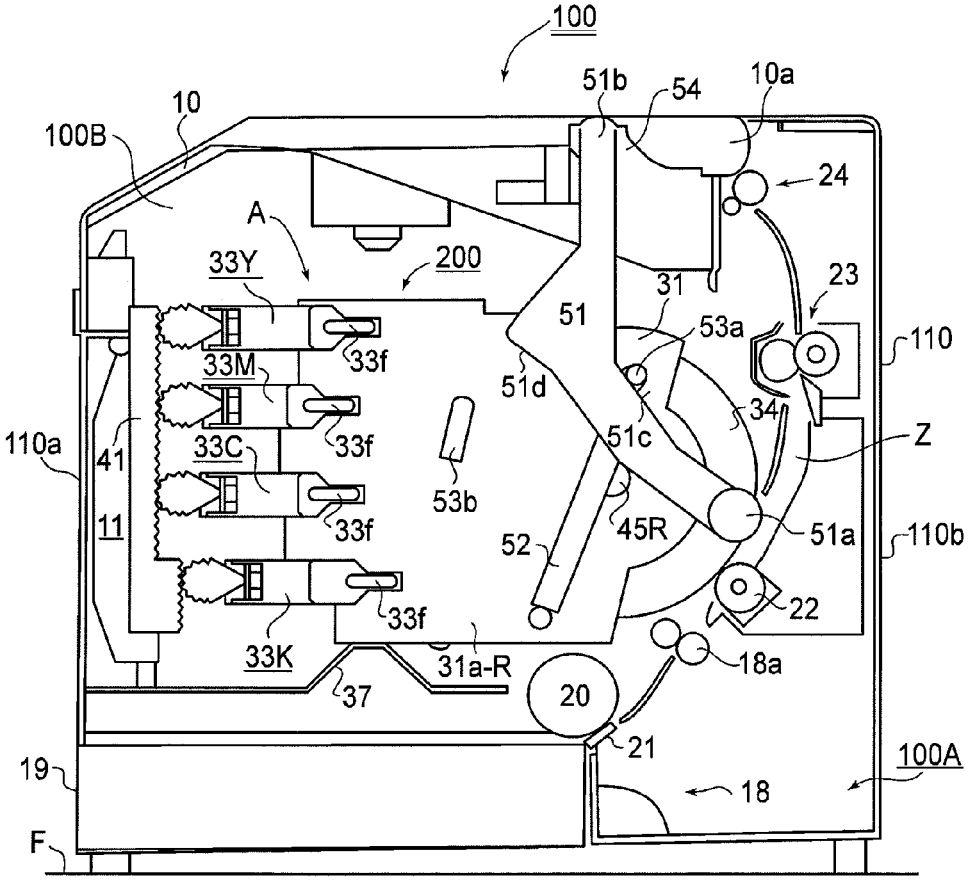
FIG. 28B is a schematic right-side sectional perspective view of the image forming apparatus of Embodiment 5.
Figure 31:
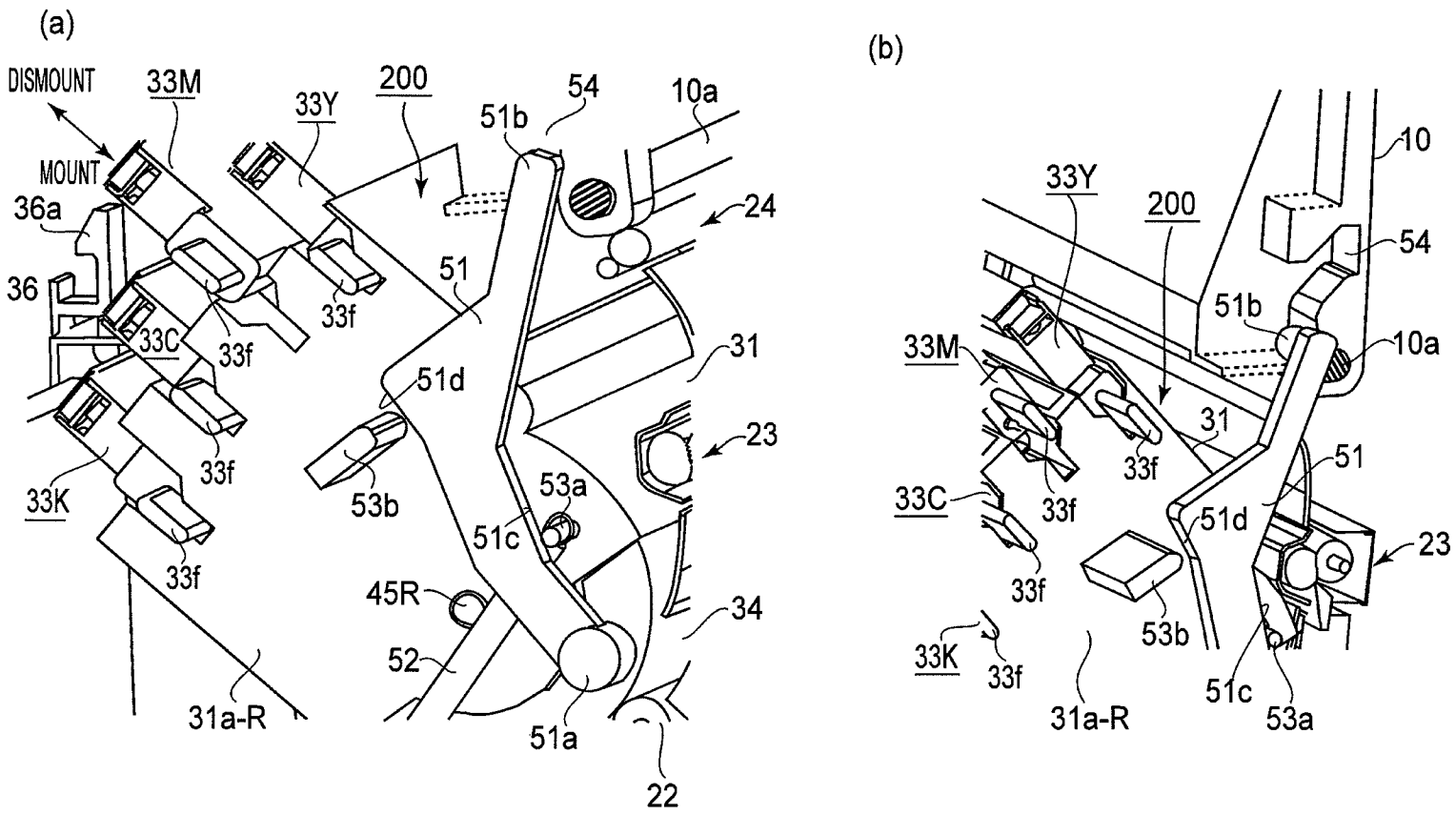

FIG. 28A-(b) of FIG. 31 are illustrations of the structure of the apparatus of this embodiment. The Embodiment 5 is the same as Embodiment 2 fundamentally. Similarly to Embodiment 2, in Embodiment 5, the unit 200 is operated in interrelation with the opening operation of the cover 10. However, the cover 10 is not operated interrelatedly with the closing operation of the unit 200. More particularly, the movement of the unit 200 to the transfer position A from the mounting and dismounting position B is carried out by the user rotating the unit 200 with the cover 10 kept opened. In Embodiment 5, in the case of moving the unit 200 from the transfer position A to the mounting and dismounting position B, the movement of the cover 10 and movement of the unit 200 interrelate with each other. However, in moving the unit 200 from the mounting and dismounting position B to the transfer position A, only the unit 200 can be moved (The movement of the cover 10 and the movement of the unit 200 are not operated interrelatedly with each other).

Figure 29A:
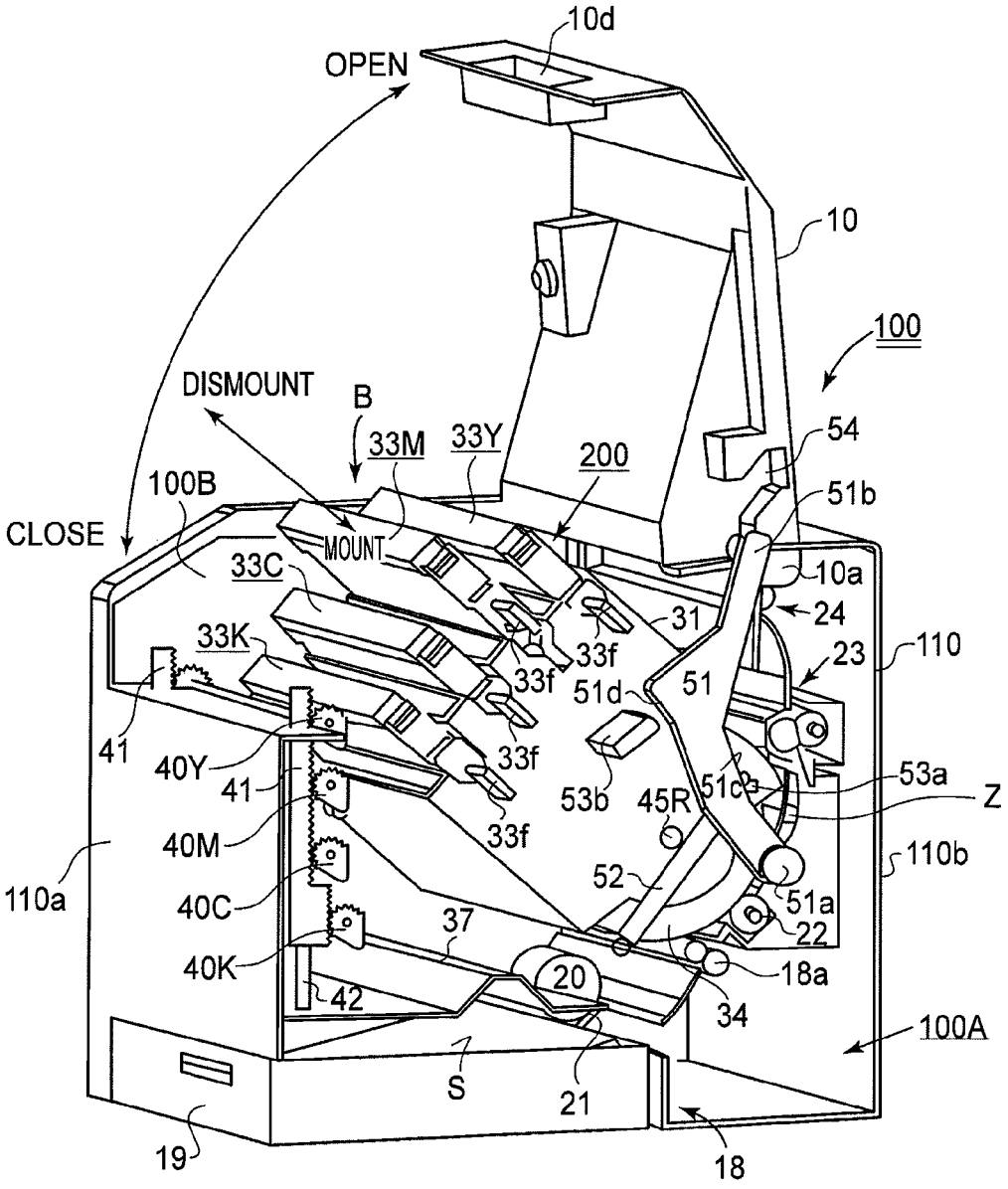
FIG. 29A illustrates the image forming apparatus (1), wherein the cover is opened to the open position, and the image forming unit is in the mounting and dismounting position.
Figure 29B:
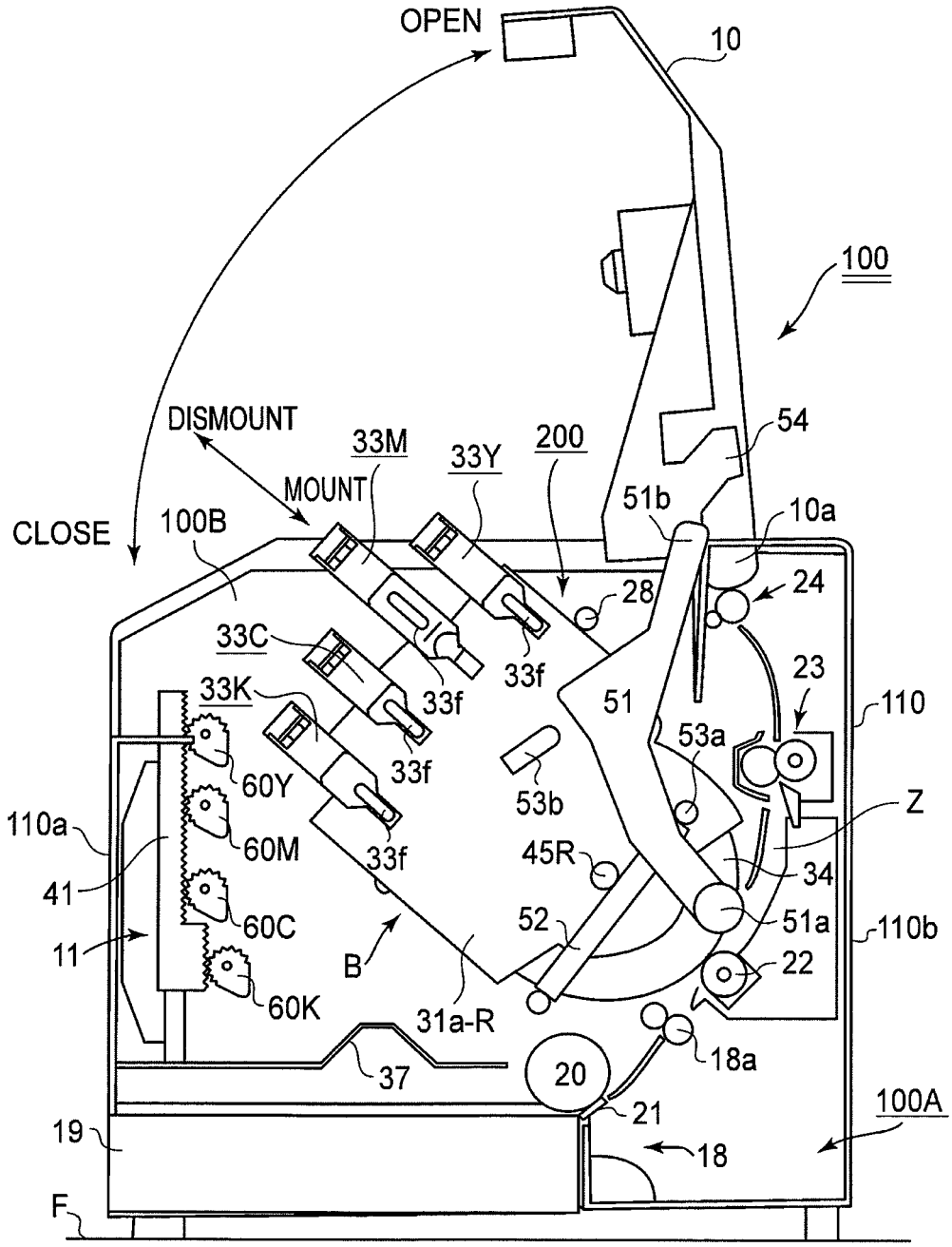
FIG. 29B illustrates the image forming apparatus (2), wherein the cover is opened to the open position, and the image forming unit is in the mounting and dismounting position.
Figure 30:
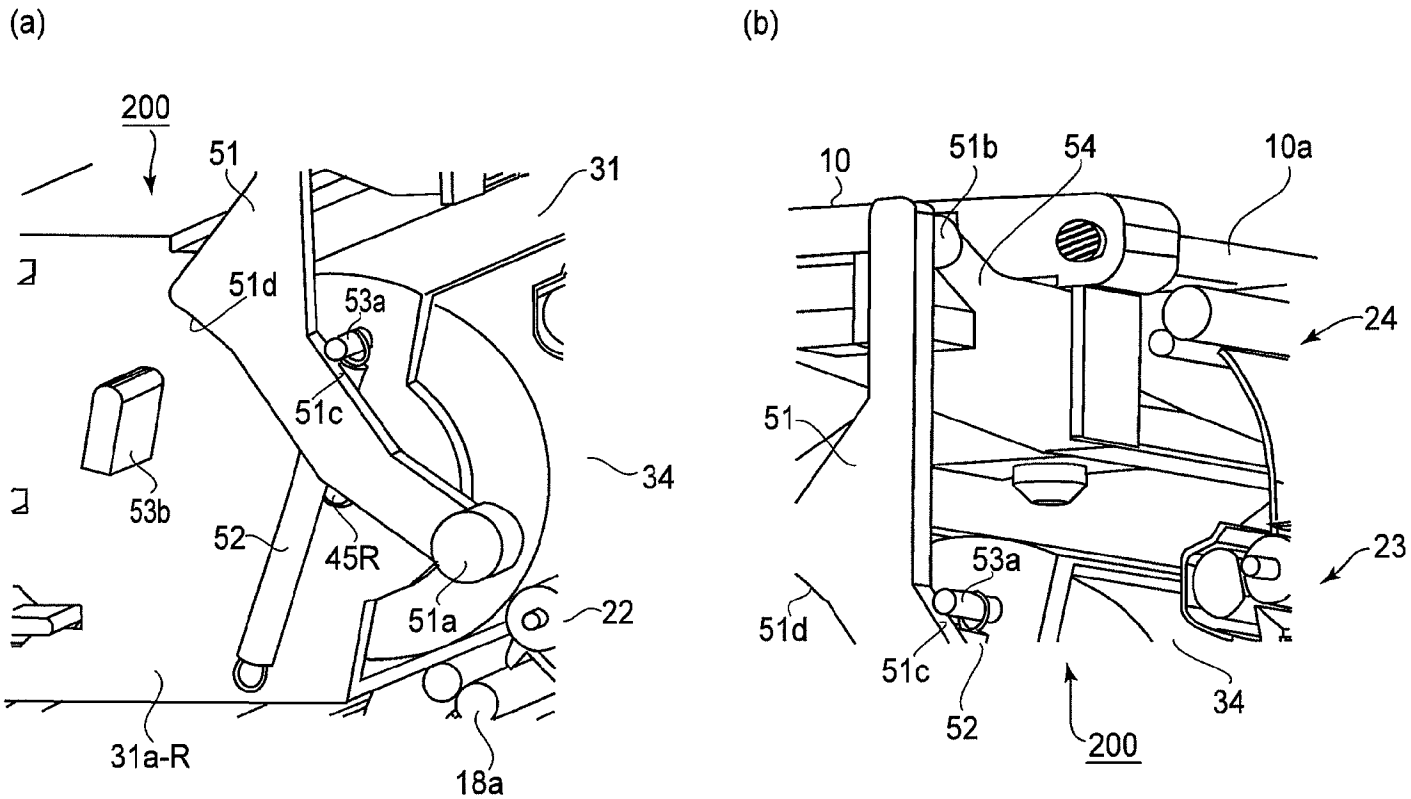
In FIG. 30, (*a*) is a perspective view illustrating a coupling portion between a toggle lever and a cover, (*b*) is a perspective view of a toggle lever, wherein the cover is closed In FIG. 31, (*a*) is a perspective view (1) of the toggle lever, wherein the cover is opened, and (*b*) is a perspective view (2) of the toggle lever, wherein the cover is opened.

FIGS. 28A and 28B are a right sectional perspective view and a schematic right side longitudinal sectional view s of the image forming apparatus 100 in which the cover 10 closes the opening portion 100B. FIG. 29A and FIG. 28B are a schematic right sectional perspective view and a schematic right side longitudinal sectional view of the image forming apparatus 100, wherein the cover 10 is opened from the opening portion 100B of the main assembly 100A to the predetermined open position, and the unit 200 is placed in the mounting and dismounting position B. (a) of FIG. 30 is a perspective view illustrating a coupling portion between the toggle lever and the cover. (b) of FIG. 30 is a perspective view of the toggle lever in the state that the cover is closed. (a) and (b) of FIG. 31 are a perspective view of the toggle lever in the state that the cover is opened. In this embodiment, a moving operation of the unit 200 to the mounting and dismounting position B from the transfer position A is the same as the operation in Embodiment 2. The like reference numerals as in the foregoing embodiments are assigned to the elements having the corresponding functions 2

The process will be described, wherein the unit 200 is moved to the transfer position (image forming position) A after the user exchanges the cartridge 33. In the case where the user returns the unit 200 to the transfer position A in manual after the mounting of the cartridge 33, the urging direction (direction of the elastic force) of the spring (resilient member) 52 which urges the frame 31 clockwisely changes to the counterclockwise direction. By this, the frame 31 is rotated in the counterclockwise direction until it abuts to the main stay 37. More particularly, the unit 200 is positioned in the transfer position A. A lever engaging portion 51*b* is also rotated counter-clockwisely by this operation. However, the cover 10 does not have the configuration for receiving the counter-clockwise rotating movement of an engaging portion 51*b*. For this reason, the cover 10 is not operated interrelatedly with the returning operation of the unit 200 to the transfer position A from the mounting and dismounting position B but continues to take the open position. Thereafter, the user closes the cover 10. The urging member (positioning members) 40 (40Y, 40M, 40C, 40K) as the positioning member moves from the retracted position to the positioning place by the closing operation of the cover 10.

Embodiment 5 is summarized as follows. The apparatus is an image forming apparatus 100 for forming the color image on recording material S. It includes two or more cartridge mounting portions 31*c* for mounting the cartridge 33 dismountably. It further includes an independent intermediary transfer member opposed to the drums 32*a*, and the developer images formed on the drums 32*a* are transferred onto the intermediary transfer member 34. The apparatus includes a unit including two or more cartridge mounting portions 31*c* and the intermediary transfer member 34. The image forming unit 200 is movable between the transfer position A for transferring the developer image transferred onto the intermediary transfer member 34 from the drums 32*a* onto recording material S, and the mounting and dismounting position B for mounting and demounting the cartridge 33 relative to the mounting portion 31*c*. The apparatus includes an opening portion 100B for permitting the mounting and demounting of the cartridge 33 relative to the mounting portion 31*c* of the unit 200 placed in the mounting and dismounting position B. The cover 10 is movable between the closed position for closing the opening portion 100B and the open position for releasing opening portion 100B. The apparatus includes an interrelating member 51-54 for moving the unit 200 from the transfer position A to the mounting and dismounting position B in interrelation with an opening and closing member 10 moving from the closed position to the open position by the manual operation. When the cover (opening and closing member) 10 moves from the open position to the closed position by the manual operation, the interrelating member 51-54 which releases the interrelation with the cover 10. The unit 200 is moved from the transfer position A to the mounting and dismounting position B in interrelation with the cover 10 moving from the closed position to the open position by the manual operation. The unit 200 is moved from the mounting and dismounting position B to the transfer position A by the manual operation, in the case where the cover 10 is moved from the open position to the closed position by the manual operation.

Embodiment 6

Figure 32:
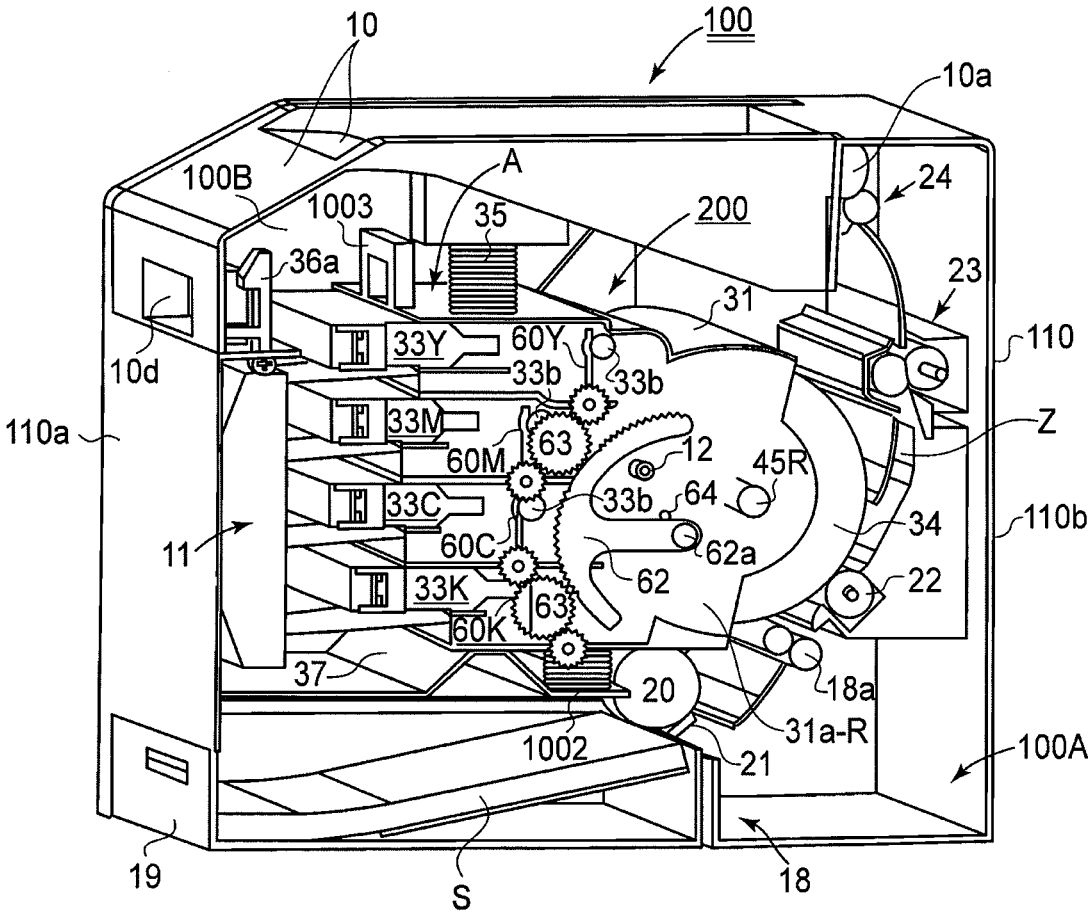
FIG. 32 is a schematic right-side sectional perspective view of an image forming apparatus according to Embodiment 6.

FIG. 32 is an illustration of the image forming apparatus 100 according to Embodiment 6. The present Embodiment 6 is the same as that of Embodiment 1, Embodiment 3, or Embodiment 4 fundamentally. Therefore, the description of this embodiment will be made referring also to the drawings relating to the foregoing Embodiments In the description of Embodiment 6, the illustrations are omitted as to the state that the button 36 is pushed and the cover 10 is partially open, the state that the cover 10 is opened, and the state that the unit 200 is moved by the manual operation to the mounting and dismounting position B This is because they are the same as in the embodiments described above. The image forming apparatus 100 of this embodiment is substantially the same as the image forming apparatus 100 of the above-described embodiments. More particularly, the cover 10 is maintained in the closed state by the engagement between the claw portion 36*a* of the button 36 and the claw portion 10*b* provided in the cover 10. In view of this, in order to release the closed state (locked state) of the cover 10, the user pushes the button 36. The button 36 is disposed on the front side of the main assembly 100A. In this embodiment, the user pushes the button 36 to release the closed state of the cover 10, by which the positioning of the unit 200 relative to the transfer position A is released. Therefore, the user can manually raise the unit 200 to the mounting and dismounting position B. The cartridge 33 is exchangeable in the opened state of the cover 10.

The frame 31 is provided with the spring (resilient member) 1002 for urging the unit 200 in the clockwise direction, the spring 1002 being provided between the main stay 37 and itself and the grip portion (manual operation member) 1003 for raising the unit 200 manually. The unit 200 is urged counter-clockwisely by the elastic force of the spring (resilient member) 35 provided in the cover 10, and it is clockwisely urged by the elastic force of a spring 1002 provided in the frame 31. The elastic force of the spring 1002 is set, such that in the closed state of the cover 10, the unit 200 abuts to a stay (main assembly positioning portion) 37 to be positioned in the transfer position A. Here, it is preferable to also consider a weight of the unit 200. The pressing and positioning structures of the cartridge 33 and the operations of the contact of the lever 60 to the cartridge 33 or the spacing from the cartridge 33 in interrelation with the rotation of the frame 31 are the same as the structures and operations in Embodiment 3, and therefore, the detailed description is omitted.

When the user pushes the button 36, the latch engagement (the engagement with the claw portion 36*a* and the claw portion 10*b*) with the cover 10 is released. The cover 10 clockwisely urged by the elastic force of the spring 35 is rotated upwardly by the amount corresponding to the operation distance of the spring 35. The cover 10 is opened to a slight degree (partly opening state). Thereafter, the user raises the cover 10 to rotate it in the open direction. By this, the user can open the cover with small force, and the vigorousness in the opening can be suppressed. Simultaneously, the unit 200 is released from the lock by the elastic force of the spring 35. Then, it is clockwisely rotated by the elastic force of the spring 1002, and rises to a slight degree and stops. In this state, it is desirable that the lever 60 maintains the state of pressing the cartridge 33. Here, the rotational operation of the cover 10 and the rotational operation of the unit 200 are not operated interrelatedly with each other. The user rotates the partially open cover 10 in the open direction to the predetermined open position, and thereafter the user raises the unit 200 with a grip portion 1003 (the movement of the grip portion 1003 to the second position from the first position). By this, the unit 200 rotates to the mounting and dismounting position B by the toggle mechanism which is provided with the toggle lever 51, and is positioned there. In this embodiment, the positioning mechanism for each cartridge 33 is the same as that of the mechanism of Embodiment 3, and is the mechanism 60-64 which employs the lever 60. The lever 60 moves from the positioning place to the retracted position with the movement of the unit 200 to the mounting and dismounting position B from the transfer position A. By this, in the state where the unit 200 is placed in the mounting and dismounting position B, the positioning of the cartridge 33 is in the released state.

By the above-described structure, the exchange of the cartridge 33 is possible without retracting the scanner unit 11, and therefore, the user can replace the cartridge 33 easily.

Then, after the user exchanges the cartridge 33, the user moves the unit 200 downwardly with the grip portion 1003 (the movement of the grip portion 1003 to the first position from the second position). By this, the unit 200 is rotated to the transfer position A by the toggle mechanism 51-53. The user closes the cover 10 against the elastic force of the springs 35, 1002. By this, the unit 200 is moved and positioned to the transfer position A. The lever 60 moves from the retracted position to the positioning place with the movement of the unit 200 to the mounting and dismounting position A from the retracted position B. By this, the cartridge 33 is positioned relative to the photosensitive unit 32.

The structure of the image forming apparatus 100 of the above described Embodiment 6 is summarized as follows. The apparatus is an image forming apparatus 100 for forming the color image on recording material S. It includes two or more mounting portions 31*c* for mounting the cartridge 33 dismountably. It further includes an independent intermediary transfer member opposed to drums 32*a*, and the developer images formed on the drums 32*a* are transferred onto the intermediary transfer member 34. It further includes a unit including two or more mounting portions 31*c* and the intermediary transfer member 34. The unit 200 is movable between the transfer position A for transferring the developer image transferred onto the intermediary transfer member 34 from drums 32*a* onto the recording material S, and the mounting and dismounting position B for mounting and demounting the cartridge 33 relative to the mounting portion 31*c*. The apparatus includes, in order to carry out by positioning of the unit 200 at the transfer position A, a first locking member for locking the unit 200 with the main assembly 100A of the image forming apparatus 100. Here, in this embodiment, the first locking members is a combination of a locking claw portion 36 on the button (36*g*), locking claw portion 10*b* on the cover 10 side, the cover 10, the spring 35, and the main stay 37. The apparatus includes an opening portion 100B for mounting and demounting the cartridge 33 relative to the mounting portion 31*c* of the unit 200 placed in the mounting and dismounting position B. It further includes a cover 10 movable between the closing position for closing the opening portion 100B and the opening position for opening the opening portion 100B. It further include a maintenance button, and in interrelation with the cover 10 moving from the closed position to the open position by the manual operation, the maintenance button (first releasing member) 36 releases the locking of the first locking member (locking claw portion 36*a*, locking claw portion 10*b*, cover 10, spring 35, and main stay 37). The apparatus includes a toggle mechanism (second locking member) 51-53 for releasable locking, to the main assembly 100A, the unit 200 which is released from the locked state of the first locking member by the maintenance button (first releasing portion) 35 and which is moved manually to the mounting and dismounting position Bowen the lock by the first locking member is released by the first releasing member, the unit 200 rotates toward the mounting and dismounting position B about the rotation axis 34*a* of the intermediary transfer member 34. The unit 200 locked with the main assembly 100A by the toggle mechanism (second locking member) 51-53 is released in the lock by the movement to the closed position of the cover 10. The unit 200 locked with the main assembly 100A by the toggle mechanism 51-53 is released in the lock by the manual operation prior to moving the cover 10 to the closed position. In Embodiment 6, the lever 60 moves to the retracted position Q2 in interrelation with the grip portion (manual operation member) 1003 moving from the first position to the second position. And, the lever 60 moves to the positioning place Q1 in interrelation with the grip portion 1003 moving from the second to the first position.

The apparatus of Embodiment 6 is provided with toggle lever (a second interrelating member 51) 51. The lever 51 moves the unit 200 from the transfer position A to the mounting and dismounting position B in interrelation with a grip portion 103 moving from the first to the second position. The lever 51 moves the unit 200 from the mounting and dismounting position B to the transfer position A in interrelation with the grip portion 55 moving from the second to the first position. The Embodiment 1 includes the cover 10, the spring 35, and the main stay 37. These correspond to the locking member. The apparatus of Embodiments 2, 3, 5, 6 includes the sub-frame 31, the main stay 37, and the toggle mechanism (second locking member) 51-53. These correspond to the locking member. The locking member (the means 10, 35-37 in Embodiment 1, and the means 31, 37, 51-53 in the other embodiments) locks the unit 200 to the image forming position A in the state that the cover 10 is in the closed position. The locking member (the means 10, 35-37 in Embodiment 1, and the means 31, 37, 52, 53 in the other embodiment) releases the lock of the unit 200 in the state that the cover 10 is moved from the closed position to the open position. Therefore, according to the embodiment described above, the unit 200 can be positioned with high precision relative to the main assembly 100A.

In Embodiment 4 described above, the toggle mechanism (second locking member) 51-53 and the first interrelating member (61-64) are provided. These correspond to the locking member. In Embodiments 3-6, the locking member (the means 31, 37, 52, 53 in Embodiments 3, 5, 6, and the means 51-53, 60-64 in Embodiment 4) locks the unit 200 to the transfer position A. By the releasing of the unit 200 by the locking member (the means 31, 37, 52, 53 in Embodiments 3, 5, 6, and the means 51-53, 60-64 in Embodiment 4), the unit 200 is raised by the elastic force. In this state, the urging member 40 and the lever 60 (positioning members) are in the positioning place. By this, the developing cartridge 33 (cartridge) is positioned. More particularly, the developing roller 33*b* of the developing cartridge 33 are opposed and positioned relative to the drum 32*a*. The urging member 40 and the lever 60 (positioning members) are retracted to the retracted position in the process in which the unit 200 moves to the transfer position A.

INDUSTRIAL APPLICABILITY

According to each embodiment described above, there is provided a color electrophotographic image forming apparatus in which the operativity at the time of mounting and demounting the cartridge relative to the main assembly is improved. In addition, according to each embodiment described above, the color electrophotographic image forming apparatus in which the cartridge can be positioned with high precision to the main assembly can be provided. Furthermore, the color electrophotographic image forming apparatus can be provided in which at the time of the replacement of the cartridge, the cartridge can be replaced without retracting the image exposure device. Moreover, the color electrophotographic image forming apparatus can be provided wherein the user's operations are simple, and the incorrect mounting at the time of the maintenance and so on can be prevented.

While the invention has been described with reference to the structures disclosed herein, it is not confined to the details set forth, and this application is intended to cover such modification or changes as may come within the purposes of the improvements or the scope of the following claims.

The invention claimed is:

1. A color electrophotographic image forming apparatus, including detachable cartridges, for forming a color image on a recording material, said apparatus comprising:

a plurality of electrophotographic photosensitive drums configured to develop images;

an intermediary transfer member onto which developed images formed on said electrophotographic photosensitive drums are transferred, said intermediary transfer member being provided opposite to said electrophotographic photosensitive drums;

an image forming unit comprising a plurality of cartridge mounting portions for demountably mounting said cartridges, being movable between a transfer position for transferring, onto the recording material, the developed images transferred onto said intermediary transfer member from said electrophotographic photosensitive drums, and a mounting and demounting position for mounting and demounting said cartridges relative to said cartridge mounting portions; and a locking member for releasably locking said image forming unit which is moved to the mounting and demounting position to prevent said image forming unit from moving from the mounting and demounting position to the transfer position.

2. An apparatus according to claim 1, wherein when the locking of said locking member is released, said image forming unit rotates toward the mounting and demounting position about a rotation axis of said intermediary transfer member.

3. An apparatus according to claim 1, further comprising:

an opening for permitting mounting and demounting of said cartridges relative to said cartridge mounting portions of said image forming unit placed in the mounting and demounting position; and an openable member capable of opening and closing said opening, said openable member being movable between a closing position for closing said opening and an open position for opening said opening, wherein said image forming unit locked to said main assembly of the apparatus by said locking member is released by movement of said openable member to said closing position.

4. An apparatus according to claim 1, further comprising:

an opening for permitting mounting and demounting of said cartridges relative to said cartridge mounting portions of said image forming unit placed in the mounting and demounting position; and an openable member capable of opening and closing said opening, said openable member being movable between a closing position for closing said opening and an open position for opening said opening, wherein said image forming unit locked to a main assembly of the apparatus by said locking member is releasable manually prior to movement of said openable member to the closing position.

5. A color electrophotographic image forming apparatus, including detachable cartridges, for forming a color image on a recording material, said apparatus comprising:

a plurality of electrophotographic photosensitive drums configured to develop images;

an intermediary transfer member onto which developed images formed on said electrophotographic photosensitive drums are transferred, said intermediary transfer member being provided opposite to said electrophotographic photosensitive drums;

an image forming unit comprising a plurality of cartridge mounting portions for demountably mounting said cartridges, being movable between a transfer position for transferring, onto the recording material, the developed images transferred onto said intermediary transfer member from said electrophotographic photosensitive drums, and a mounting and demounting position for mounting and demounting said cartridges relative to said cartridge mounting portions;

positioning members movable between a positioning position for positioning said cartridges at a predetermined place when said mage forming unit is at the transfer position and a retracted position retracted from the positioning place;

wherein with movement of said image forming unit from the transfer position to the mounting and demounting position, said positioning members move from the positioning place to the retracted position to permit mounting and demounting of said cartridges relative to a cartridge mounting portion of said image forming unit, and further comprising a manual operating member, and a first interrelating member for moving said positioning members to the retracted position in interrelation with movement of said manual operating member from a first position to a second position and for moving said positioning members to the positioning place in interrelation with movement of said manual operating member from the second position to the first position.

6. An apparatus according to claim 5, further comprising a second interrelating member for moving said image forming unit from the transfer position to the mounting and demounting position in interrelation with movement of said manual operating member from the first position to the second position and for moving said image forming unit from the mounting and demounting position to the transfer position in interrelation with movement of said manual operating member from the second position to the first position.

7. A color electrophotographic image forming apparatus, including detachable cartridges, for forming a color image on a recording material, said apparatus comprising:

a plurality of electrophotographic photosensitive drums configured to develop images;

an intermediary transfer member onto which developed images formed on said electrophotographic photosensitive drums are transferred, said intermediary transfer member being provided opposite to said electrophotographic photosensitive drums;

an image forming unit comprising a plurality of cartridge mounting portions for demountably mounting said cartridges, being movable between a transfer position for transferring, onto the recording material, the developed images transferred onto said intermediary transfer member from said electrophotographic photosensitive drums, and a mounting and demounting position for mounting and demounting said cartridges relative to said cartridge mounting portions;

positioning members movable between a position for positioning said cartridges at a predetermined place when said image forming unit is at the transfer position and a retracted position retracted from the positioning position;

an opening for permitting mounting and demounting of said cartridges relative to said cartridge mounting portions of said image forming unit placed in the mounting and demounting position;

wherein with movement of said image forming unit from the transfer position to the mounting and demounting position, said positioning members move from the positioning position to the retracted position to permit mounting and demounting of said cartridges relative to a cartridge mounting portion of said image forming unit, and further comprising an openable member movable between a closing position for closing said opening and an open position for opening said opening, and a third interrelating member for moving said positioning members from the positioning position to the retracted position in interrelation with manual movement of said openable member from the closing position to the open position for moving said positioning members from the retracted position to the positioning position in interrelation with manual movement of said openable member from the open position to the closing position.

8. An apparatus according to claim 7, further comprising a fourth interrelating member for moving said image forming unit from the transfer position to the mounting and demounting position in interrelation with movement of said openable member from the closing position to the open position and for moving said image forming unit from the mounting and demounting position to the transfer position in interrelation with movement of said openable member from the open position to the closing position.

9. An apparatus according to claim 7, further comprising a locking member for locking said image forming unit to the transfer position, wherein said locking member locks said image forming unit to the transfer position in the state in which said openable member is at the closing position, and said locking member releasing locking of said image forming unit in the state in which said openable member is moved from the closing position to the open position.

10. An apparatus according to claim 5, further comprising a locking member for releasably locking said image forming unit, wherein in the state in which said image forming unit is raised by an elastic force by the locking of said image forming unit by said locking member of the image forming unit at the transfer position being released, the positioning member is at the positioning place, and wherein in a process of movement of said image forming unit to the transfer position, said positioning member retracts to the retracted position.

11. An apparatus according to claim 5, wherein said image forming unit is movable between the transfer position and the mounting and demounting position by rotation about a rotational center of said intermediary transfer member.

12. An apparatus according to claim 5, wherein each said cartridge includes a developing roller for developing an electrostatic latent image formed on said electrophotographic photosensitive drum into a developed image, and wherein said developing roller develops the electrostatic latent image with a gap from said electrophotographic photosensitive drum with said cartridge mounted to said cartridge mounting portion.

* * * * *